US006109735A

United States Patent [19]

Kashino et al.

[11] Patent Number: 6,109,735

[45] Date of Patent: Aug. 29, 2000

[54] LIQUID DISCHARGING METHOD, LIQUID SUPPLYING METHOD, LIQUID DISCHARGE HEAD, LIQUID DISCHARGE HEAD CARTRIDGE USING SUCH LIQUID DISCHARGE HEAD, AND LIQUID DISCHARGE APPARATUS

[75] Inventors: Toshio Kashino, Chigasaki; Hiroyuki Ishinaga, Tokyo; Hirokazu Tanaka, Yokohama; Makiko Kimura, Matto; Takeshi Okazaki, Sagamihara; Aya Yoshihira; Kiyomitsu Kudo, both of Yokohama; Yoshie Asakawa, Nagano-ken, all of Japan

[73] Assignee: Canon Kabushiki Kaisha, Tokyo, Japan

[21] Appl. No.: 08/870,320

[22] Filed: Jun. 6, 1997

[30] Foreign Application Priority Data

| | | | |
|---|---|---|---|
| Jun. 7, 1996 | [JP] | Japan | 8-145941 |
| Jul. 12, 1996 | [JP] | Japan | 8-183576 |
| May 23, 1997 | [JP] | Japan | 9-133550 |

[51] Int. Cl.[7] ..... B41J 2/05; B41J 2/175

[52] U.S. Cl. ..... 347/65; 347/85

[58] Field of Search ..... 347/65, 63, 85

[56] References Cited

U.S. PATENT DOCUMENTS

| | | | |
|---|---|---|---|
| 4,480,259 | 10/1984 | Kruger et al. | 347/63 |
| 4,496,960 | 1/1985 | Fischbeck . | |
| 4,509,063 | 4/1985 | Sugitani et al. . | |
| 4,558,333 | 12/1985 | Sugitani et al. . | |
| 4,568,953 | 2/1986 | Aoki et al. . | |
| 4,596,994 | 6/1986 | Matsuda | 347/64 |
| 4,611,219 | 9/1986 | Sugitani et al. . | |
| 4,698,645 | 10/1987 | Inamoto . | |
| 4,723,129 | 2/1988 | Endo et al. . | |
| 4,723,136 | 2/1988 | Suzumura . | |
| 4,896,171 | 1/1990 | Ito | 347/63 |
| 5,262,802 | 11/1993 | Karita et al. . | |
| 5,278,585 | 1/1994 | Karz et al. | 347/65 |
| 5,296,875 | 3/1994 | Suda . | |
| 5,389,957 | 2/1995 | Kimura et al. . | |
| 5,458,254 | 10/1995 | Miyagawa et al. | 347/63 |
| 5,467,112 | 11/1995 | Mitani | 347/1 |
| 5,485,184 | 1/1996 | Nakagomi et al. . | |
| 5,821,962 | 10/1998 | Kudo | 347/65 |

FOREIGN PATENT DOCUMENTS

| | | | |
|---|---|---|---|
| 0436047 | 7/1991 | European Pat. Off. | B41J 2/055 |
| 0443798 | 8/1991 | European Pat. Off. | B41J 2/14 |
| 0496533 | 7/1992 | European Pat. Off. | B41J 2/055 |
| 0538147 | 4/1993 | European Pat. Off. | B41J 2/195 |
| 0 655 337 | 5/1995 | European Pat. Off. | B41J 2/205 |
| 61-59914 | 2/1980 | Japan | B41J 3/04 |
| 55-81172 | 6/1980 | Japan | B41J 3/04 |
| 55-100169 | 7/1980 | Japan | B41J 3/04 |
| 59-199256 | 11/1984 | Japan | B41J 3/04 |

(List continued on next page.)

*Primary Examiner*—John Barlow
*Assistant Examiner*—Juanita Stephens
*Attorney, Agent, or Firm*—Fitzpatrick, Cella, Harper & Scinto

[57] ABSTRACT

A liquid discharging method is provided with heat generating elements for creating air bubbles for discharging liquid, discharge ports arranged corresponding to the heat generating elements, first liquid flow paths conductively connected with the discharge ports, second liquid flow paths arranged corresponding to the heat generating elements, and a separation wall to separate the first and second liquid flow paths. This separation wall is provided with the free end, which is caused to be displaced to the first liquid flow side by pressure exerted by air bubbles created by the heat generating elements, thus leading the pressure toward the discharge port side for discharging liquid from the discharge ports. For this liquid discharging method, liquids are supplied to the second liquid flow paths and to the first liquid flow paths from different sides, respectively, in order to stabilize the flow of liquid for the enhancement of the discharging efficiency and power, while reducing the influence of cavitation with respect to the heat generating elements to make the life thereof longer.

35 Claims, 24 Drawing Sheets

FOREIGN PATENT DOCUMENTS

| | | | |
|---|---|---|---|
| 61-69467 | 4/1986 | Japan | B41J 3/04 |
| 61-110557 | 5/1986 | Japan | B41J 3/04 |
| 62-156969 | 7/1987 | Japan | B41J 3/04 |
| 62-202740 | 9/1987 | Japan | B41J 3/04 |
| 62-240558 | 10/1987 | Japan | B41J 3/04 |
| 62-48585 | 10/1987 | Japan | B41J 3/04 |
| 63-102945 | 5/1988 | Japan | B41J 3/04 |
| 63-197652 | 8/1988 | Japan | B41J 3/04 |
| 63-199972 | 8/1988 | Japan | B41J 3/04 |
| 1-027955 | 1/1989 | Japan | B41J 3/04 |
| 2-113950 | 4/1990 | Japan | B41J 2/175 |
| 3-81155 | 4/1991 | Japan | B41J 2/02 |
| 5-124189 | 5/1993 | Japan | B41J 2/05 |
| 6-31918 | 2/1994 | Japan | B41J 2/05 |
| 6-87214 | 3/1994 | Japan | B41J 2/05 |

FIG. 1A - PRIOR ART
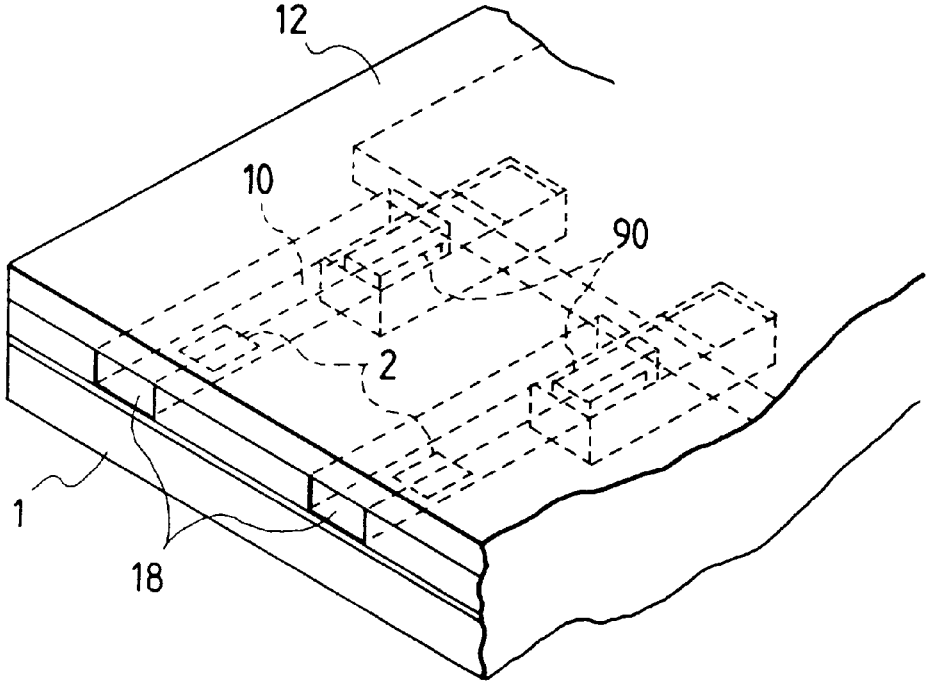
FIG. 1B - PRIOR ART
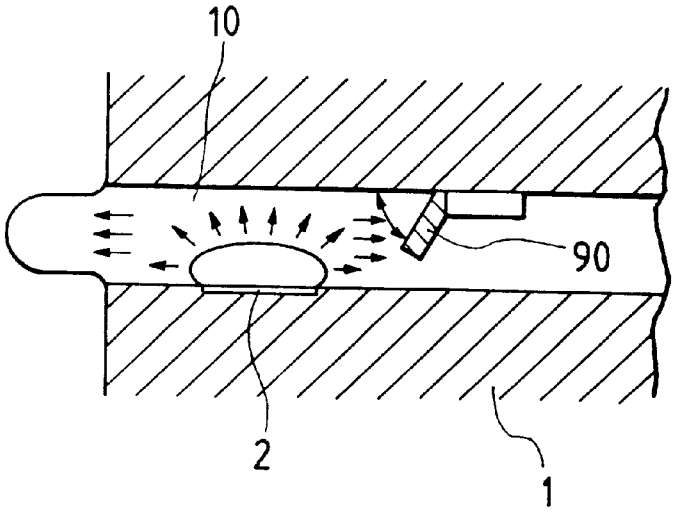

FIG. 4 - PRIOR ART
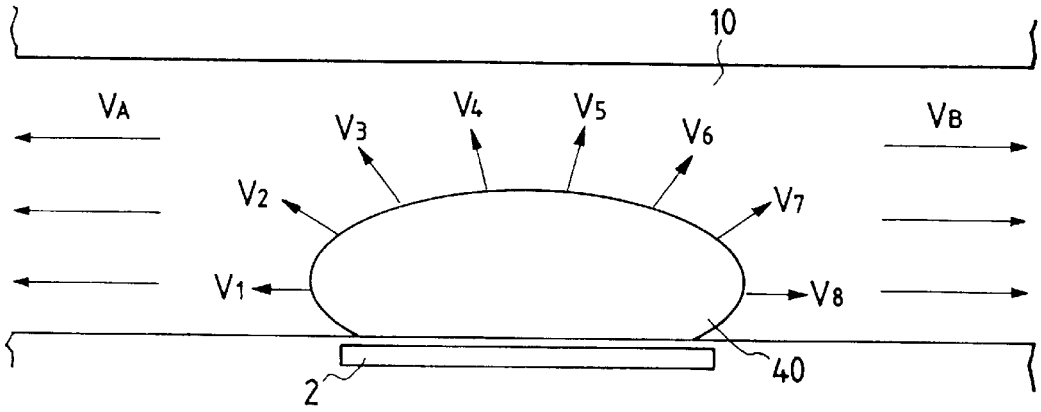
FIG. 5
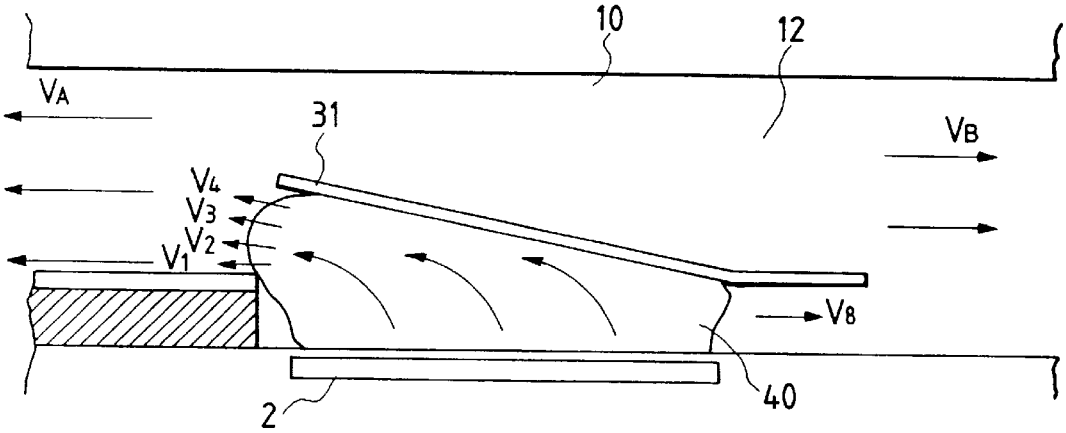
FIG. 6
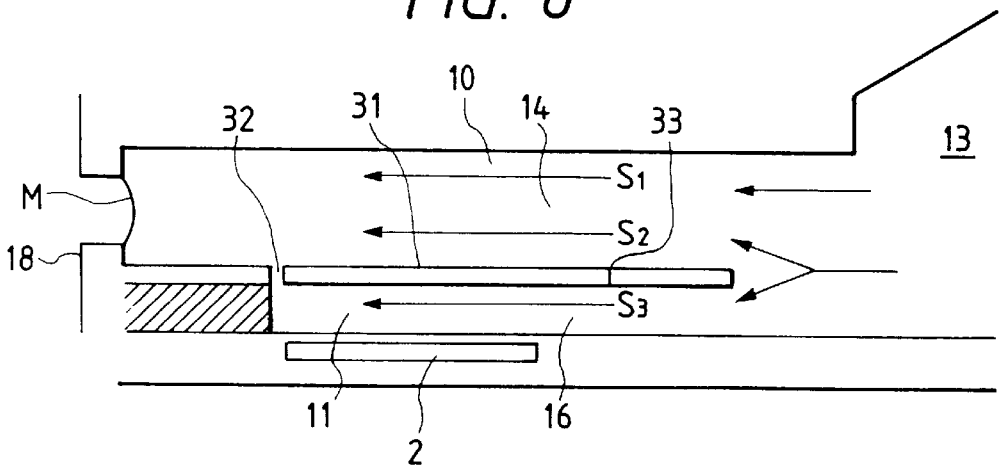

50
14
33
31
32
18
11
40
2
621
619
623
636
630
620
1
35

LIQUID DISCHARGING METHOD, LIQUID SUPPLYING METHOD, LIQUID DISCHARGE HEAD, LIQUID DISCHARGE HEAD CARTRIDGE USING SUCH LIQUID DISCHARGE HEAD, AND LIQUID DISCHARGE APPARATUS

BACKGROUND OF THE INVENTION

1. Field of the Invention

The present invention relates to a liquid discharging method for discharging a desired liquid by creating air bubbles by means of thermal energy applied to the liquid, a liquid discharge head, a liquid discharge head cartridge using such liquid discharge head, and a liquid discharge apparatus.

More particularly, the invention relates to a liquid discharge head having a movable member that can be displaced by the utilization of the creation of air bubbles, a liquid supplying method, a head cartridge using such liquid discharge head, and a liquid discharge apparatus.

Also, the present invention is applicable to a printer that records on a recording medium, such as paper, thread, fiber, cloth, leather, metal, plastic, glass, wood, or ceramic, as well as to a copying machine, a facsimile equipment provided with communication systems, a word processor provided with a printing unit, among some others. The invention is further applicable to a complex recording apparatus for the industrial use, which is combined with various processing systems.

2. Related Background Art

There has been known the so-called bubble jet recording method, which is an ink jet recording method whereby to form images on a recording medium by discharging ink from discharge ports using acting force exerted by the change of states of ink brought about by the abrupt voluminal changes (creation of air bubbles) when thermal energy or the like is applied to ink in accordance with recording signals. For the recording apparatus that uses the bubble jet recording method, it is generally practiced to provide, as disclosed in the specifications of U.S. Pat. No. 4,723,129 and others, the discharge ports that discharge ink, the ink paths conductively connected to the discharge ports, and electrothermal transducing elements arranged in each of the ink paths as means for generating energy for discharging ink. Then, it is generally practiced for the bubble jet recording method that the air bubbles are developed by means of film boiling generated in liquid.

In accordance with such recording method, it is possible to record high quality images at high speeds with a lesser amount of noises. At the same time, the head that executes this recording method makes it possible to arrange the discharge ports for discharging ink in high density, with the advantage, among many others, that images are recordable in high resolution, and that color images are easily obtainable by use of a smaller apparatus. In recent years, therefore, the bubble jet recording method is widely adopted for many kinds of office equipment, such as a printer, a copying machine, a facsimile equipment, and further utilized for industrial systems, such as a textile printing, among others.

Along the wider utilization of bubble jet technologies and techniques for various products in many different fields, there have been increasingly more demands technically in recent years as given below.

For example, as to the demand on the improvement of energy efficiency, the adjustment of the thickness of protection film has been studied to optimize the performance of heat generating elements. A study of the kind has produced effects on the enhancement of efficiency of generated heat transferred to ink or other liquids. Also, in order to obtain high quality images, there has been proposed a driving condition under which a liquid discharging method or the like is arranged to be able to execute good ink discharge at higher ink discharging speeds with more stabilized creation of air bubbles. Also, from the viewpoint of a high-speed recording, there has been proposed the improved configuration of liquid flow paths that makes it possible to obtain a liquid discharge head capable of refilling liquid to the liquid flow paths at higher speeds after discharging.

Of the various configurations of liquid flow paths thus proposed, those represented in FIGS. 1A and 1B are disclosed in the specification of Japanese Patent Application Laid-Open No. 63-199972 as a liquid flow path structure. The liquid flow path structure and a method for manufacturing heads disclosed in the specification thereof are the inventions devised with attention to the back waves (the pressure orientated opposite to the direction toward the discharge ports, that is, pressure exerted in the direction toward the liquid chamber 12). The back waves are known as energy loss because such energy is not exerted in the discharging direction.

For the liquid flow path configuration represented in FIGS. 1A and 1B, each of the heat generating elements 2 is provided on an elemental substrate 1. At the same time, each of the valves 90 is arranged in a position opposite to the side where each heat generating element 2 is formed, which is away from the region where the air bubble is created by means of the heat generating element 2. The valve 90 keeps an initial position as if it adheres to the ceiling of the liquid flow path 10 as shown in FIG. 1B by a method of manufacture that utilizes a board material or the like, and then, hangs down into the liquid flow path 10 as an air bubble is being created. In accordance with the invention shown in conjunction with FIGS. 1A and 1B, the back waves described above are partly controlled by use of the valve 90, thus suppressing the progress of the back waves toward the upstream side with the intention to reduce the energy loss. However, as clear from the precise studies on the process in which each of the air bubbles is created, suppressing the back waves partly by the provision of the valve 90 in the interior of the liquid flow path that holds discharging liquid is not practicable with respect to discharging. In other words, the back waves themselves are not directly concerned with discharging fundamentally in this system. As shown in FIG. 1A, the moment the back waves are generated in the liquid flow path 10, the pressure exerted by means of the air bubble that directly concerned with discharging has already acted upon liquid to be discharged from the liquid flow path 10. Therefore, even if the back waves are totally suppressed, it is obvious that a suppression of the kind does not affect discharging greatly, not to mention its partial suppression.

Meanwhile, as to the bubble jet recording method, the heat generating elements repeat heating while the elements are kept in contact with ink. Therefore, sedimentary deposit is made on the surface of each element due to burning of ink. Depending on the kinds of ink, such sedimentary deposit is often produced to make the creation of air bubbles instable, leading to the difficulty in discharging ink in good condition. Also, it has been desired to provide a good method whereby to discharge liquid without changing its quality even when such liquid is the one that easily deteriorates by the application of heat or the one that does not easily provide a sufficient foaming.

From these points of view, it has been proposed and disclosed in the specifications of Japanese Patent Application Laid-Open No. 61-69467, Japanese Patent Application Laid-Open No. 55-81172, and U.S. Pat. No. 4,480,259 that the liquid (foaming liquid) that creates air bubbles by means of heat and the liquid (discharging liquid) that can be discharged are prepared as separate liquids, and then, the discharging liquid is discharged by the transfer of pressure exerted by foaming to the discharging liquid. In these specifications, the structure is arranged so that ink serving as the discharging liquid and the foaming liquid are completely separated by means of a flexible film such as silicon rubber, and at the same time, the foaming pressure of the foaming liquid is transferred to the discharging liquid by the deformation of such flexible film, while the discharging liquid is prevented from being directly in contact with the heating elements. With a structure of the kind, it is made possible to prevent sedimentary deposit on the surface of the heat generating elements, and also, contribute to widening the selection range of discharging liquids.

However, as to the head thus structured to separate the discharging liquid and foaming liquid completely, the arrangement is made so that the foaming pressure is transferred to the discharging liquid by means of deformation effectuated by the expansion and contraction of the flexible film. Therefore, the foaming pressure tends to be absorbed by the flexible film to a considerable extent. Also, the degree of deformation cannot be made sufficiently large for the flexible film. As a result, although it is possible to obtain an effect to separate the discharging liquid and foaming liquid, there is a fear that energy efficiency and discharging force are inevitably lowered.

Now, when air bubbles are created in liquid by heating it using electrothermal transduing elements or the like, there is a possibility that electrothermal transducing elements are damaged due to cavitation brought about at the time of defoaming following the contraction of each of the created air bubbles. To counteract this, it is generally practiced that an anti-cavitation layer formed by tantalum or the like is provided for the surface including the electrothermal transducing elements of a liquid discharge head of the kind. In order to enhance the reliability more, it is also important to consider means for preventing such cavitation more effectively.

SUMMARY OF THE INVENTION

As described above, the further enhancement of discharging characteristics is desired for the method for discharging liquid by forming air bubbles (particularly, air bubbles created following film boiling) in each of the liquid flow paths. Under the circumstance, therefore, the inventors have reverted to making studies on the principle of the discharge of droplets and made the technical analyses given below in order to provide a new droplet discharging method utilizing air bubbles, as well as heads and others to be used therefor. The first technical analysis is to begin with the operation of the movable member in each of the liquid flow paths, such as an analysis on the principle of the mechanism of such movable member in the liquid flow path. The second analysis is to begin with the principle of droplet discharging by means of air bubbles, and the third analysis is to begin with the bubble generation area of each heat generating element for use of air bubble creation. As a result, while giving light upon the aspects that have not been taken into consideration for the conventional art, it is made possible to improve the fundamental discharging characteristics of the liquid discharging method for creating each of the air bubbles (particularly, the air bubble following film boiling) in each of the liquid flow paths to such a high level that cannot be anticipated in accordance with the conventional art.

In other words, the inventors have established a completely new technique to control air bubbles positively by arranging the positional relationship between the pivot of a movable member and the free end thereof in such a manner as to locate the free end on the discharge port side, that is, on the downstream side or by arranging the movable member to face each heat generating element or the area where the air bubbles are created. The invention based upon the new technique has been filed as an application for a patent. More specifically, in terms of energy to be given to a discharging amount by an air bubble itself, the developing component of the air bubble on the downstream side should be taken in consideration as the greatest element for the remarkable enhancement of the discharging characteristics. In other words, it has been found that the developing component of the air bubble on the downstream side should be converted efficiently to be in the direction of discharging in order to enhance the discharging efficiency and the discharging speed as well. With this in view, it has been arranged to positively shift the developing component of the air bubble on the downstream side to the free end side of the movable member, thus completing the invention having an extremely high technical standard as compared to the conventional liquid discharging method.

In accordance with this invention, there are disclosed the heat generating area for the creation of each of the air bubbles, that is, the downstream side of the center line passing the center of each area of electrothermal transducing elements in the flowing direction of liquid, for example, or structural elements, such as each movable member and liquid flow path, which are related to the development of each air bubble on the downstream side of the center of the area for its creation. Also, it is disclosed that the refilling speed is significantly enhanced by giving particular attention to the arrangement of each movable member and the structure of each of the liquid supply paths.

In addition to the techniques described above, the inventors have devised the structure of the liquid flow paths and the configuration of the heat generating elements to suppress the back waves and the developing component of each air bubble that progress in the direction opposite to the liquid supply direction, while effectuating the further enhancement of discharging power, thus leading to the introduction of an epoch-making technique that makes it possible to orientate the flow of the discharging liquid in one way.

Particularly, with the present invention, it is aimed to utilize the discharging principle described above more effectively, while giving attention to the formation of structure that enables liquid to be supplied underneath a movable member. Then, the structure is improved to introduce an epoch-making technique that makes it possible to obtain a stabilized discharge performance by means of an extremely simple structure.

More specifically, the main objectives of the present invention are as follows:

A first object of the invention is to provide a liquid discharge head and a liquid supplying method that implement a more compact head structure using the completely new liquid discharging technique obtainable from the knowledge described above, and also, to provide a liquid discharge head cartridge using such liquid discharge head and a liquid discharge apparatus as well.

It is a second object of the invention to provide a liquid discharging method and a liquid discharge head capable of stabilizing the flow of liquid to be discharged by suppressing the developing component of air bubbles and pressure waves (back waves) in the direction opposite to the liquid supply direction.

It is a third object of the invention is to provide a liquid discharging method and a liquid discharge head capable of preventing cavitation from being produced on the heat generating elements (electrothermal transducing elements or the like).

In order to achieve the objectives described above, a first liquid discharging method of the present invention is to comprise heat generating elements that create air bubbles for discharging liquid; discharge ports arranged for the heat generating elements; a first liquid flow path conductively connected with the discharge ports; a second liquid flow path arranged for the heat generating elements; and a separation wall that separates the first and second liquid paths. The separation wall has a free end on the discharge port side to lead the pressure to the discharge port side by displacing the free end thereof to the first liquid flow path side by means of the pressure exerted by the creation of air bubbles by means of heat generating elements, thus enabling liquid to be discharged from the discharge ports. For this method, it is arranged to perform liquid supply to the second liquid flow path and liquid supply to the first liquid flow path from the different sides, respectively.

A second liquid discharging method of the present invention is to use a head provided with discharge ports for discharging liquid, air bubble generating areas, and movable members each arranged to face each of the air bubble generating areas, which can be displaced between a first position and a second position arranged further away from the air bubble generating area than the first position, and liquid is supplied at least to each air bubble generating area to enable the movable member to be displaced from the first position to the second position by means of pressure exerted by the creation of each air bubble in the air bubble generating area, and then, the air bubble is expanded to the discharge port side by means of the displacement of the movable member, thus discharging liquid from each of the discharge ports. For this method, liquid supply to each of the air bubble generating areas is performed from the side end facing each of the movable members. More specifically, an arrangement should be made to supply liquid by way of the through hole, which is provided for the air bubble generating area.

A third liquid discharging method of the present invention is to discharge liquid from discharge ports by the creation of air bubbles. For this method, there is used a head provided with liquid paths conductively connected with discharge ports, air bubble generating areas having heat generating elements to create air bubbles, and movable members each having a free end on the discharge port side, which is arranged between each of the liquid flow paths and air bubble generating areas, and then, a first liquid is supplied to the liquid flow path, while a second liquid is supplied to the air bubble generating area from the side end facing the movable member, respectively, thus causing each heat generating element to create each of the air bubbles to displace the free end of the movable member to the liquid flow path side by means of the pressure exerted by the creation of the air bubble, and then, the pressure is led to the discharge port side of the liquid flow path by the displacement of each movable member. In this case, each heat generating element may be arranged in a position facing the discharge port so that each movable member resides between the heat generating element and the discharge port to lead the pressure by the displacement of the movable member to the discharge port side facing the heat generating element. Also, the first liquid and the second liquid may be the same one or different ones.

In accordance with the liquid discharging method of the present invention, liquid in the vicinity of each discharge port can be discharged efficiently because of the mutually potentiating effect of the created air bubble and the movable member to be displaced thereby, and discharging efficiency is enhanced as compared with the conventional liquid discharge head. Also, it is possible to attempt making the apparatus smaller by arranging to supply liquid to the first liquid flow path and to the second liquid flow path from different sides, respectively. Further, liquid is supplied from the surface that faces the movable member, that is, the lower side of each heat generating element. Therefore, it becomes possible to suppress the developing component of each air bubble and pressure waves propagated in the direction opposite to the direction of liquid supply, while attempting the enhancement of discharging power. The flow of discharging liquid can be confined to one direction, thus implementing the stabilized liquid flow and discharging. Furthermore, by arranging a structure so that a through hole is provided for the location where cavitation takes place for each of the heat generating elements, it becomes possible to make the life of heat generating elements longer, for example.

The liquid supplying method of the present invention comprises heat generating elements for creating air bubbles to discharge liquid, discharge ports corresponding to the heat generating elements, first liquid flow paths conductively connected with the discharge ports, second liquid flow paths arranged for the heat generating elements, and separation wall to separate the first and second liquid flow paths. The separation wall has its free end on the discharge port side. This liquid supplying method is such that using the pressure exerted by the air bubble created by each of the heat generating elements, the free end is displaced to the first liquid flow path side, thus leading the pressure to the discharge port side. Liquid supply to the second liquid flow path and liquid supply to the first liquid flow path are performed from different sides, respectively.

For this liquid supplying method, a through hole is provided for the substrate having heat generating elements arranged on it, and it may be possible to perform liquid supply to the second liquid flow path by way of the through hole from the reverse side of the supporting element that fixes the substrate. Further, with the separation wall configured to be almost U-shaped, the separation wall is fixed to cover the substrate having the heat generating elements arranged on it, and it may be possible to perform liquid supply to the second liquid flow path through a gap formed between the side end of the substrate and the side wall of the separation wall from the reverse side of the supporting element that fixes the substrate. Further, a plurality of substrates each having heat generating elements arranged on it are fixed on a supporting element so that each interval between the heat generating elements is made equal, and it may be possible to perform liquid supply to the second liquid flow path through each gap formed between the side walls of the substrates from the supporting element side. In this case, the separation wall is configured to be almost U-shaped, and fixed to cover each of the substrates, and it may be possible to perform further the liquid supply to the second liquid flow path through each gap formed between the side end of each substrate and the side wall of the separation wall from the supporting element side.

A first liquid discharge head of the present invention comprises heat generating element for creating air bubbles to discharge liquid; discharge ports arranged for the heat generating elements; a first liquid flow path conductively connected with each of the discharge ports; a second liquid flow path arranged for each of heat generating elements, and a separation wall for separating the first and second liquid flow paths. The separation wall has the free end on the discharge port side. This liquid discharge head leads pressure to the discharge port side by displacing the free end to the first liquid flow path side using the pressure exerted by each air bubble created by each of the heat generating elements, and a first liquid supply path conductively connected with the first liquid flow path and a second liquid supply path conductively connected with the second liquid flow path are arranged on different sides, respectively.

For this liquid discharge head, a substrate having heat generating elements arranged on it is fixed to a supporting element. The substrate is provided with a through hole, and it may be possible to arrange a structure so that the second liquid supply path is formed by a passage conductively connected with the second liquid flow path from the supporting element side by way of the through hole. Also, the substrate having heat generating elements arranged on it is fixed on the supporting element, while the separation wall is configured to be almost U-shaped and fixed to cover the substrate, and it may be possible to arrange a structure so that the second liquid supply path is formed by a passage conductively connected with the second liquid flow path from the supporting element side through the gap formed between the side end of the substrate and the side wall of the separation wall. Further, a plurality of substrates each having heat generating elements arranged on it are fixed on a supporting element so that each interval between the heat generating elements is made equal, and it may be possible to arrange a structure so that the second liquid supply paths is formed by a passage conductively connected with the second liquid flow path from the supporting element side through each gap formed between the side walls of the substrates. In this case, the separation wall is configured to be almost U-shaped, and fixed to cover each of the substrates, and it may be possible to arrange a structure so that the second liquid supply path includes a passage conductively connected with the second liquid flow path from the supporting element side through each gap formed between the side end of each substrate and the side wall of the separation wall.

For the liquid discharge head provided with the free end on the discharge port side and structured to lead pressure to the discharge port side by displacing the free end to the first liquid flow path side by means of the pressure generated by each of the air bubbles created by each heat generating elements, liquid supplies to the first and second liquid flow paths are performed by different passages, respectively. In this case, if the second liquid supply system is arranged behind the first liquid supply system, and liquid is supplied from above to both of them, the head is made inevitably larger, and further, it becomes necessary to provide through holes on the ceiling plate and separation wall. Therefore, the structure of the head becomes complicated. In accordance with the present invention, each of the liquid supply paths to the first and second liquid flow paths is arranged on the different sides, respectively, thus making it possible to make the apparatus smaller. Further, with the structure where liquid is supplied from the supporting element side to the second liquid flow path, there is no need for providing any through hole on the ceiling plate or the separation wall in order to supply liquid to the second liquid flow path. As a result, it is possible to attempt making the structure of the head simpler. Particularly, for the structure where a plurality of substrates are arranged and liquid is supplied to each of the second liquid flow paths through the gaps formed between substrates, there is no need for providing any through hole, hence making it possible to further simplify the head structure. In addition, liquid is supplied to each of the second liquid flow paths formed on each of the substrates is performed from both sides of the substrates. As a result, liquid is supplied efficiently and stably.

A second liquid discharge head of the present invention comprises discharge ports for discharging liquid; heat generating elements to create air bubbles by heating liquid; and movable members each having the free end and pivot, the movable member being displaced by means of pressure exerted by the creation of each air bubble. This liquid discharge head discharges liquid from the discharge ports by the displacement of the movable member, and also, a through hole is provided for the heat generating elements to make it possible to supply liquid onto each of the heat generating elements by way of the through hole.

A third liquid discharge head of the present invention comprises discharge ports for discharging liquid; liquid flow paths conductively connected with the discharge ports; air bubble generating area provided with heat generating elements to create air bubbles; and movable members each having free end on the discharge port side arranged between each liquid flow path and air bubble generating area to lead the free end to the liquid flow path side by means of pressure generated by the creation of each air bubble in the air bubble generating area. This liquid discharge head is provided with a first supply path to supply liquid to the liquid flow path and a second supply path to supply liquid to the air bubble generating area by way of a through hole. This liquid discharge head is provided with heat generating elements in a position facing each of the discharge ports, and it may be possible to reside the movable member between the discharge port and the heat generating element to lead pressure to the discharge port side facing the heat generating element by the displacement of the movable member by means of each of the air bubbles. For the structure where this liquid flow path and air bubble generating are arranged, it may be possible to make the first liquid and the second liquid the same one or different ones.

It is preferable to create air bubbles by means of film boiling phenomenon generated in liquid by the application of heat of the heat generating elements for each of the liquid discharge head described above.

A liquid discharge head cartridge of the present invention is provided with either one of the liquid discharge heads described above, and a first and second liquid containers to supply the first and second liquid through the first and second liquid supply paths of the liquid discharge head. In this case, it may be possible to structure the liquid discharge head, and the first and second liquid containers separable.

A liquid discharge apparatus of the present invention mounts either one of the liquid discharge heads described above on a carriage that can reciprocate in the sub-scanning direction for recording on a recording medium. In this respect, the terms "upstream" and "downstream" used for describing the present invention are related to the flowing direction of liquid toward each of the discharge ports from the liquid supply source through each of the air bubble generating areas (or each of the movable members) or used to represent the directions with respect to this structure.

Also, the terms "downstream side" regarding the air bubble itself chiefly represents the portion of an air bubble on the discharge port side that directly acts upon the discharges of droplets. More specifically, it means the flow direction described above and the downstream side in the direction of the structure described above with respect to the center of an air bubble or it means an air bubble to be created in the area on the downstream side of the center of the area of the heat generating element.

For the present invention, the terms "recording" means not only the provision of images representing characters and graphics for a recording medium, but also, it means the provision of images representing patterns or the like therefor.

BRIEF DESCRIPTION OF THE DRAWINGS

FIGS. 1A and 1B are views illustrating the structure of liquid flow paths for the conventional liquid discharge head.

FIG. 4 is a schematic view showing the pressure propagation from an air bubble in accordance with the conventional liquid discharge head.

FIG. 5 is a schematic view showing the pressure propagation from an air bubble in accordance with a liquid discharge head using the liquid discharging principle represented in FIGS. 1A and 1B.

FIG. 6 is a schematic view illustrating the flow of liquid in accordance with the liquid discharge head of the present invention.

DETAILED DESCRIPTION OF THE PREFERRED EMBODIMENTS

Figure 2A:
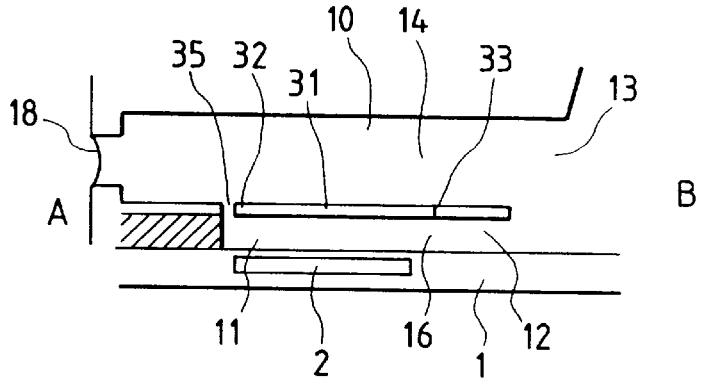
FIGS. 2A, 2B, 2C and 2D are cross-sectional views which schematically illustrate the liquid discharging process in accordance with the liquid discharging principle of the present invention.

Now, with reference to the accompanying drawings, the description will be made of the embodiments in accordance with the present invention.

(The liquid discharging principle upon which the present invention has been made)

At first, preceding the description of the embodiments of the present invention, the description will be made of the liquid discharging principle upon which the invention has been made. In accordance with such principle, a movable member is arranged for each of the liquid paths, and then, the propagating direction of the pressure exerted by each of the air bubbles and the developing direction of each air bubble for discharging liquid are controlled by means of such movable member. Hence, it is attempted to enhance the discharging power and the discharging efficiency as well.

FIGS. 2A to 2D are cross-sectional views showing a liquid discharge head, taken in the direction of its liquid flow paths, illustrating the process of droplet discharge sequentially in accordance with the discharging principle. Also, FIG. 3 is a partially broken perspective view showing the liquid discharge head.

For this liquid discharge head, heat generating elements 2 (here, each in a configuration of 40 μm×105 μm, for example) are arranged on an elemental substrate 1 as discharging energy generating elements to enable thermal energy to act upon liquid for discharging it. On the elemental substrate 1, liquid flow paths 10 are arranged for the heat generating elements 2. Each liquid flow path 10 is conductively connected with each of the discharge ports 18, and at the same time, it is conductively connected with a common liquid chamber 13 that supplies liquid to a plurality of liquid flow paths 10. It is also arranged that each of the liquid paths receives liquid from the common liquid chamber 13 in an amount corresponding to that of the liquid discharged from the discharge port 18.

In the position of the elemental substrate 1 that faces each liquid flow path 10, a flat movable member 31 having a flat portion, formed by an elastic metal or the like, is arranged in a cantilever fashion to face the heat generating element 2. One end of the movable member 31 is fixed to a stand (a supporting member) 34 or the like formed by patterning a photosensitive resin or the like applied to the wall of the liquid flow path 10 and the elemental substrate 1. In this way, the movable member 31 is held, and also, a pivot (a pivotal section) 33 is structured.

The movable member 31 has the pivot (pivotal section: fixed end) 33 on the upstream side of the large flow running from the common liquid chamber 13 to the discharge port side 18 through the movable member 31 when operating liquid discharge. This member is arranged away from the heat generating element 2 by approximately 15 μm, for example, in a state that the member covers the heat generating element 2 in a location to face the heat generating element 2 so that the member has its free end (free end section) 32 on the downstream side with respect to the pivot 33. Between the heat generating element 2 and the movable member 31 is an air bubble generating area. The kinds, configurations, and arrangement of the heat generating element 2 and the movable member 31 are not necessarily limited to those described above. It should be good enough if only the element and member are configured and arranged so that the development of air bubbles and the propagation of pressure can be controlled as described later. In this respect, the liquid flow path 10 will be described by separating it into a first liquid flow path 14 that is directly and conductively connected with the discharge port 18, and a second liquid flow path 16 provided with the air bubble generating area 11 and the liquid supply path 12 as well, having the movable member 31 as its boundary in order to illustrate the flow of liquid, which will be also described later.

The heat generating element 2 is actuated to cause heat to act upon liquid in the air bubble generating area existing between the movable member 31 and the heat generating element 2, thus creating each of the air bubbles in liquid by means of film boiling phenomenon such as disclosed in the specification of U.S. Pat. No. 4,723,129. The pressure thus exerted by the creation of the air bubble, and the air bubble itself acts upon the movable member 31 priorly. The movable member 31 is displaced to be open largely on the discharge port side centering on the pivot 33 as shown in FIGS. 2B and 2C or in FIG. 3. By the displacement of the movable member 31 or by the displaced state thereof, the pressure exerted by the creation of the air bubble and the development of the air bubble itself are led toward the discharge port 18 side.

Here, the description will be made of one of the fundamental principles of discharge, which is applied to the present invention. For the present invention, one of the most important principles is that the movable member that is arranged to face the air bubble generating area 11 is to be displaced from a first position where it usually resides to a second position where it resides after displacement, and by means of this moving member 31, the pressure exerted by the creation of each air bubble and the air bubble itself are led toward the downstream side where the discharge ports 18 are arranged.

This principle of discharge will be described further in detail with the comparison between FIG. 4 schematically showing the conventional structure of liquid flow path without using any movable member and FIG. 5 schematically showing the structure of liquid flow path using the movable member as described above. Here, the propagating direction of pressure toward the discharge port is designated by a reference mark $V_A$, and the propagating direction of pressure toward the upstream side as $V_B$.

As shown in FIG. 4, the conventional head has no structure that regulates the propagating direction of pressure exerted by the created air bubble 40. As a result, the propagating direction of pressure exerted by the air bubble 40 becomes the normal direction on the surface of the air bubble 40 as indicated by the reference marks $V_1$ to $V_8$, respectively, and orientated toward various directions. Of these directions, those having the component in the pressure propagating directions toward the $V_A$ which affects the liquid discharge most, are designated by the marks $V_1$ to $V_4$, that is, the components in the pressure propagating directions near the discharge port from the position almost half of the air bubble. These are in the important portions that contribute directly to the effectiveness of discharging efficiency, discharging power, and discharging speed. Further, the one designated by the mark $V_1$ functions efficiently because it is nearest to the discharging direction $V_A$. On the contrary, the one designated by the mark $V_4$ contains a comparatively small directional component toward $V_A$.

Compared to this structural arrangement, the provision of the movable member as shown in FIG. 5 in accordance with the principle described above makes it possible to lead the pressure propagating directions of the air bubble, which are orientated in the various directions $V_1$ to $V_4$ in the conventional case as represented in FIG. 4, toward the downstream side (discharge port side) by means of the movable member 31, and let them change into the pressure propagating directions designated by the reference mark $V_A$, thus enabling the pressure exerted by the air bubble 40 to contribute directly and more efficiently to discharging. Then, the developing direction of the air bubble itself is led toward the downstream direction in the same manner as the pressure propagating directions $V_1$ to $V_4$. As a result, the air bubble is developed larger in the downstream side than in the upstream side. In this way, the developing direction of the air bubble itself is controlled by means of the movable member 31. Also, the pressure propagating directions of the air bubble are controlled likewise. Therefore, it becomes possible to attain the fundamental enhancement of the discharge efficiency, discharging power, and discharging speed, among others.

Now, reverting to FIGS. 2A to 2D, the discharging operation of the liquid discharge head will be described in detail.

Figure 2B:
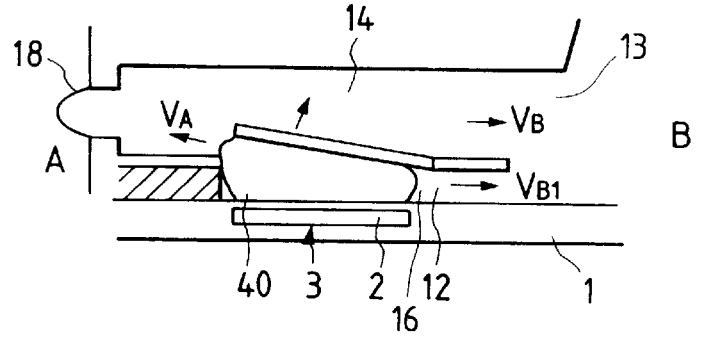
Figure 2C:
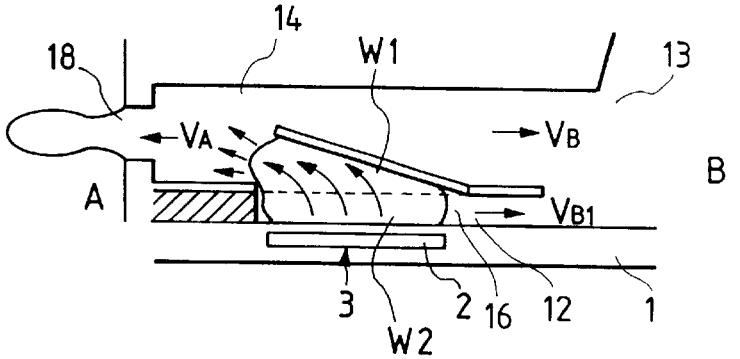
Figure 3:
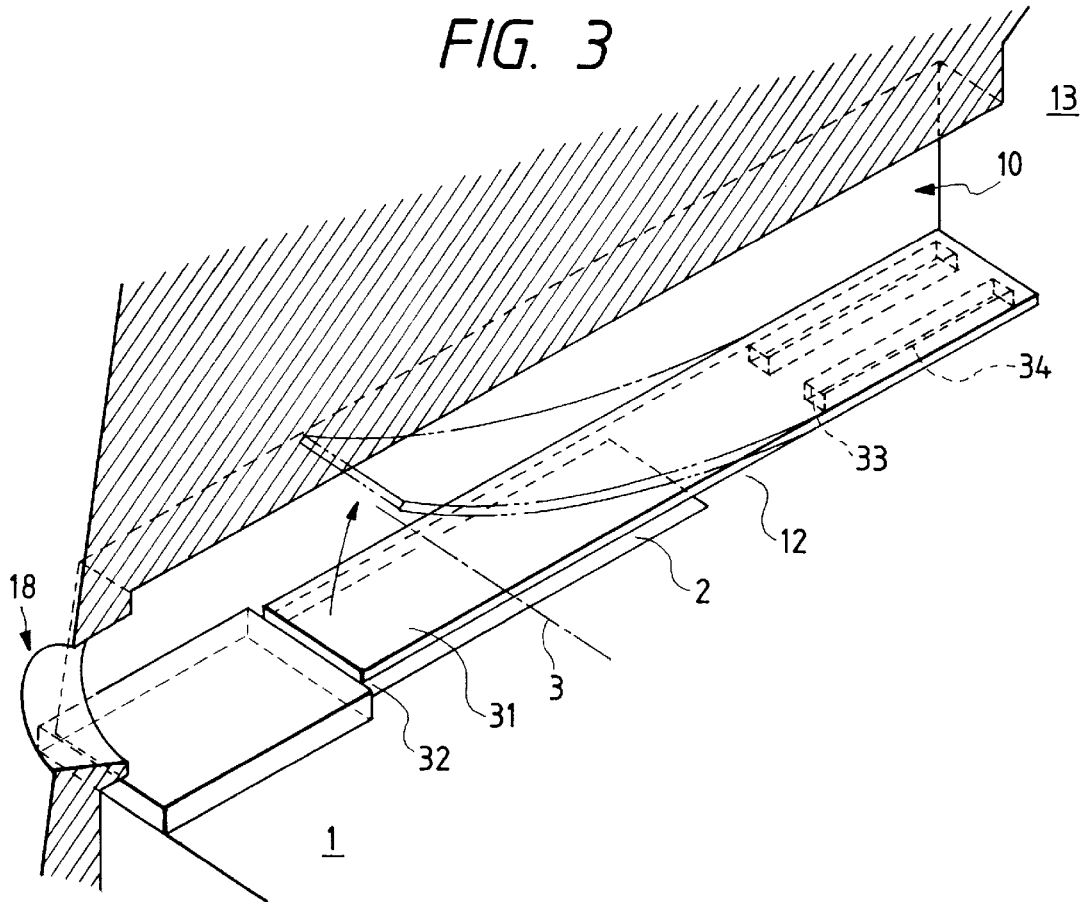
FIG. 3 is a partially broken perspective view showing the liquid discharge head to which the liquid discharging principle in FIGS. 2A, 2B, 2C and 2D is applicable.

FIG. 2A shows a state before electric energy or some other energy is applied to a heat generating element 2. The heat generating element 2 is in a state before it generates heat. What is important here is that the movable member 31 is arranged in a position to face at least the portion of an air bubble on its downstream side with respect to the air bubble 40 created by the heating of the heat generating element 2. In other words, the movable member 31 is arranged at least in a position on the downstream of the center 3 of the area of the heat generating element in the structure of the liquid flow path (that is, the downstream of a line perpendicular to the longitudinal direction of liquid flow path, which passes the center 3 of the area of the heat generating element 2) so that the downstream side of the air bubble 40 can act upon the movable member.

FIG. 2B shows a state that electric energy or some other energy is applied to the heat generating element 2 to enable the heat generating element 2 to be heated, and then, liquid filled in the air bubble generating area 11 is partly heated by the heat thus generated to create the air bubble following film boiling. At this juncture, the movable member 31 is displaced from a first position to a second position by means of pressure exerted by the creation of the air bubble 40 so as to lead the propagating direction of the pressure of the air bubble 40 toward the discharge port. What is important here is that, as described above, the free end 32 of the movable member 31 is arranged on the downstream side (discharge port side), while the pivot 33 is arranged in a position on the upstream side (common liquid chamber side) so that at least a part of the movable member 31 is brought to face the downstream portion of the heat generating element 2, that is, the downstream portion of the air bubble 40.

FIG. 2C shows a state that the air bubble 40 is further developed. Here, in accordance with the pressure following the creation of the air bubble 40, the movable member 31 is further displaced. The air bubble 40 thus created is developed larger on the downstream than the upstream, and at the same time, it is developed larger still beyond the first position of the movable member 31 (the position indicated by a dotted line). In this way, as the air bubble 40 is being developed, the movable member 31 is gradually displaced. Thus, it becomes possible to lead the developing direction of the air bubble toward the direction in which the pressure propagating direction of the air bubble 40 and its voluminal shift are easily effectuated. In other words, the developing direction of the air bubble toward the free end side is orientated to the discharge port 18 evenly. This is considered to be a factor that contributes to the enhancement of the discharging efficiency. The movable member 31 presents almost no obstacle in propagating the pressure waves in the direction of the discharge port following the air bubble or the creation of the air bubble. The propagating direction of the pressure and the developing direction of the air bubble can be controlled efficiently corresponding to the magnitude of the pressure to be propagated.

Figure 2D:
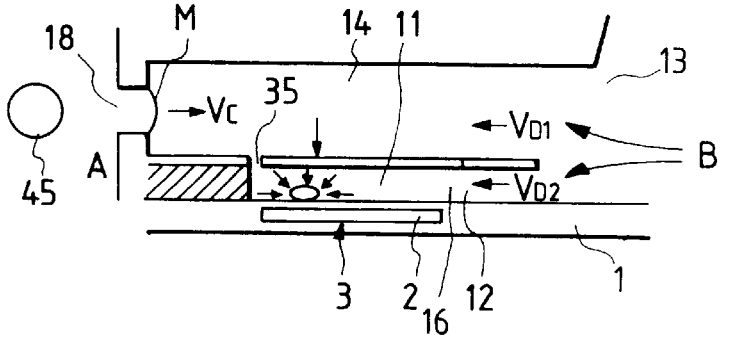

FIG. 2D shows a state that a droplet 45 is discharged and that it is in flight. At the same time, the air bubble 40 is contracted due to the reduction of the pressure in the air bubble subsequent to the film boiling described above. In this state, the air bubble disappears. Here, electric energy is no longer applied to the heat generating element 2 (at least, no energy greater than the one required to maintain the air bubble is supplied). The movable member 31, which is displaced to the second position, is returned to the initial position shown in FIG. 2A (the first position) by means of the negative pressure exerted by the contraction of the air bubble and the restoring force provided by the spring of the movable member 31 itself as well. Also, when the air bubble disappears, liquid flows in from the upstream side (B side shown in FIG. 4D), that is, from the common liquid chamber side as the flows of liquid designated by reference marks $V_{D1}$ and $V_{D2}$, and also, from the discharge port side as designated by $V_C$, in order to make up the contracted volume of the air bubble on the air bubble generating area 11, as well as the voluminal portion of liquid that has been discharged.

Now, the description has been made of the operation of the movable member following the creation of an air bubble, and also, of the discharging operation of liquid. Hereinafter, the description will be made of the liquid refilling for the liquid discharge head in detail.

Following the state shown in FIG. 2C, the air bubble 40 enters the defoaming process after its volume becomes the greatest. At this juncture, liquid that makes up the volume that has been reduced due to defoaming caused to flow in the air bubble generating area 11 from the discharge port 18 side of a first liquid flow path 14 and from the common liquid chamber 13 side of a second liquid flow path 16 as well.

For the conventional liquid flow structure that does not contain any movable member 31, the amount of liquid flowing in the defoaming position from the discharge port side and the liquid amount flowing in from the common liquid chamber are determined by the magnitude of flow resistance between the portion nearer to the discharge port than to the air bubble generating area and the portion nearer to the common liquid chamber (that is, determined by the flow resistance and the inertia). Therefore, if the flow resistance is smaller on the side near to the discharge port, a large amount of liquid flows in the defoaming position from the discharge port side, which makes the backward amount of meniscus greater. Particularly when the flow resistance on the side nearer to the discharge port is made smaller in order to enhance the discharging efficiency, the backward amount of meniscus M becomes greater. As a result, it takes more time to execute refilling, which hinders a higher speed printing.

In contrast, for the liquid discharge head using the discharging principle described above, the movable member 31 is provided. Therefore, the backward progress of the meniscus comes to a stop when the movable member 31 returns to the original position when defoaming, provided that the upper side of the volume W of the air bubble is given as $W_1$ with the first position being defined as the boundary, and the air bubble generating area 11 side as $W_2$. After that, the voluminal portion of the liquid supply for the remaining $W_2$ is made up by the liquid supply from the flow $V_{D2}$, which is mainly from the second liquid flow path. In this way, whereas the backward amount of the meniscus becomes as large as almost a half of the volume of the air bubble W conventionally, it is possible to suppress the backward amount of the meniscus to almost a half of the $W_1$, which is already smaller than the conventional backward amount of the meniscus. Further, the liquid supply for the voluminal portion $W_2$ can be executed compulsorily mainly from the upstream side ($V_{D2}$) of the second liquid flow path 16 along the surface of the movable member 31 on the heat generating side. Therefore, refilling can be implemented at a higher speed.

Here, characteristically, when refilling is executed using the pressure exerted at the time of deforming for the conventional head, the vibration of meniscus becomes great, leading to the degrading of image quality. However, with the high-speed refilling described above, it is possible to suppress and make the vibration of the meniscus extremely small, because the liquid flow is suppressed on the area of the first liquid flow path 14 on the discharge port side and the air bubble generating area 11 on the discharge port side as well.

Thus, by the adoption of the discharging principle used for the present invention, it is possible to attain the compulsory refilling to the air bubble generating area 11 through the second liquid flow path 16 of the liquid supply path 12, and also, attain a high-speed refilling by suppressing the backward progress and vibration of the meniscus. Therefore, the stabilized discharges and a high-speed repetition of discharges can be implemented. Also, when applying it to recording, the enhancement of image quality and high-speed recording can be implemented.

The liquid discharging principle described above has also the effective functions given below. In other words, it is possible to suppress the propagation of pressure exerted by the creation of the air bubble to the upstream side (back waves). Conventionally, in an air bubble created on a heat generating element, most of the pressure exerted by the air bubble on the common liquid chamber side (upstream side) becomes a force that pushes back liquid (back waves) toward the upstream side. The back waves bring about not only the pressure on the upstream side, but also, the shifting amount of liquid caused thereby, and the inertia following such shifting of liquid. This event results in the unfavorable performance of liquid refilling into the liquid flow paths, leading also to the hindrance of high-speed driving. In accordance with the liquid discharging principle described above, such action working upon the upstream side is suppressed at first by means of the movable member 31, and then, the further enhancement of refilling supply performance is made possible.

Now, the description will be made of the structures and effects characteristic to the discharging principle described above.

The second liquid flow path 16 is provided with a liquid supply path 12 having the inner wall (the surface of the heat generating element does not fall remarkably) which is essentially connected with the heat generating element 2 flatly on the upstream of the heat generating element 2. In this case, the liquid supply to the air bubble generating area and to the surface of the heat generating element 2 is executed as indicated by the reference mark $V_{D2}$ along the surface on the side nearer to the air bubble generating area 11 of the movable member 31. As a result, the stagnation of liquid on the surface of the heat generating element 2 is suppressed to make it possible to easily remove the deposition of gas remaining in liquid, as well as the so-called remaining bubbles yet to be defoamed. Also, there is no possibility that the heat accumulation on liquid becomes too high. Therefore, it is possible to perform more stabilized creation of bubbles repeatedly at high speeds. In this respect, the description has been made of the liquid supply path 12 having an inner wall, which is essentially flat, but the present invention is not necessarily limited to it. It should be good enough if only the liquid supply path has a smooth inner wall connected with the surface of the heat generating element smoothly, and is configured so that there is no possibility that liquid is stagnated on each of the heat generating elements and that any large disturbance of flow takes place in supplying liquid.

Also, the liquid supply to the air bubble generating area is executed from the $V_{D1}$ through the side portion (slit 35) of the movable member. However, in order to lead the pressure toward the discharge port more effectively when each of the air bubbles is created, a large movable member is adopted to cover the entire area of the air bubble generating area (to cover the surface of the heat generating element totally) as shown in FIGS. 2A to 2D. In this case, the liquid flow from the $V_{D1}$ to the air bubble generating area 11 may be blocked if the mode is such that the flow resistance between the air bubble generating area 11 and the area near to the discharge port on the first liquid flow path 14 becomes larger when the movable member 31 returns to the first position. With the head structure described above, there is provided the flow $V_{D1}$ for liquid supply to the air bubble generating area. As a result, the liquid supply performance becomes extremely high, and there is no possibility that the liquid supply performance is lowered even if the structure is arranged so that the movable member 31 covers the air bubble generating area 11 totally for the enhancement of discharging efficiency.

Now, as to the positions of the free end 32 of the movable member 31 and the pivot 33, it is arranged that the free end is relatively on the downstream side than the pivot as shown in FIG. 6. Since the structure is arranged in this way, it becomes possible to implement the function to lead the pressure propagating direction and developing direction of the air bubble toward the discharge port side effectively when foaming is effectuated as described earlier. Further, with this positional relationship, it is made possible to produce not only favorable effects on the discharging functions, but also, make the flow resistance smaller for liquid running in the liquid flow path 10 as liquid is being supplied, thus obtaining the effect that refilling is possible at higher speeds. This is because, as shown in FIG. 6, the free end and the pivot 33 are arranged not to present resistance to the flows S1, S2, and S3 running in the liquid flow path 10 (including the first liquid flow path 14 and the second liquid flow path 16) along the meniscus M, which has progressed backward due to discharging, returning to the discharge port 18 by means of capillary force or along liquid supply being supplied subsequent to defoaming.

To supplement this, as shown in FIGS. 2A to 2D, the free end 32 of the movable member 31 extends over the heat generating element 2 to face the downstream side of the center 3 of the area (that is the line orthogonal to the longitudinal direction of the liquid flow path, passing the center (central portion) of the area of the heat generating element), which divides the heat generating element 2 into the upstream side and the downstream side. In this way, the pressure generated on the downstream side of the central position 3 of the heat generating element, which contributes greatly to liquid discharging, or the air bubble, is received by the movable member 31. Thus, the pressure and air bubble are led to the discharge port side for the fundamental enhancement of the discharging efficiency and discharging power.

Further, the upstream side of the air bubble is also utilized to produce many favorable effects.

Also, with the structure described above, the free end of the movable member 31 effectuates a mechanical displacement instantaneously. This function is also considered to contribute effectively to discharging liquid.

Now, in consideration of the liquid discharging principle described above, the detailed description will be made of the embodiments in accordance with the present invention. At first, an observation is made as to means for the further enhancement of the refilling characteristics and discharging efficiency, as well as the influences exerted by cavitation on the heat generating element 2, in accordance with the liquid discharging principle described above.

For the liquid discharge head represented in FIGS. 2A to 2D and FIG. 3, the liquid flow path is divided at least in the vicinity of the movable member 31 into the first liquid flow path 14 and the second liquid flow path 16 with the movable member 31 being placed between them. Here, giving attention to the back waves or the portion of the air bubble that develops into the upstream side, the first liquid flow path 14 has only fine back waves or only small portion of the air bubble that develops into the upstream side because of the displacement of the movable member 31 as described above. For the second liquid flow path 16, however, there is no means for suppressing the back waves or such portion of the air bubble completely as indicated by the reference mark $V_8$ in FIGS. 2A to 2D and FIG. 8. To counteract this, the second liquid flow path 16 connected with the air bubble generating area 11 is provided with a narrower portion on the upstream side of the air bubble generating area 11. In this way, it is attempted to make it difficult for the back waves or the like to be propagated to the liquid chamber portion, which is located further on the upstream side. However, if such narrower portion is provided, refilling is hindered to that extent. It becomes very important, therefore, that the further enhancement is attained without hindering the performance of liquid refilling for obtaining a higher efficiency of discharging.

Also, in order to reduce the influence of cavitation against the heat generating element 2, it is effective to avoid placing the center of the air bubble on the heat generating element 2 at the time of defoaming.

(First Embodiment)

Figure 7:
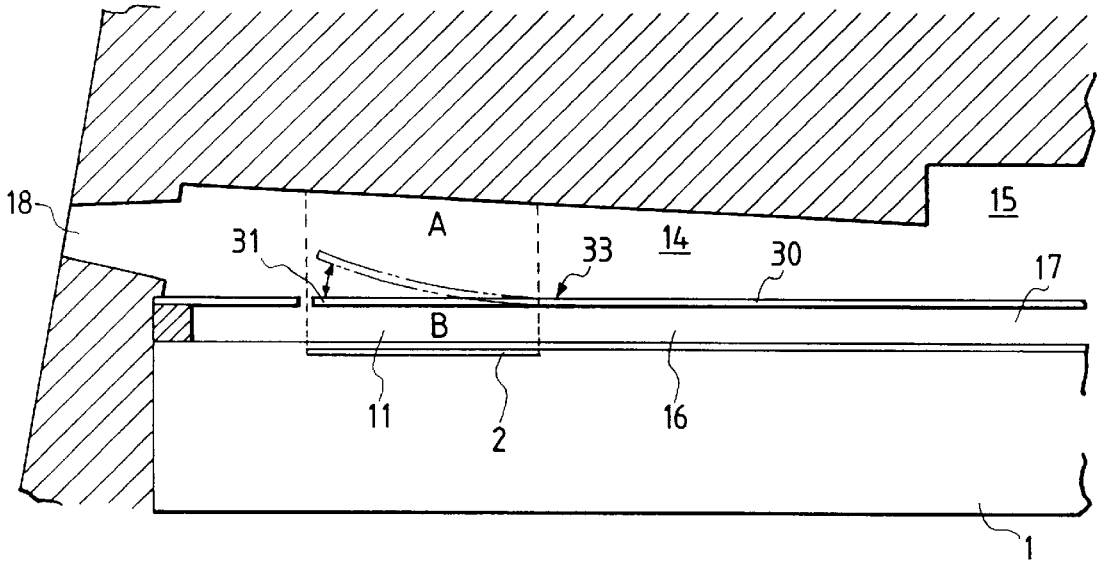
FIG. 7 is a cross-sectional view schematically showing a liquid discharge head (two liquid flow paths) in accordance with a first embodiment of the present invention, taken in the direction of the liquid flow paths.
Figure 8:
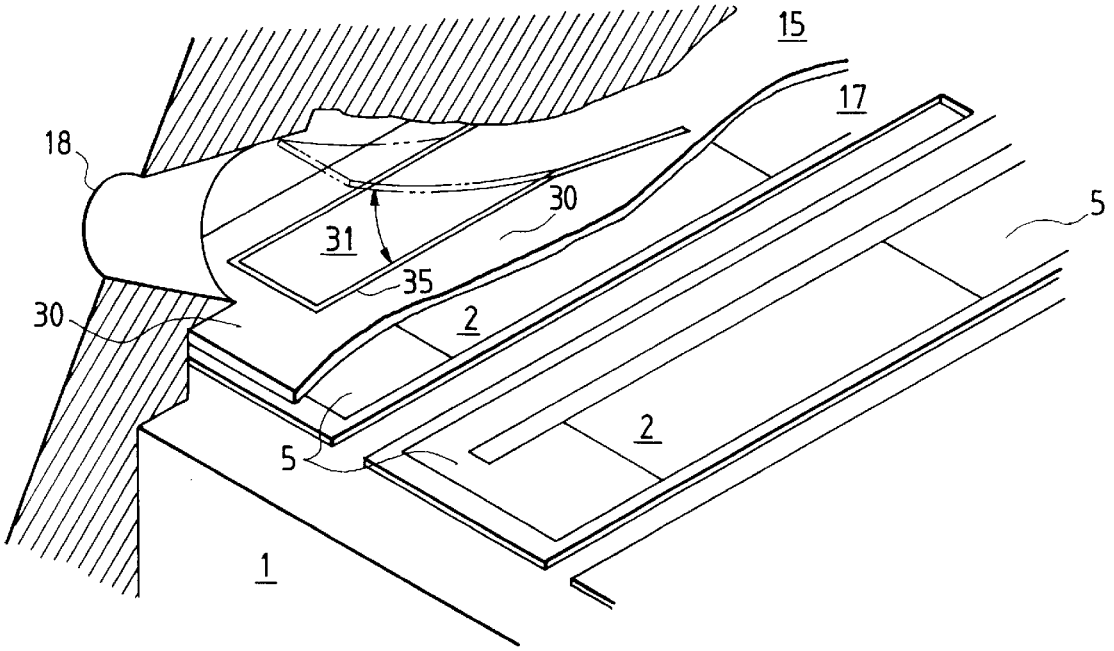
FIG. 8 is a partially broken perspective view showing the liquid discharge head represented in FIG. 7.

Now, the description will be made of a liquid discharge head in accordance with a first embodiment of the present invention. The liquid discharge head comprises the plural liquid flow paths, each being structured in accordance with the liquid discharging principle described above. The structure is further divided into two, one is for foaming liquid (first liquid) to be foamed by giving more heat, and the other is for discharging liquid (second liquid) which is mainly discharged. However, the first and second liquids may be the same. FIG. 7 is a cross-sectional view which schematically shows the liquid discharge head in accordance with the first embodiment, taken in the liquid flow path direction thereof. FIG. 8 is a partially broken perspective view showing the liquid discharge head.

The liquid discharge head is provided with the second liquid flow path 16 for use of foaming on an elemental substrate 1 where each of the heat generating elements 2 is arranged to give thermal energy to liquid for the creation of air bubbles, and then, the first liquid flow path 14 for use of discharging liquid is arranged on it, which is directly connected with each of the discharge ports 18 conductively. The upstream side of the first liquid flow path 14 is conductively connected with a first common liquid chamber 15 to supply discharging liquid to a plurality of first liquid flow paths 14. The upstream side of the second liquid flow path 16 is conductively connected with a second common liquid chamber 17 to supply foaming liquid to a plurality of second liquid flow paths 16. However, if the same liquid is adopted as foaming liquid and discharging liquid, it may be possible to provide only one common liquid chamber, which is shared for different uses.

Between the first liquid flow path 14 and the second liquid flow path 16, there is arranged a separation wall 30 formed by an elastic metal or the like to separate the first liquid flow path and the second liquid flow path. In this respect, if it is better not to mix liquids to be used for foaming and discharging as far as the circumstances permit, the distribution of the first liquid flow path 14 and the second liquid flow path 16 should be separated by the provision of the separation wall. However, if there is no problem even by mixing foaming liquid and discharging liquid, it may be unnecessary to provide the separation wall with the function to implement such complete separation. The portion of the separation wall, which is positioned in the projection space to the upper part of the surface direction of the heat generating element (hereinafter referred to as a discharge pressure generating area; areas designated by reference marks A and B with respect to the air bubble generating area 11), is arranged to function as a movable member 31 prepared in a cantilever fashion, which is provided with a free end by means of a slit 35 on the discharge port side, and the pivot 33 positioned on the common liquid chambers (15 and 17) side. The movable member 31 is arranged to face the air bubble generating area 11 (B). Therefore, it operates to be open to the discharge port side of the first liquid flow path by means of foaming of the foaming liquid (in the direction indicated by arrows in FIG. 7). In FIG. 8, too, the separation wall 30 is arranged through the space that constitutes the second liquid flow path 16 on the elemental substrate 1 having on it the heat generating resistor unit serving as the heat generating elements 2 and wiring electrodes 5 to apply electric signals to the heat generating resistor unit. The relationship between the arrangements of the pivot 33 and the free end 32 of the movable member 31 and each of the heat generating elements 2 is arranged to be the same as the case referred to in the description of the principle given earlier. Also, in the description of the principle, the structural relationship between the liquid supply path 12 and the heat generating element 2 is referred to. The same description is applicable to the structural relationship between the second liquid flow path 16 and each of the heat generating elements 2 for this liquid discharge head.

Now, in conjunction with FIGS. 9A and 9B, the operation of the liquid discharge head will be described.

When driving the head, the same water ink is used for driving as discharging liquid to be supplied to the first liquid flow path 14 and as foaming liquid to be supplied to the second liquid flow path 16. Heat generated by each of the heat generating elements 2 acts upon the foaming liquid in the air bubble generating area of the second liquid flow path 16, thus creating an air bubble 40 in the foaming liquid by means of film boiling as disclosed in the specification of U.S. Pat. No. 4,723,129 in the same manner as referred to in the description of the principle.

For this liquid discharge head, foaming pressure cannot escape in the three directions but toward the upstream side of the air bubble generating area. Therefore, the pressure exerted by the creation of air bubble is propagated intensively to the movable member 6 side arranged in the discharge pressure generating area, and then, along the development of the air bubble, the movable member 6 is displaced from the state shown in FIG. 9A to the liquid flow path side as shown in FIG. 9B. By this movement of the movable member, the first liquid flow path 14 and the second liquid flow path 16 are largely connected conductively, thus enabling the pressure exerted by the creation of air bubble to be propagated mainly in the direction toward the discharge port side of the first liquid flow path (direction indicated by an arrow as A). By this propagation of pressure and the mechanical displacement of the movable member as described earlier, liquid is discharged from the discharge port.

Figure 9A:
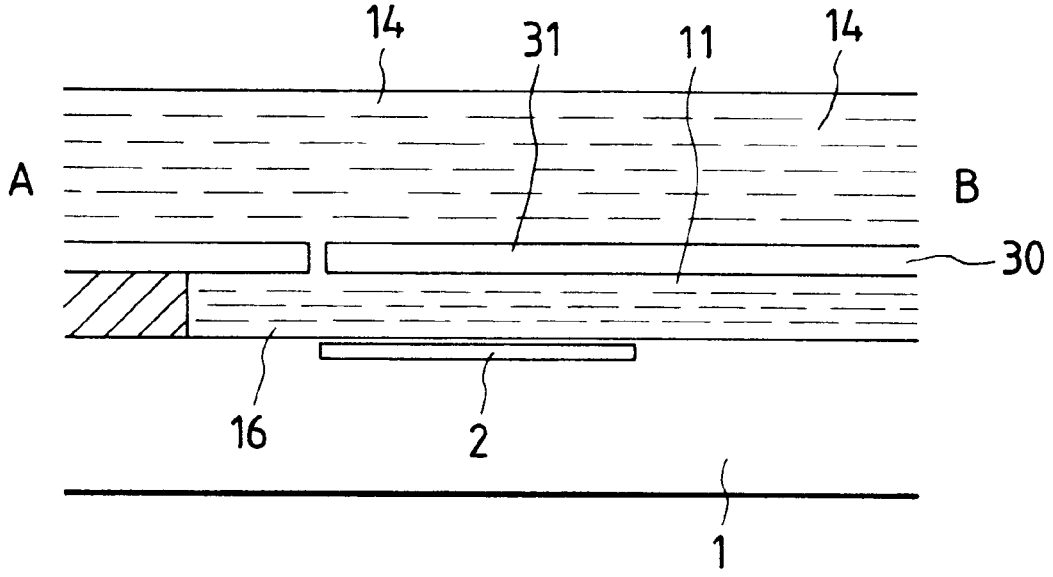
FIGS. 9A and 9B are views illustrating the operation of a movable member.

Now, when the movable member 31 returns to the position shown in FIG. 9A following the contraction of the air bubble, discharging liquid is supplied from the upstream side of the first liquid flow path 14 for an amount corresponding to the amount of discharging liquid that has been discharged. This supply of discharging liquid is in the direction in which the movable member is closed in the same manner as each of the modes described earlier. Therefore, refilling of discharging liquid is not hindered by the presence of the movable member at all.

The functions and effects of the principal part of this liquid discharge head, such as the propagation of foaming pressure following the displacement of the movable member, the developing direction of the air bubble, the prevention of back waves, are the same as those heads described in conjunction with the discharging principle. Besides, it has more advantages given below by adopting the two-liquid flow path structure.

In other words, in accordance with the structure of the present embodiment, discharging liquid and foaming liquid can be separate liquids, and then, it is made possible to discharge the discharging liquid by means of the pressure exerted by foaming by the foaming liquid. As a result, such highly viscous liquid as polyethylene glycol or the like, which presents insufficient discharging power due to insufficient foaming effectuated by the conventional heating, can be discharged in good condition in such a manner that a liquid of the kind is supplied to the first liquid flow path, while liquid (such as a mixture of ethanol and water=4:6 in approximately 1 to 2 cp) that promotes foaming for the liquid to perform good foaming or liquid having a low boiling point is supplied to the second liquid flow path. Also, as foaming liquid, it becomes possible to select such a liquid that generates no burning or any other deposit on the surface of the heat generating element when receiving heat. Then, foaming can be stabilized likewise so as to make good discharging possible. Further, with the head structured in accordance with the present embodiment, it is also possible to demonstrate the effects referred to in the description of the discharging principle. Therefore, the highly viscous liquid and others can be discharged with a high discharging efficiency and high discharging power. Also, even for the liquid whose nature is not very strong against heating, it is equally possible to discharge such liquid with a high discharging efficiency and high discharging power as described above without damaging it thermally if the liquid is supplied to the first liquid flow path, while the liquid whose nature is such that it does not change its properties thermally and presents good foaming is supplied to the second liquid flow path.

Figure 10:
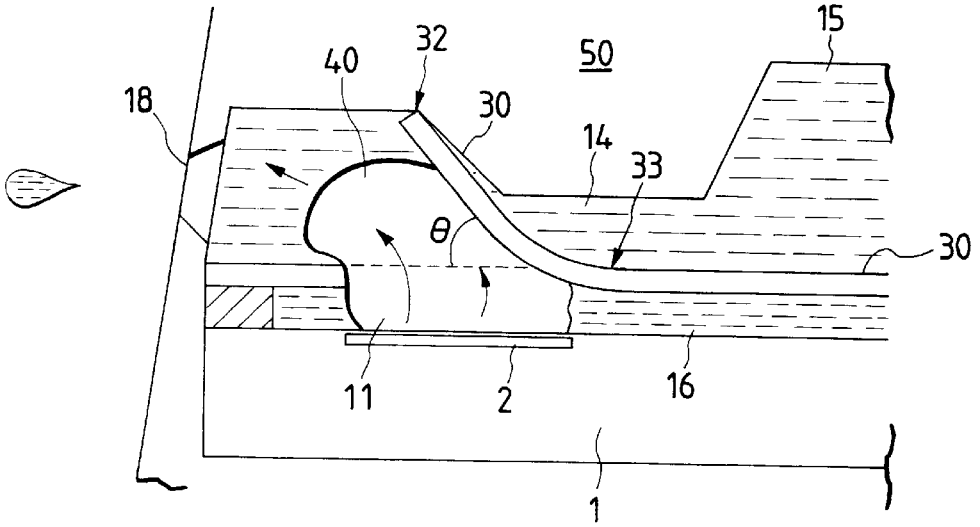
FIG. 10 is a view illustrating the structure of the movable member and the first liquid flow path.

Now, the description will be made of the ceiling configuration of this liquid discharge head. FIG. 10 is a cross-sectional view of the liquid discharge head, taken in the direction of its liquid flow path. Here, a separation wall 30, which is provided with a grooved member 50 on it is arranged to constitute the first liquid flow path 14. The height of the liquid flow path ceiling is made larger in the vicinity of the position of the free end 32 of the movable member 31 so that the operational angle θ is made larger for the movable member 31. The operational range of the movable member 31 is determined by taking the structure of liquid flow paths, durability of the movable member, foaming power, and others into consideration, but it should be desirable that the operation is possible up to the angle including the angle in the axial direction of the discharge port 18.

Also, as shown in FIG. 10, the propagation of discharging power becomes better still if the displacement height of the free end of the movable member 31 is made larger than the diameter of the discharge port 18. Further, as shown in FIG. 10, the height of the liquid flow path ceiling in the position of the pivot of the movable member 31 is made smaller than that of the liquid flow path ceiling in the position of the free end 32 of the movable member 31. As a result, the pressure waves are prevented from escaping to the upstream side more effectively when the movable member 31 is displaced.

Figure 11A:
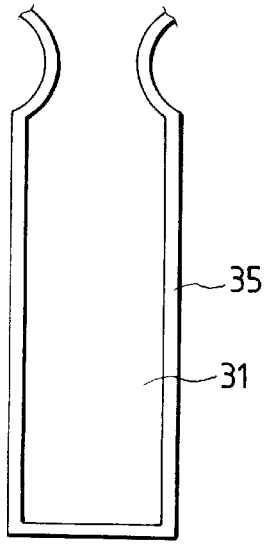
FIGS. 11A, 11B and 11C are views illustrating the movable member and liquid flow path.
Figure 11B:
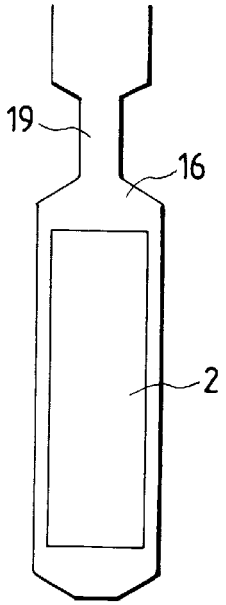
Figure 11C:
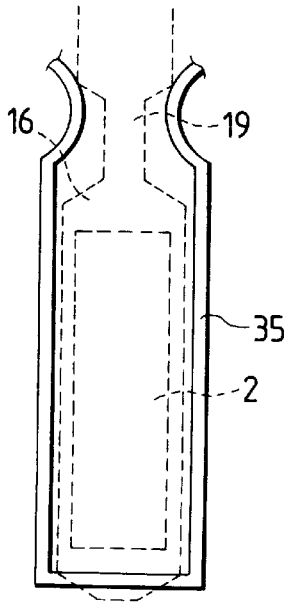

Now, the arrangement relationship between the second liquid flow path 16 and the movable member 31 will be described. FIGS. 11A to 11C are views illustrating the arrangement relationship between the movable member 31 and the second liquid flow path 16; FIG. 11A shows the separation wall 30 and the vicinity of the movable member 31, being observed from above; FIG. 11B shows the second liquid flow path 16 after removing the separation wall 30, being also observed from above; and FIG. 11C is a view schematically showing the arrangement relationship between the movable member 31 and the second liquid flow path 16 by overlapping each of these elements. Here, all the figures illustrate the front side where the discharge port 18 is arranged underneath each one of them.

The second liquid flow path 16 is provided with a narrower portion 19 on the upstream side of the heat generating element 2 (here, the upstream side means the one in the large flow from the second common liquid chamber side to the discharge port 18 through the position of the heat generating element, movable member 31, and the first liquid flow path), and this path is structured like a chamber (foaming chamber) arranged to suppress foaming pressure so that it does not escape to the upstream side of the second liquid flow path 16.

If such narrower portion should be provided for the conventional head having the same path for foaming and discharging path in anticipation that pressure exerted by each of the heat generating elements on each liquid chamber side does not escape to the common liquid chamber side, it is necessary to arrange the structure so as not to make the sectional area too small for the liquid flow path in the narrower portion, taking liquid refilling fully into consideration. However, for this liquid discharge head, most of liquid in the first liquid flow path 14 is used for discharging, while the arrangement can be made to suppress the consumption of foaming liquid in the second liquid flow path where each of the heat generating elements is provided. It may be possible, therefore, that the refilling amount of foaming liquid to the air bubble generating area 11 of the second liquid flow path 16 is made smaller, and as a result, the gap in the narrower portion described above is made as extremely small as several μm to ten and several μm to suppress further the escape of foaming pressure exerted in the second liquid flow path to its circumference. The pressure is led toward the movable member side intensively. Then, as this pressure can be utilized as discharge power through the movable member 31, it is possible to obtain higher discharging efficiency and power. In this respect, however, the configuration of the second liquid flow path 16 is not necessarily limited to the one adopted for the structure described above. It should be good enough if only such configuration is made so that the foaming pressure is effectively led to the movable member 31. In this respect, as shown in FIG. 11C, the side end of the movable member 31 covers a part of the wall that constitutes the second liquid flow path 16 in order to prevent the movable member 31 from falling off into the second liquid flow path 16, making the separation between the discharging liquid and the foaming liquid more reliable. Also, the escape of air bubble from the slit is suppressed in order to enhance both the discharging power and discharging efficiency more. In this way, the refilling effect from the upstream side is further improved by the utilization of pressure exerted at the time of defoaming.

Figure 9B:
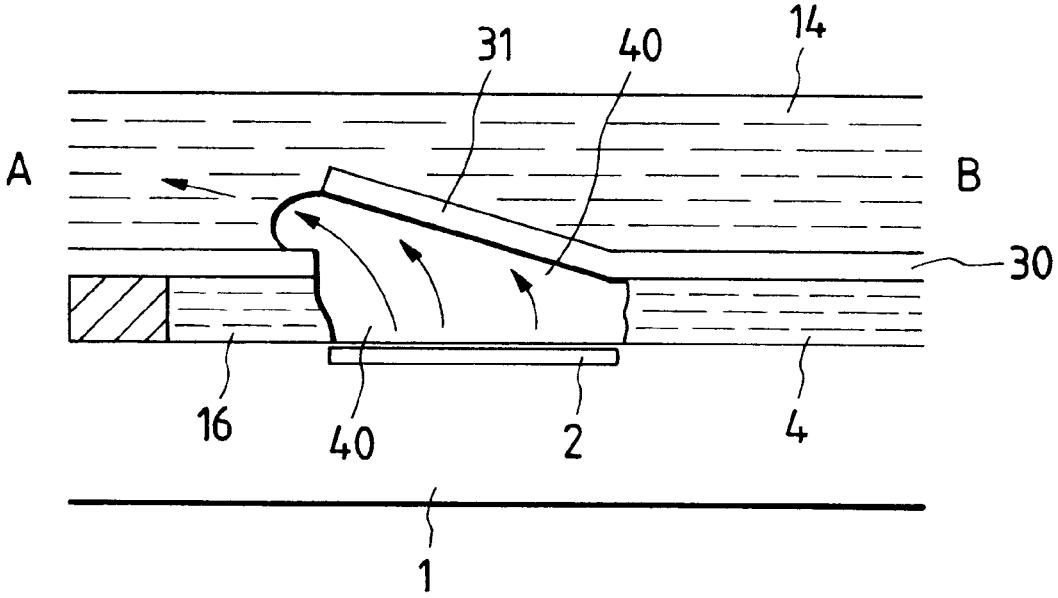

Here, in FIG. 9B and FIG. 10, the air bubble created in the air bubble generating area of the second liquid flow path 16 is partly expanded into the first liquid flow path 14 side following the displacement of the movable member 31 to the first liquid flow path 14 side. However, by arranging the height of the second liquid flow path to allow the air bubble to expand in this manner, it is possible to enhance the discharging power as compared with the case where no expansion is possible. In order to effectuate such expansion of the air bubble into the first liquid flow path 14, it is preferable to make the height of the second liquid flow path 16 lower than the maximum height of the air bubble. This height should preferably be made from several $\mu$m to 30 $\mu$m. Here, the height is set at 15 $\mu$m.

With the liquid discharge head structured in accordance with the first embodiment described above, liquid supplies to the first liquid flow path 14 and to the second liquid flow path 16 (or to the common liquid chambers 15 and 17) are executed through different paths, respectively. In this case, it is conceivable that the second liquid supply system is arranged behind the first liquid supply system, and at the same time, the structure is arranged so that both liquids are supplied from above the head. However, in order to materialize a compact head, it is preferable to arrange the second liquid supply system and the first liquid supply system in different directions. Hereinafter, the description will be made of the specific example in which the structure of a head is implemented more compactly by arranging the second liquid supply system and the first liquid supply system in different directions.

STRUCTURAL EXAMPLE 1

Figure 12:
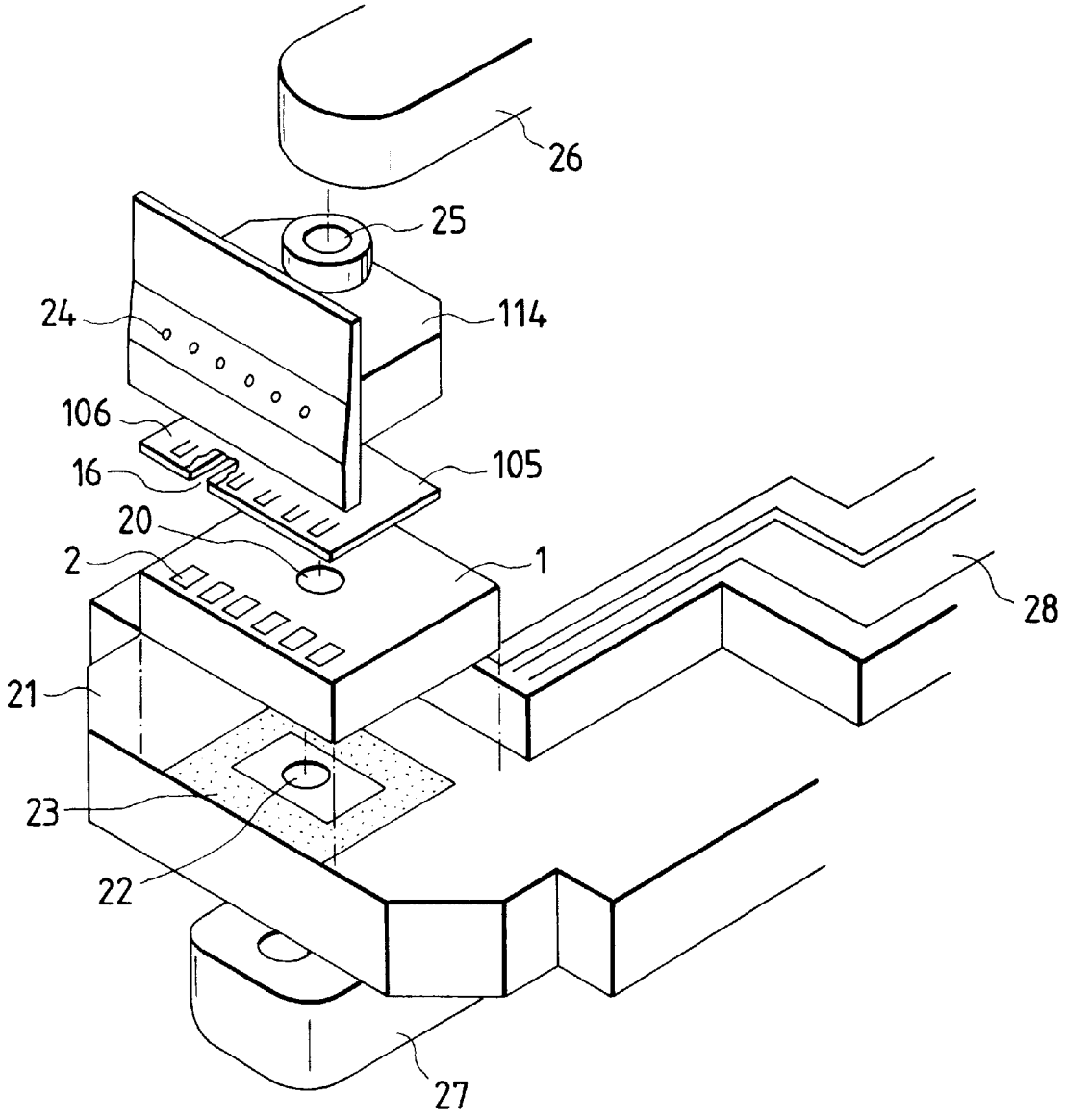
FIG. 12 is an exploded perspective view which illustrates the liquid discharge head in accordance with the structural example 1 of the first embodiment.

FIG. 12 is a partly broken perspective view which illustrates the structural example 1 of the liquid discharge head in accordance with the first embodiment.

In FIG. 12, a through hole 20 is made on the substrate 1 where the heat generating element 2 is arranged. This through hole is used for the second liquid supply. A supporting element 21 is used for bonding the substrate 1. The through hole 20 on the substrate 1 is made mechanically by means of sandblasting or diamond reamer in a state of silicon wafer or it may be made by a chemical process such as anisotropic etching. In this way, each of through holes 20, heat generating elements 2, and driving circuits are produced in the state of wafer, and each individual substrate is obtained by cutting using a deicing machine.

Then, the substrate 1 is positioned and bonded to the supporting element 21, which is formed by pressing aluminum or some other metal or formed by diecasting, after a bonding agent 23 is coated in the range that agrees with the outer diameter of the circumference of the through hole and the substrate prepared by a transfer method or screen printing method. The bonding agent 23 used here should preferably be the one capable of preventing the leakage of the second liquid from the gap between the substrate 1 and the supporting element 21. As silicone bonding agent, SE4400 (manufactured by Toray Co., Ltd.), silicone sealant YSE399 (manufactured by Toshiba Silicone Co., Ltd.) or the like can be used, for example. In this respect, a printed-circuit board 28 is also bonded to this supporting element 21 to connect the substrate 1 and the main body electrically. As described above, after the substrate 1 and printed-circuit board 28 are bonded to the supporting element 21, these members are connected by means of bonding using aluminum wires whose diameter is 50 $\mu$m each.

Hereinafter, the description will be made of an assembling of orifices 24 corresponding to each of the heat generating elements arranged on the substrate 1, and the first liquid flow paths 14 conductively connected with them (see FIG. 7); a common liquid chamber 15 conductively connected with each of the first liquid flow paths 14 (see FIG. 7); a grooved ceiling plate 114 produced by means of plastic molding, having the first liquid supply port through which the first liquid is supplied to this liquid chamber 15; and the separation wall 105.

The separation wall 105 provided with the movable member 106 is produced by means of electrocasting using nickel. For the separation wall 105, a wall of 15 $\mu$m high is formed by means of electrocasting between adjacent movable members on the side facing the substrate 1 in advance so that the second liquid flow path 16 can be structured when this member is bonded to the substrate 1. In this way, the structure is obtained as shown in FIG. 4.

The separation wall 105 and the grooved ceiling plate 114 are fixed by press fitting with the arrangement of three extrusions molded on the grooved ceiling plate 114 in advance, and the corresponding three positioning holes provided for the separation wall 105. By the fixation using these three extrusions and holes, each of the movable members 106 of the separation wall 105 is arranged for each of the first liquid flow paths on the ceiling plate 114. At the same time, the separation wall 105 is prevented from falling off from this integrated product due to handling or the like.

Subsequently, the part prepared by bonding the grooved ceiling plate 114 and the separation wall 105, and the substrate 1 are positioned and bonded. For this positioning and bonding, there are a method for processing the images of the center of the orifices 124 arranged for the grooved ceiling plate 114 and the center of heat generating elements arranged for the substrate 1 by use of ITV (Industrial TV) for positioning, and also, a method whereby to provide a recessed portion on the surface between adjacent heat generating elements on the substrate 1 in a depth of 0.5 $\mu$m to 2 $\mu$m to make it configured to agree with the liquid flow path wall that forms the second liquid flow path 16 on the separation wall 105, and then, to place these bonding members described above on the substrate 1 for positioning by applying fine vibrations by use of piezoelectric element or ultrasonic waves so that the second liquid flow path wall of the separation wall 105 and the recessed portion on the substrate to engage with each other. For any one of the methods, a pressure spring is incorporated to integrate both of them on the apparatus immediately after having positioned these members to be bonded, the grooved ceiling plate 114, and the separation wall 105 as well.

After that, the first liquid supply member 26, which is provided with the supply path to supply the first liquid to the first liquid supply port 25 on the grooved ceiling plate 114, and the second liquid supply member 27, which is provided with the supply path to supply the second liquid to the second liquid supply port of the supporting element 21, are fixed. The other ends of the first liquid supply member 26 and the second liquid supply member 27 are connected with each of liquid retaining members (not shown), respectively.

Subsequently, each of the gaps between these members, and each portion of aluminum wires being bonded are sealed with silicone sealant 23, such as TSE399 (manufactured by Toshiba Silicone Co., Ltd.) to complete the liquid discharge head.

Figure 13:
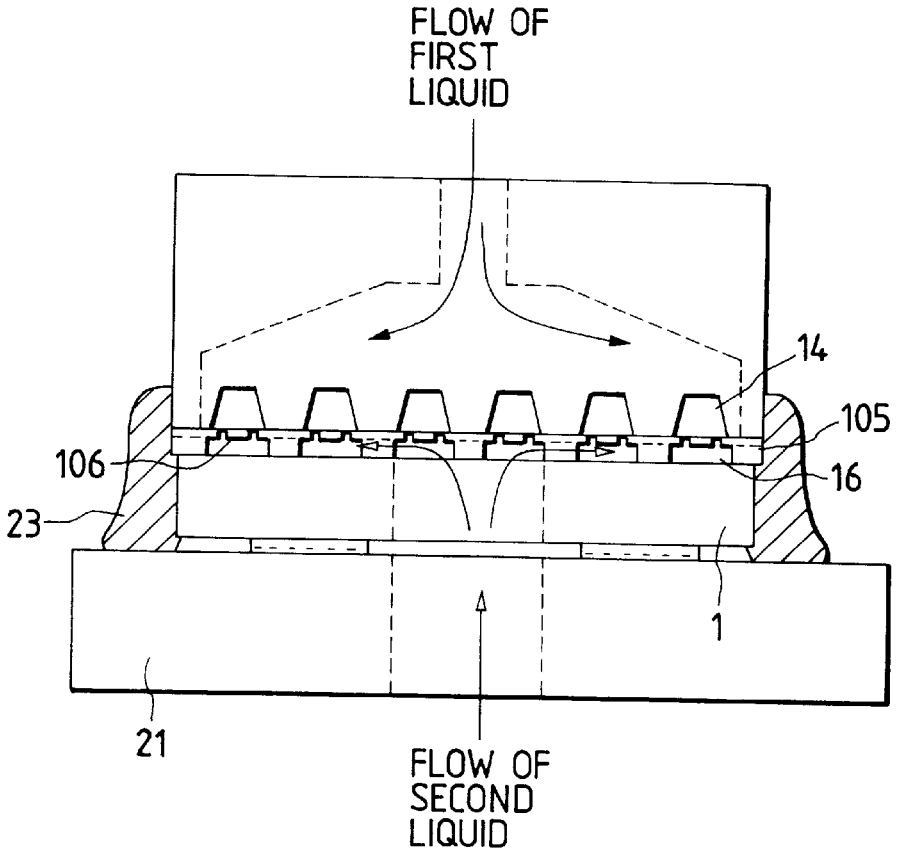
FIG. 13 is a schematic view showing the first and second liquid flows of the liquid discharge head represented in FIG. 12.

FIG. 13 is a view which schematically shows the flows of the first and second liquids for the liquid discharge head described above. As clear from the representation of FIG. 13, the liquid discharge head of this structural example allows the first liquid to flow from the first liquid supply port 25 arranged for the grooved ceiling plate 144 into the common liquid chamber 15 in the ceiling plate, and then, supplied to each of the first liquid flow paths 14. On the other hand, the second liquid flows into the interior from the second liquid supply port arranged for the supporting element 21, and runs to the dead-end provided by the separation wall 105 after passing the supporting element 21 and the substrate 1, and then, branched in the common liquid chamber 17 arranged for the second liquid into each of the second liquid flow paths.

As described above, this liquid discharge head is structured to enable the second liquid to be supplied from below by way of the supporting element 21. As a result, it becomes unnecessary to arrange the structure so that the second liquid supply system is placed behind the first liquid supply system as described earlier. Therefore, the head can be made smaller and simpler.

Figure 14:
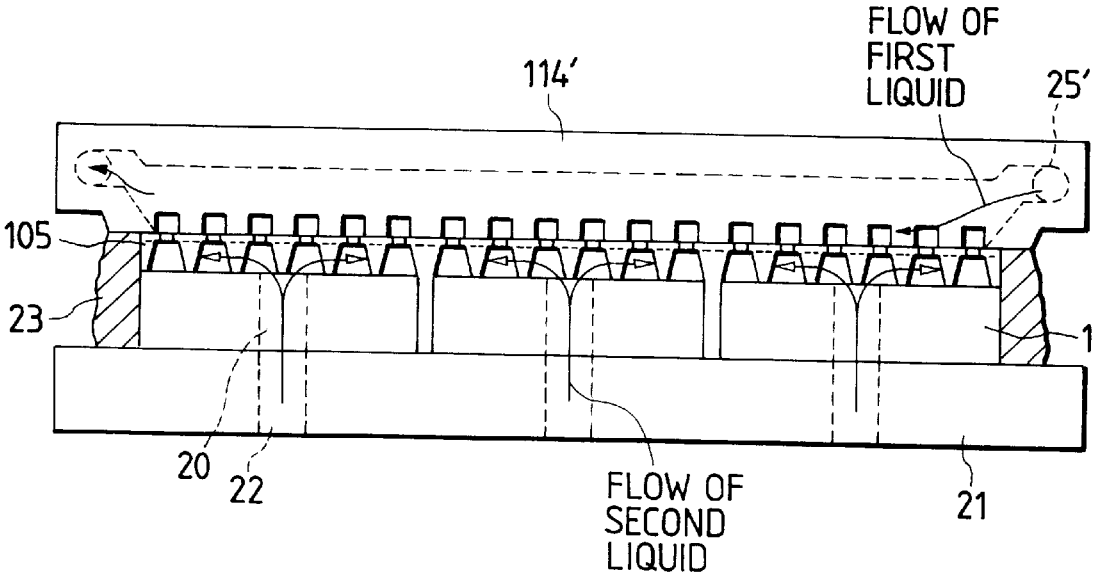
FIG. 14 is a schematic view showing the structure of a liquid discharge head provided with a plurality of substrates in accordance with the structural example 1.

Also, the supply systems described above are applicable to the structure of the liquid discharge head in which a plurality of substrates 1 are arranged with heat generating elements arranged on them. FIG. 14 is a view which schematically showing the liquid supply paths for the liquid discharge head where a plurality of substrates 1 are arranged. For the head shown in FIG. 14, a plurality of substrates 1 having heat generating elements 2 arranged on them are fixed onto the supporting element 21, and both side faces are sealed with the sealant 23. Each of the substrates 1 is provided with the through hole 20, while through holes 22 are provided for the supporting element 21 in the positions corresponding to those through holes 20. The separation wall 105 is bonded to each of the substrates 1 to form the second liquid flow path 16. For the grooved ceiling plate 144', the first liquid supply port 25' is conductively provided for the first liquid flow path 14.

For this liquid discharge head, liquid supply to the second liquid flow path 16 is performed from the reverse side of each substrate 1 through each of the through holes 20 provided for each substrate 1, respectively. Liquid supply to the first liquid path 14 is performed through the first liquid supply port 25' provided for the grooved ceiling plate 114'. With this structure, the head is made smaller and simpler.

STRUCTURAL EXAMPLE 2

For the liquid discharge head of the structural example 1 described above, the relatively large through hole 20 is arranged for the elemental substrate 1. At the same time, liquid is supplied to a number of second liquid supply paths through this through hole 20. With such structure as this, there are some cases where liquid is not smoothly supplied to some of the second liquid flow paths, which are located away from the through hole 20.

Figure 15:
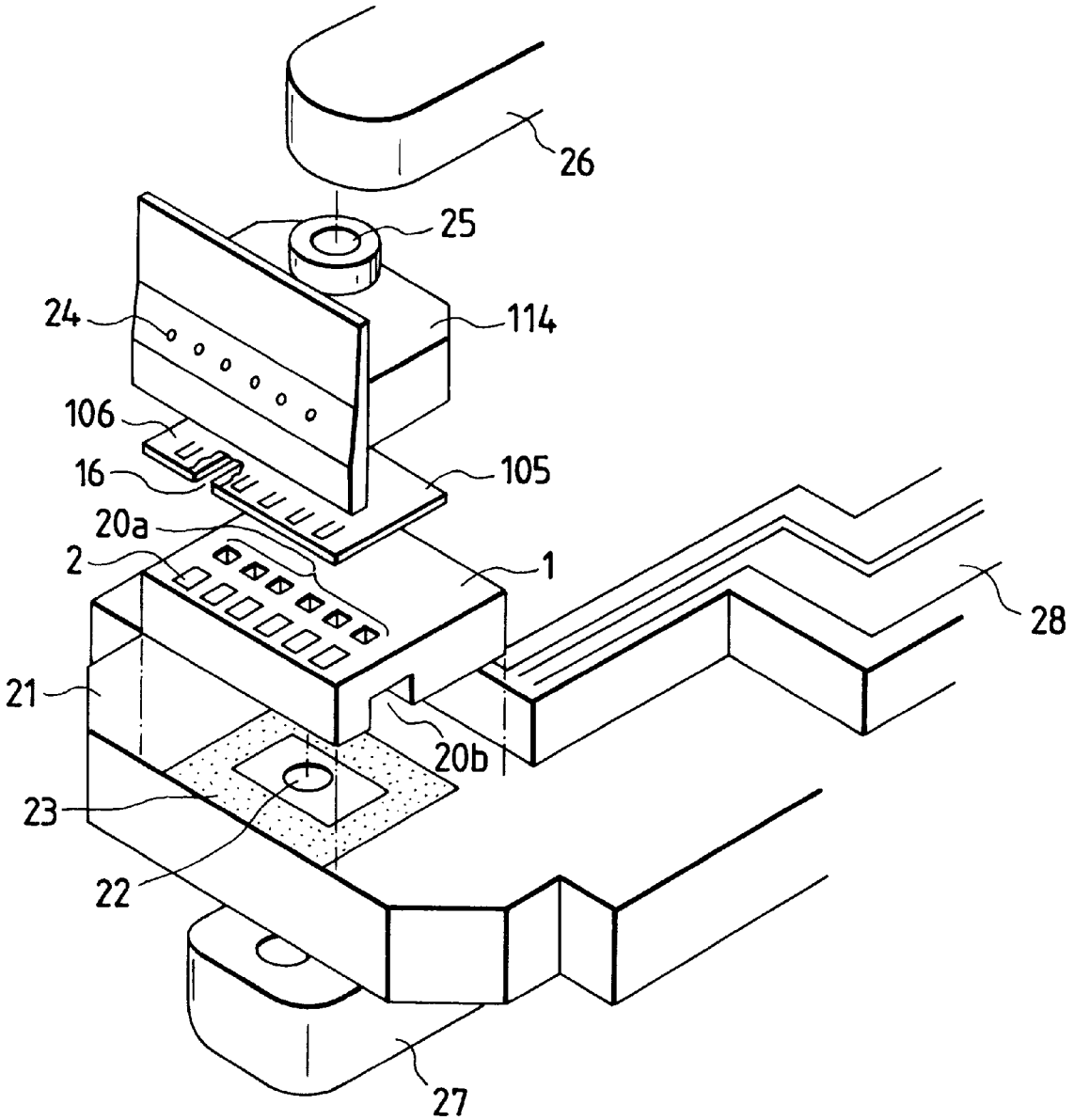
FIG. 15 is an exploded perspective view which illustrates a liquid discharge head in accordance with a structural example 2 of the first embodiment.

Therefore, as shown in FIG. 15, the liquid discharge head of this structural example 2 is provided with each of the through holes 20 in the position near to each of the heat generating elements per second liquid path 16. In accordance with this structural example, each through hole 22 on the supporting element 21 side and each through hole 20*a* on the substrate 1 is not necessarily arranged to correspond to each other. Also, as each of the through holes 20*a* is fine, it is preferable to arrange a groove 20*b* on the surface of the substrate 1 on the supporting element 21 corresponding to each of the through holes 20*a* so that liquid supplied from the through hole 22 is distributed to each of the through holes 20*a* by way of the groove 20*b*. The through holes 20*a* on the substrate 1 are formed in such a manner that the groove 20*b* is cut on the substrate 1 still in the form of silicon wafer, and then, these holes are made in the groove mechanically by means of sandblasting or diamond reamer or chemically by means of anisotropic etching. In this way, the through holes 20*a*, groove 20*b*, heat generating elements 2, and circuits for driving are produced at the stage of wafer processing. After that, the wafer thus produced is cut off by use of deicing machine to obtain individual substrates. With the exception of the through holes 20*a* and the groove 20*b* arranged for the substrate 1, the liquid discharge head of the structural example 2 is the same as the liquid discharge head of the structural example 1 described above.

Figure 16:
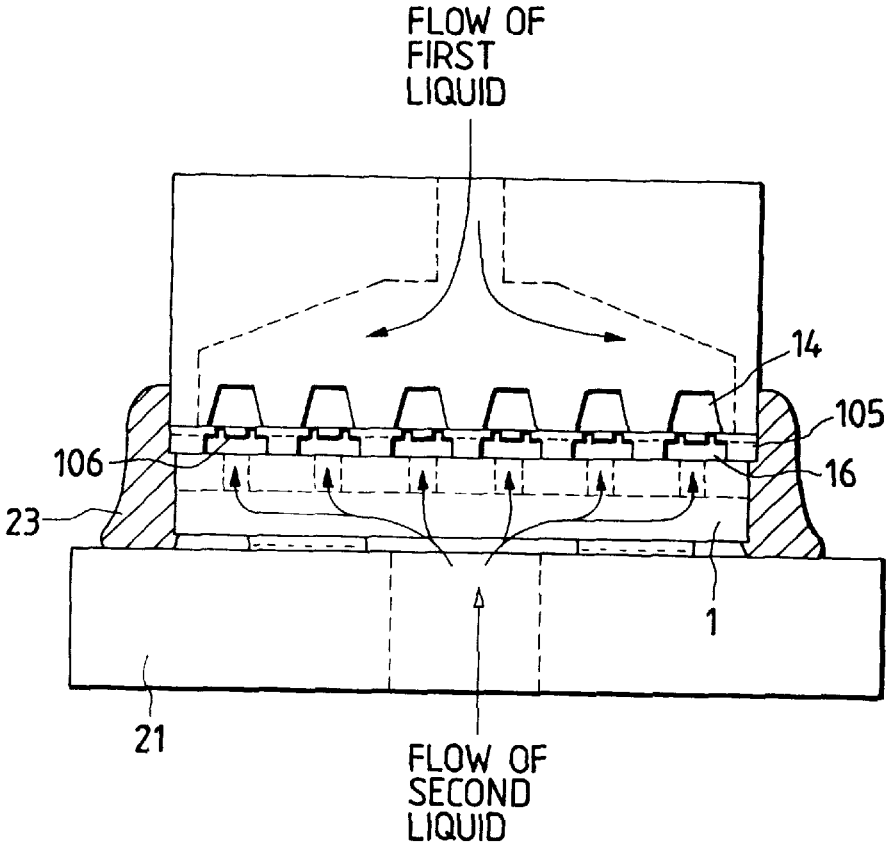
FIG. 16 is a schematic view showing the first and second liquid flows of the liquid discharge head represented in FIG. 15.

FIG. 16 is a view which schematically shows the flows of the first and second liquids in the liquid discharge head of the structural example 2. The flow of the first liquid is the same as that of the structural example 1. The second liquid is, however, distributed to each of the through holes 20*a* through the groove 20*b*, and supplied to each of the second liquid flow paths 16.

Figure 17:
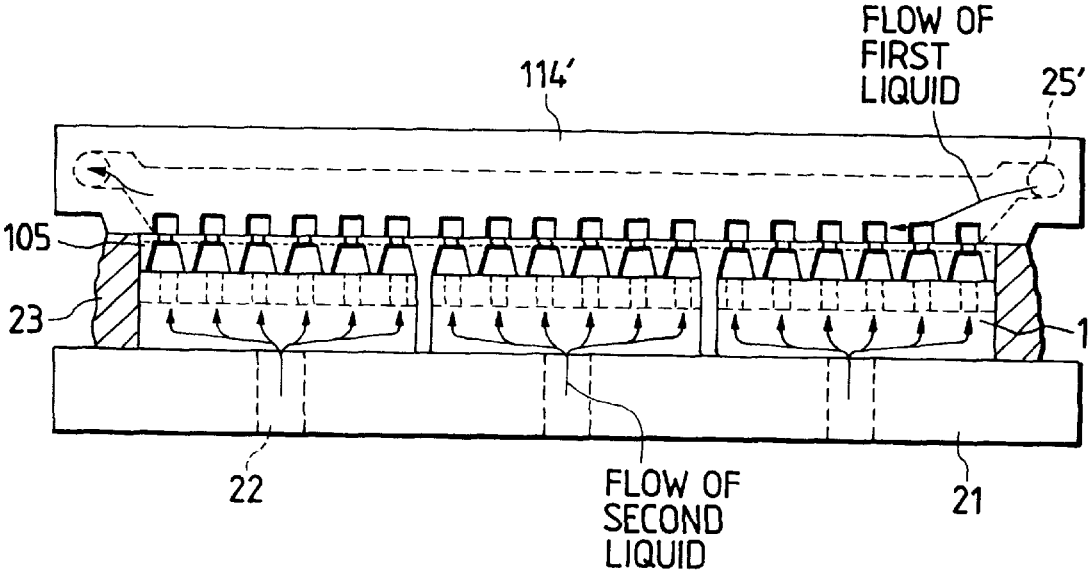
FIG. 17 is a schematic view showing the liquid supply path of the liquid discharge head provided with a plurality of substrates in accordance with the structural example 2.

Also, the same as the first structural example, it is possible to adopt the supply systems described above for the liquid discharge head provided with a plurality of elemental substrates 1 having heat generating elements 2 arranged on each of them. FIG. 17 is a view which schematically shows the liquid supply paths for the structure of the liquid discharge head structure having a plurality of substrates 1 arranged therefor.

STRUCTURAL EXAMPLE 3

Figure 18:
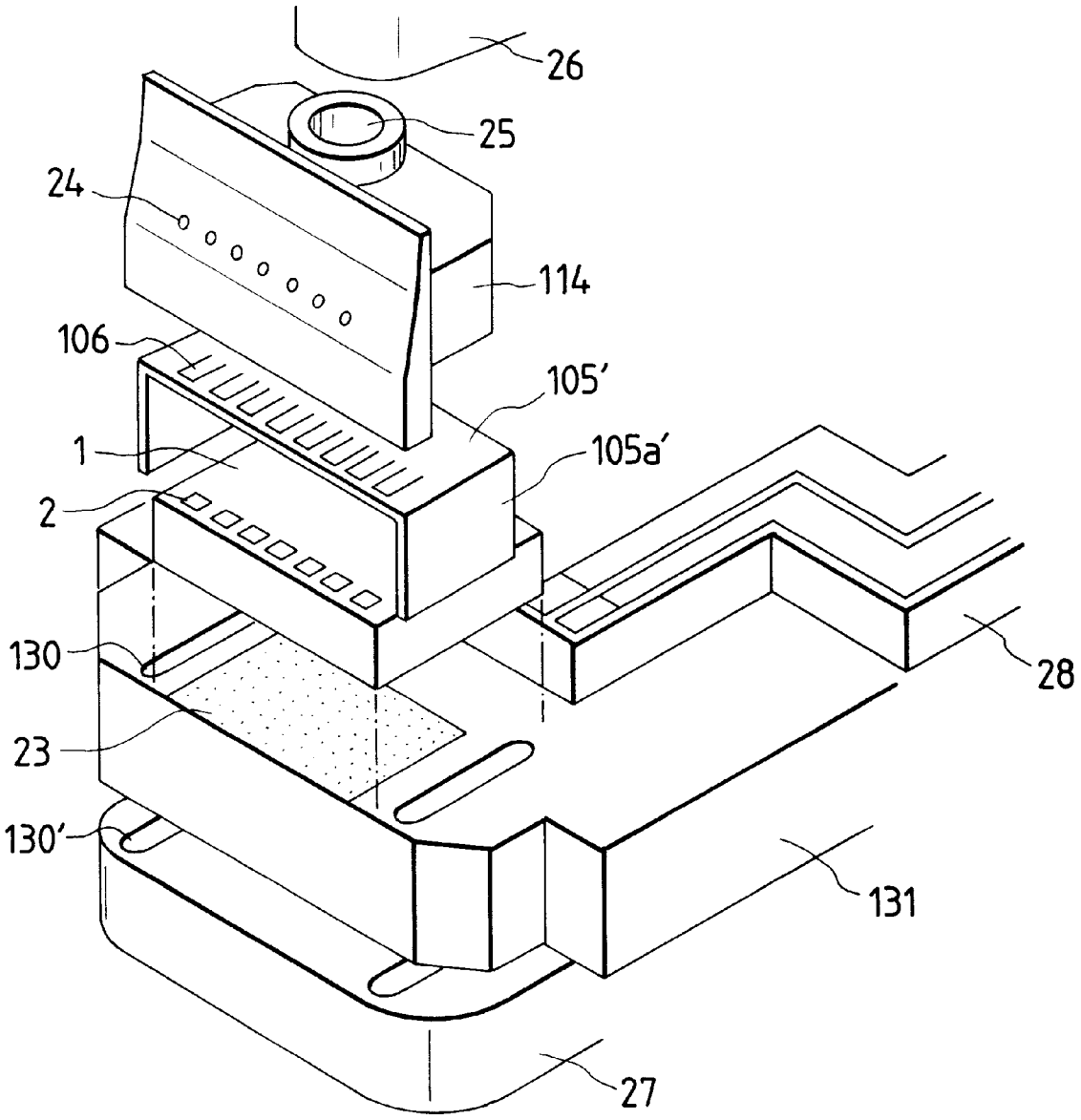
FIG. 18 is an exploded perspective view which illustrates the liquid discharge head in accordance with the structural example 3 of the first embodiment.

FIG. 18 is an exploded perspective view which illustrates the liquid discharge head of the structural example 3 in accordance with the first embodiment of the present invention.

The separation wall 105' is produced by folding the extruded portions thereof over the substrate 1 at 90° (folded portions 105*a*') after the movable member 106 and the second liquid flow path 16 are produced by the same method applied to the structural example 1 described above. The separation wall 105' thus produced is bonded to the grooved ceiling plate 114 in the same manner as the structural example 1, and then, assembled on the substrate 1 and printed-circuit board 28 bonded and connected with the supporting element 131 by the application of bonding agent 23 as in the structural example 1. The leading ends of the folded portion 105*a*' of the separation wall 105' are press fitted into the holes 130, which are arranged in advance for the supporting element by use of press or the like. Then the liquid flow paths are formed by each of the gaps between the inner walls of the holes 130 arranged for the supporting element 131 and the separation wall 105' to supply the second liquid. The first liquid supply member 26 and the second liquid supply member 27 are fixed to the supporting member 131, respectively. Then, these members are sealed by the sealant 29 to prevent liquid from leaking to each unit on its circumference. For the second liquid supply member 27, holes 130' are formed corresponding to the holes 130 arranged for the supporting element 131. Through these holes 130', liquid is supplied from the outside.

Figure 19:
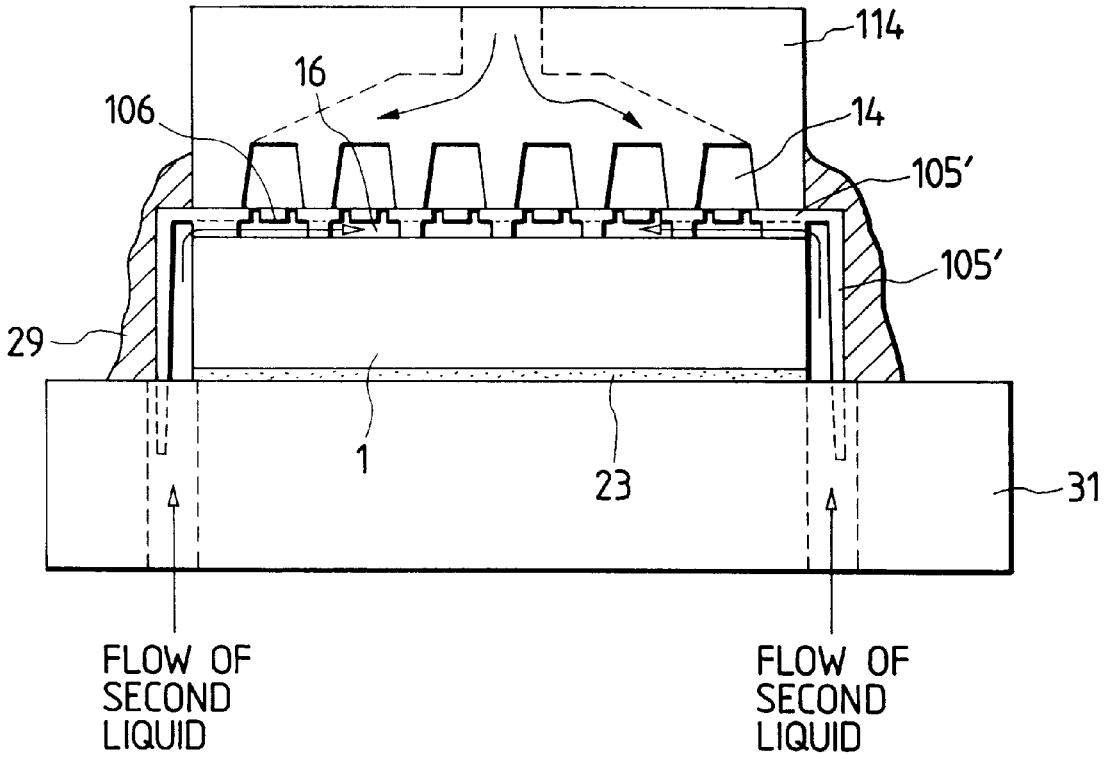
FIG. 19 is a schematic view showing the first and second liquid flows of the liquid discharge head represented in FIG. 18.

FIG. 19 is a view which schematically shows the flows of the first liquid (discharging liquid) and the second liquid (foaming liquid) for the liquid discharge head described above. As clear from FIG. 19, the first liquid flows from the first liquid supply port 25 arranged for the grooved ceiling plate 114 to the common liquid chamber 13 in the ceiling plate for this liquid discharge head. On the other hand, the second liquid flows into the interior through the paths formed between the inner walls of the holes 130 arranged for the supporting element 131 and the separation wall 105', and runs to the dead end formed by the separation wall 105' after passing the supporting element 131 and the substrate 1. Then, it is branched in the common liquid chamber arranged for the second liquid into each of the second liquid flow paths.

In accordance with this structural example, the supply of the second liquid is performed from both side ends of the substrate 1, but it is not necessarily limited to this arrangement. It may be possible to obtain the same effect by the liquid supply from one side end.

Also, the gaps between the side ends of the substrates 1 and the folded portions 105*a*' of the separation wall 105 are determined after considering the mechanical processing precision and assembling precision of each component. Here, however, the lower limit is approximately 10 μm from the gap between the surface of the substrate and the separation wall. The upper limit is not particularly limited. It may be determined in consideration of such factors as machining and assembling precision, the application degree of sealant, and the size of a head used.

STRUCTURAL EXAMPLE 4

Figure 20:
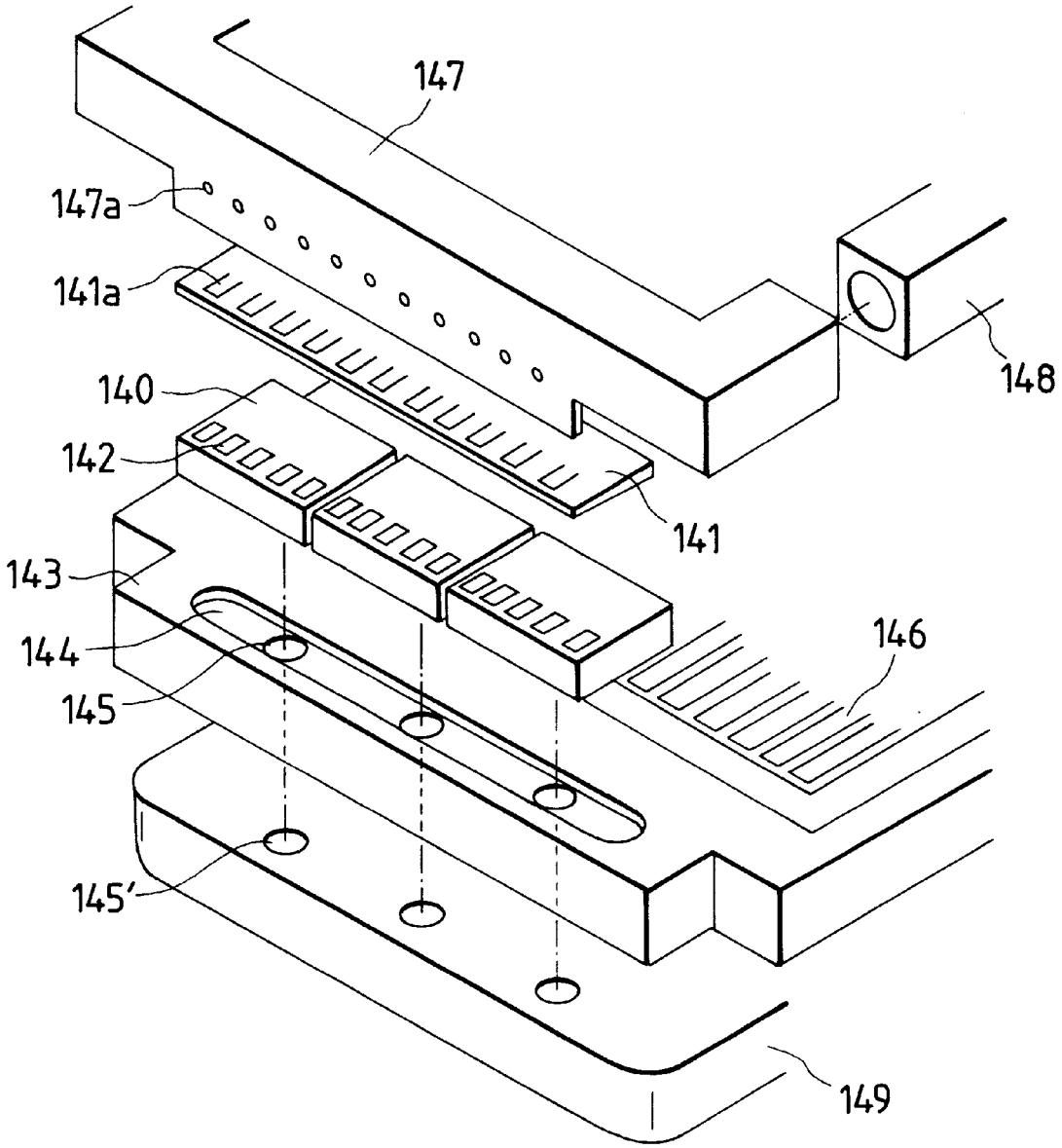
FIG. 20 is an exploded perspective view which illustrates the liquid discharge head in accordance with the structural example 4 of the first embodiment.

FIG. 20 is an exploded perspective view which illustrates the liquid discharge head of the structural example 4 in accordance with the first embodiment of the present invention.

This liquid discharge head is provided with a plurality of substrates 140 having plural heating elements 142 arranged on each of them. The substrates 140 are arranged in line on the supporting element 143. Then, the arranged is made to use gaps formed between each of the side walls of the substrates 140 for the provision of supply paths of the second liquid.

For the supporting element 143, a groove 144 is formed to supply the second liquid, and further, holes 145 are arranged for the liquid supply groove to supply the second liquid. The supporting element 143 is fixed to the second liquid supply member 149 where holes 149*a* are formed corresponding to the second liquid supply holes 145. Thus, the second liquid is supplied to the second liquid supply holes 145 through this member for its supply to each of the gaps between the substrates 140. In this respect, a printed-circuit board 146 is bonded to the supporting element 143 in order to connect each of the substrates 140 and the main body electrically.

The separation wall 141 faces the heat generating elements 142 on each of the substrates 140. It is provided with movable members 141*a* each having its free end on the discharge port side, and also, with plural grooves that constitute the second liquid flow path 16. The separation wall 141 is bonded to the substrates 140 to form the second liquid flow path 16.

For the grooved ceiling plate 147, orifices 147*a* are formed to configure the discharge ports corresponding to each of the heat generating elements 142 on each substrate 140. For the formation of the first liquid flow path 14 that conductively connected with the orifices 147*a*, grooves are arranged for the inner wall. Further, the first liquid supply member 148 is provided for supplying liquid to the first liquid flow path 14.

Hereinafter, a method for manufacturing this liquid discharge head will be described specifically.

For each substrate 140, 128 heat generating elements (electrothermal transducing elements) are arranged in 360 dpi (70.5 μm pitch). The supporting element 143 having a plurality of such substrates 140 on it is formed by means of diecasting using aluminum. On the arrangement surface of each substrate, there are formed a through hole for performing suction and fixation until bonding agent is solidified after positioning the substrate, and a groove for running the second liquid.

The substrate 140 is sucked and fixed after positioned on the supporting element 143 as described above, and bonding agent is dropped in for bonding from the rear end of the substrate (the discharge ports as referred to in this description, that is, the side opposite to the side where electrothermal transducing elements are arranged). The bonding agent may be the one used for the structural example 1. The adjacent substrates are positioned so that the adjacent electrothermal transducing elements are set at the pitch of 70.5 μm for the provision of 360 dpi. At this juncture, each gap between substrates is secured in an amount of approximately 10 μm so as not to allow the substrates themselves are in contact. This gap is used for the second liquid supply path.

In this respect, the number of substrates is three in FIG. 20 for the description's sake, but for an actual liquid discharge head, there are arranged on the supporting element 11 substrates for a width of four inches (approximately 101.6 mm), 22 substrates for a width of eight inches (approximately 203.2 mm), and 33 substrates for a width of 12 inches (approximately 304.8 mm).

After the substrates 140 are arranged and bonded, a printed-circuit board is bonded for the application of electrical signals from a recording apparatus to these plural substrates. The printed-circuit board and each of the substrates are connected by use of aluminum wires. With this, bonding is completed. Subsequently, the grooved ceiling plate 147 and the separation wall 141 are produced and bonded in the same manner as the structural example 1.

Then, the integrated body of the grooved ceiling plate 147 and separation wall 141, and the substrates thus arranged are positioned. After that, while in a state of provisional setting, a pressure spring is incorporated immediately to compete the integration, and then, after the first liquid supply member 148 and the second liquid supply member 149 are assembled, gaps between each of the components and the portion of aluminum wire bonding are sealed using silicone sealant 29 (TSE399 (manufactured by Toshiba Silicone Co., Ltd.), for example), thus completing the manufacture of a liquid discharge head.

Figure 21:
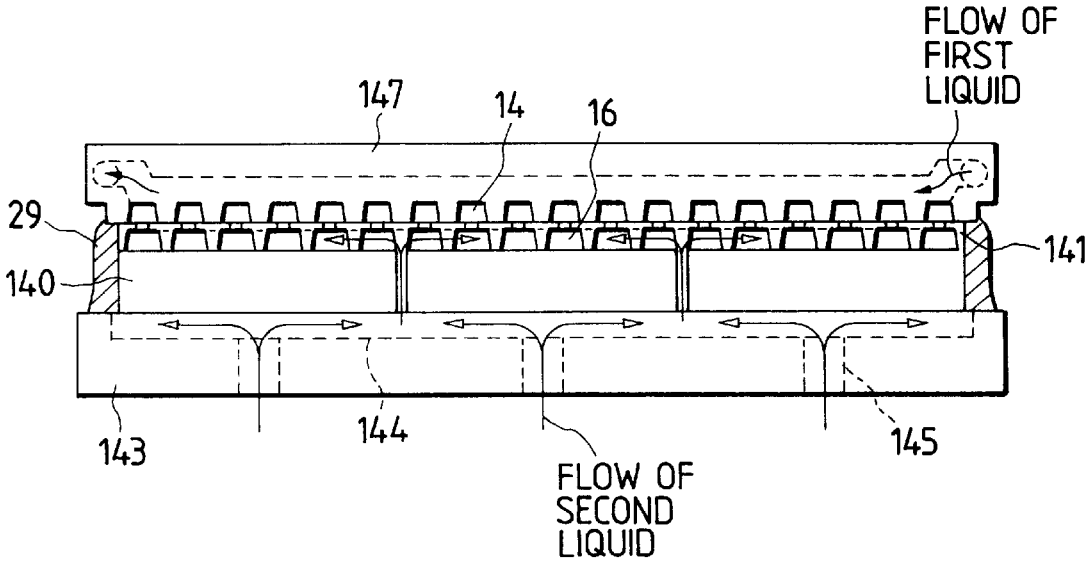
FIG. 21 is a schematic view showing the first and second liquid flows of the liquid discharge head represented in FIG. 20.

FIG. 21 is a view which schematically shows the flow when the first and second liquids are supplied to the head described above. As clear from FIG. 21, the second liquid is supplied from the reverse side of the supporting element for the liquid discharge head of the structural example 4, and it runs in the second liquid supply groove 144 of the supporting element 131 below the substrate 140. Then, through the gap between substrates 140, it is supplied to the common liquid chamber 17 and each of the second liquid flow paths 16.

With the liquid discharge head structured as described above, it is not necessarily required to use one elemental substrate, which tends to lower production yield. There can be used a substrate presenting a high yield with the requirement of only a smaller number of discharge energy generating elements, such as 64 or 128, making it possible to enhance the production yield for a head as a whole, as well as to attain lowering its costs of manufacture. Also, even if a plurality of elemental substrates are used, the grooved member can be shared by them for use. As a result, unlike the structure where heads, each having a ceiling plate per elemental substrate, should be arranged, it is possible to arrange the liquid flow paths and discharge ports in a specific direction, thus providing an elongated head capable of obtaining good images at low costs.

Figure 22:
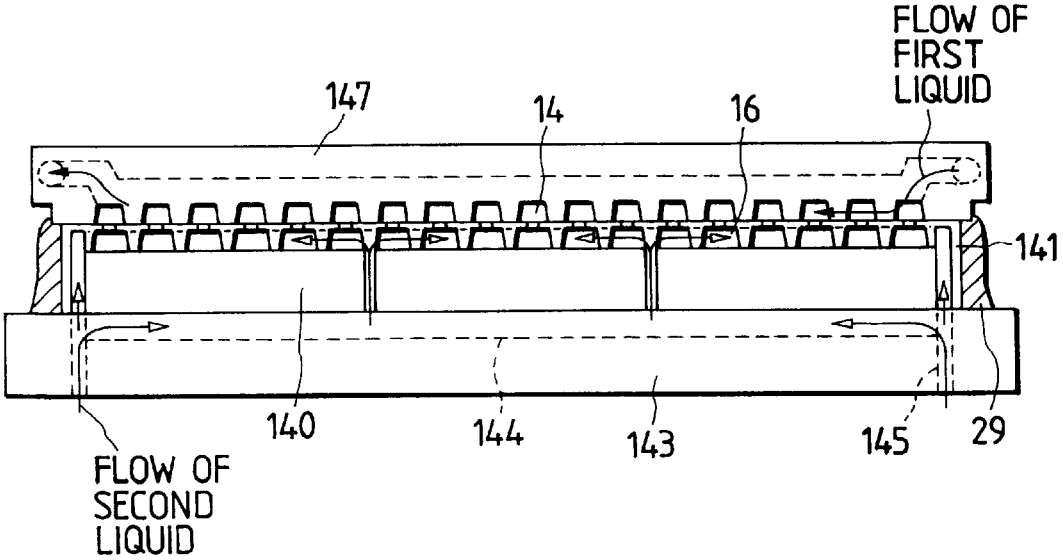
FIG. 22 is a schematic view showing the first and second liquid flows in accordance with one variational example of the liquid discharge head represented in FIG. 20.

Also, for this liquid discharge head of the structural example 4, it is possible to further stabilize the second liquid supply using the separation wall 105' shown in FIG. 18. FIG. 22 is a view schematically showing the liquid supply path in the liquid discharge head structure using the separation wall 105'. In accordance with the structure shown in FIG. 22, the second liquid is supplied from the reserve side of the supporting element 143 to the second liquid supply groove 144 through the second liquid supply holes 145, and then, supplied to the second liquid path from the second liquid supply groove 144 through the gaps formed between the side wall portions of the separation wall 105' and the side ends of substrates 140 and the gaps between each of the substrates 140, respectively. Liquid is supplied to the second liquid flow path from both sides, and then, to each of the substrates 140, hence making more stabilized liquid supply possible.

Now, the first embodiment of the present invention has been described. With a structure of the kind, discharging liquid (first liquid) and foaming liquid (second liquid) can be separate ones, and the discharging liquid can be discharged by means of pressure exerted by foaming of the foaming liquid. Therefore, even such highly viscous liquid as polyethylene glycol or the like, which presents insufficient discharging power due to insufficient foaming effectuated by the conventional heating, can be discharged in good condition in such a manner that a liquid of the kind is supplied to the first liquid flow path, while liquid (such as a mixture of ethanol and water=4:6 in approximately 1 to 2 cp) that promotes foaming is supplied to the second liquid supply path in order to perform good foaming or liquid having a low boiling point is supplied to the second liquid flow path. Also, as foaming liquid, it becomes possible to select such a liquid that generates no burning residue or any other deposit on the surface of the heat generating element when receiving heat. Then, foaming can be stabilized likewise so as to make good discharging possible. Further, with the head thus structured, it is also possible to demonstrate the effects referred to in the description of the previous structural examples. Therefore, the highly viscous liquid and others can be discharged with a high discharging efficiency and high discharging power.

Also, even for the liquid whose nature is not very strong against heating, it is equally possible to discharge such liquid with a high discharging efficiency and high discharging power as described above without damaging it thermally if such liquid is supplied to the first liquid flow path, while the liquid whose nature is such that it does not change its properties thermally and presents good foaming is supplied to the second liquid flow path.

(Second Embodiment)

Now, the description will be made of a second embodiment in accordance with the present invention. With the second embodiment, third embodiment, and fourth embodiment as well, it is equally attempted to provide the compact structures of heads, and at the same time, it is intended to enhance the prevention of back waves in the second liquid flow path, and the discharging efficiency, while reducing cavitation influence with respect to the heat generating elements from each related point of views.

Figures 23A, 23B, 23C:
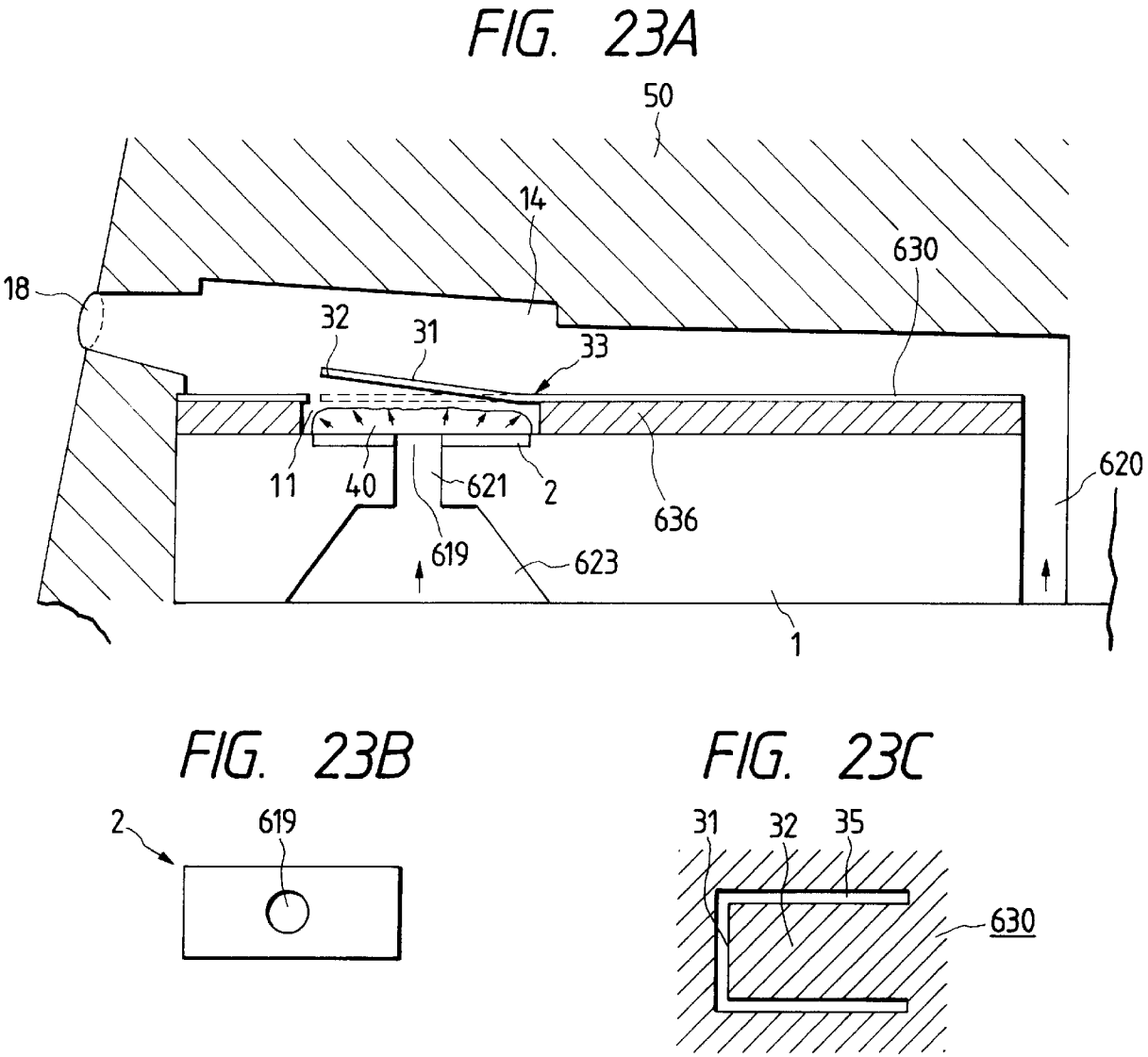
FIG. 23A is a cross-sectional view which schematically shows a liquid discharge head in accordance with a second embodiment of the present invention.
FIG. 23B is a plan view which shows the configuration of a heat generating element.
FIG. 23C is a plan view which shows the configuration of a movable member.

FIG. 23A is a cross-sectional view schematically showing the structure of the liquid discharge head in accordance with the second embodiment. FIGS. 23B and 23C are plan views showing the configurations of the heat generating element 2 and the movable member 31 of the liquid discharge head, respectively.

This liquid discharge head is the so-called edge shooter type liquid discharge head where the discharge ports are arranged in the direction toward the side direction with respect to the air bubble generating area (heat generating element 2). On one surface of the elemental substrate 1, electrothermal transducing elements serving as heat generating elements are arranged as in the liquid discharge head shown in FIGS. 2A to 2C and FIG. 3. The configuration of each heat generating element 2 is elongated to extend in the direction opposite to its discharge port 18. However, a through hole 619 is arranged almost in the center of the heat generating element. The through hole 619 of the heat generating element 2 is conductively connected with the liquid supply path 621 that penetrates the elemental substrate 1. On the other surface side of the elemental substrate 1, the liquid supply path is widened like the shape of a chamber to become the liquid chamber 623. The elemental substrate 1 is formed by semiconductor such as silicon, for a substrate, for example. Then, liquid chamber 623 and the liquid supply path 621 are formed by the combination of mechanical processing and chemical etching. The heat generating elements 2 are formed by patterning after depositing electrically resisting layer such as hafnium boride or the like and wire electrode layer such as aluminum or the like by means of semiconductor manufacturing processes.

On one surface of the elemental substrate 1, a spacer layer is laminated all over by resin, metal, or the like with the exception of the locations where the heat generating elements 2 are formed (the location of the through hole 619 is also excluded). Since no spacer layer 636 is formed on the location where the heating elements 2 are produced, a space is formed with each heat generating element residing on the bottom thereof and the spacer layer that constitutes its side ends. This space becomes each of the air bubble generating area 11 for this liquid discharge head. Further, there is arranged a plate type wall member 630 formed by nickel or some other metal typically in a thickness of several $\mu$m order for covering the entire upper surface of the spacer layer 636 including the location of air bubble generating areas 11. In a position facing each heat generating element 2, a U-shaped slit 35 is formed for the wall member 630 as shown in FIG. 23C. The wall member 630 on the portion surrounded by the slit 35 functions as a movable member 31. This movable member 31 faces the air bubble generating area 11 corresponding to each heat generating element 2. On the discharge port 18 side, it has its free end in a cantilever fashion with its pivot 33 being arranged on the side opposite to the discharge port 18. In other words, the root portion of the U-letter shape becomes the pivot 33. Then, along the creation of each air bubble 40 in the air bubble generating area 11, the movable member 31 is caused to be open to the discharge port 18 side. In other words, the wall member 630 has the same structure and function as the separation wall 30 of the first embodiment.

On the upper side of the wall member 630, the liquid flow path 14 is formed in a configuration including the bottom end of the movable member 31. One end of the liquid flow path 14 is conductively connected with the air outside as the discharge port 18. From the manufacturing point of view, the liquid flow path 14 is implemented as a groove of the grooved member 50, which is resin molded component. Also, the discharge port 18 is implemented as a through hole connected with this groove by means of the grooved member 50. On the elemental substrate 1 where heat generating elements are formed, the spacer layer 36 is produced at first. Then, on the spacer layer, the wall member 630 having movable members 31 formed by slits 35 in advance is installed. Lastly, the grooved member 50 is fixed over it to complete this liquid discharge head.

Since this liquid discharge head is structured as described above, each of the air bubble generating area 11 is a space surrounded by the heat generating element 2, the spacer layer 636, and the movable member 31 (the wall member 630 in the vicinity of the movable member 31). Liquid supply to this air bubble generating area is performed by way of the through hole arranged on substantially center of the heat generating element. In this respect, in accordance with the example shown in FIGS. 23A to 23C, the liquid supply path 620, which is conductively connected with the liquid flow path 14, extends to the other side end of the elemental substrate 1. As a result, it is possible to supply liquid to the liquid flow path 14 through the liquid supply path 620, and also, to the air bubble generating area 11 through the liquid supply path 621 from the same side end of the elemental substrate 1.

Now, the operation of this liquid discharge head will be described. In the normal state, the movable member 31 is stationary in a position indicated by dotted line in FIG. 23A. The air bubble generating area 11 is filled with liquid through the liquid supply path 621 and the through hole 619. The liquid flow path 14 is filled with liquid through the liquid supply path 620. The heat generating element 2 is heated when electric energy is applied to it, thus partly heating liquid filled in the air bubble generating area 11. Then, the air bubble 40 is created following film foiling. At this juncture, the movable member 31 is displaced toward the liquid flow path 14 side by means of pressure exerted by the creation of the air bubble 40. With the movable member 31 thus displaced, the pressure propagating direction of the pressure exerted by the creation of the air bubble is led toward the discharge port. As a result, based upon the principle described earlier, a part of liquid in the liquid flow path 14 is discharged from the discharge port 18 as each droplet.

At this juncture, as compared with FIG. 4 and FIG. 5 referred to in the description of the discharge principle given earlier, the pressure component orientated to the pressure propagating directions $V_1$ to $V_8$ by the creation of air bubble in the air bubble generating area 11 is all transferred to the movable member 31 or the side wall (spacer layer 636) of the air bubble generating area 11 for the liquid discharge head described here. As a result, there is almost no energy loss with respect to the discharging power. In this respect, it is known that the pressure waves following the creation of each air bubble are being propagated intensively from the boundary between the heating surface of each heat generating element 2 and liquid at the beginning of film boiling on each of the heat generating elements 2. Therefore, even with a through hole 619, which is open to the heat generating element 2, the surface of the heat generating element 2 is not involved in any anticipated factor from the liquid supply path 621 side. Therefore, almost no back waves are propagated to the liquid supply path 21 side by way of the through hole 619. Also, there is almost no reverse flow of liquid from the air bubble generating area 11 to the liquid supply path 621 side.

Therefore, no back waves are present essentially. At the same time, it is possible to lead the pressure component created by each air bubble to the discharge port effectively. As a result, the flow of discharging liquid is made one directional and more stabilized, thus enhancing the discharging efficiency remarkably. In this respect, the position of the movable member 31 is indicated by solid line when the air bubble 40 is in the developing process. When film boiling begins, the air bubble exists only on the boundary portion with the surface of the heat generating element 2. No air bubble is present in the position of the through hole 619, but as time elapses, the air bubble 40 develops to cover the through hole 619.

Now, the description will be made of the operation at the time of defoaming. When the air bubble 40 contracts and deforms, the air bubble 40 does not change its central portion essentially in the process of contraction. For the liquid discharge head of the present embodiment, the though hole 619 is arranged almost in the central portion of the heat generating element 2. However, at the final stage of the defoaming process of the air bubble 40, the air bubble exists only in the position corresponding to the through hole 619. This position is slightly away from the surface of the heat generating element 2. As a result, compared to the case where defoaming reaches its final stage immediately upon the surface of the heat generating element 2, the influence of cavitation becomes smaller with respect to the heat generating element 2. Also, as this defoaming position is the position for liquid being refilled from the liquid supply path 621, the contracting pressure exerted by defoaming is weakened because of this refilling, which contributes to making the influence of cavitation smaller still with respect to the heat generating element 2, hence leading to the enhancement of durability of each heat generating element 2 to materialize its longer life.

Now, the description will be made of liquid to be supplied to the liquid flow path 14 and the air bubble generating area 11. For this liquid discharge head, it may be possible to use the same liquid to both the liquid flow path 14 and the air bubble generating area 11 or use different liquids. When the same liquid is used, it may be possible to provide one common liquid chamber that connects the liquid supply path 620 on the liquid flow path 14 side with the liquid supply path 621 on the air bubble generating area 11 side or to prepare separate supply systems in order to make it possible to control the liquid flow efficiently by the utilization of difference in supply pressure.

On the other hand, when different liquids are supplied to the air bubble generating area 11 and to the liquid flow path 14, liquid for use of foaming by the application of heat (foaming liquid) is supplied to the air bubble generating area 11, while liquid for use of discharging (discharging liquid) is mainly supplied to the liquid flow path 14. When using different liquids for discharging and foaming separately, it is made possible to effectively discharge even highly viscous liquid in good condition in such a manner as to supply to the liquid flow path 14 such highly viscous liquid that does not present sufficient discharging power when heated conventionally due to difficulty in creating sufficient foaming, while supplying to the air bubble generating area 11 the liquid, which is provided with good foaming properties or with low boiling point as foaming liquid. Likewise, liquid whose nature is not very strong against heat can be used without damaging it thermally by supplying it to the liquid flow path 14 and it can be discharge with high discharging efficiency and high discharging power.

Now that the second embodiment of the present invention has been described, what is important here is that liquid is supplied from the surface opposite to each movable member. Also, the configuration of each heat generating element 2 and the position of each through hole 619 are not necessarily limited to those described above. In order to prevent the influence of cavitation with respect to each of the heat generating elements 2, it is preferable to form the through hole in the defoaming position, but depending on the structures of the liquid flow path, the defoaming position does not necessarily agree with the central position of each area of each heat generating element 2. In such a case, it is preferable to arrange the through hole 619 corresponding to the defoaming position even though it deviates from the central area of the heat generating element 2.

(Third Embodiment)

Figure 24A:
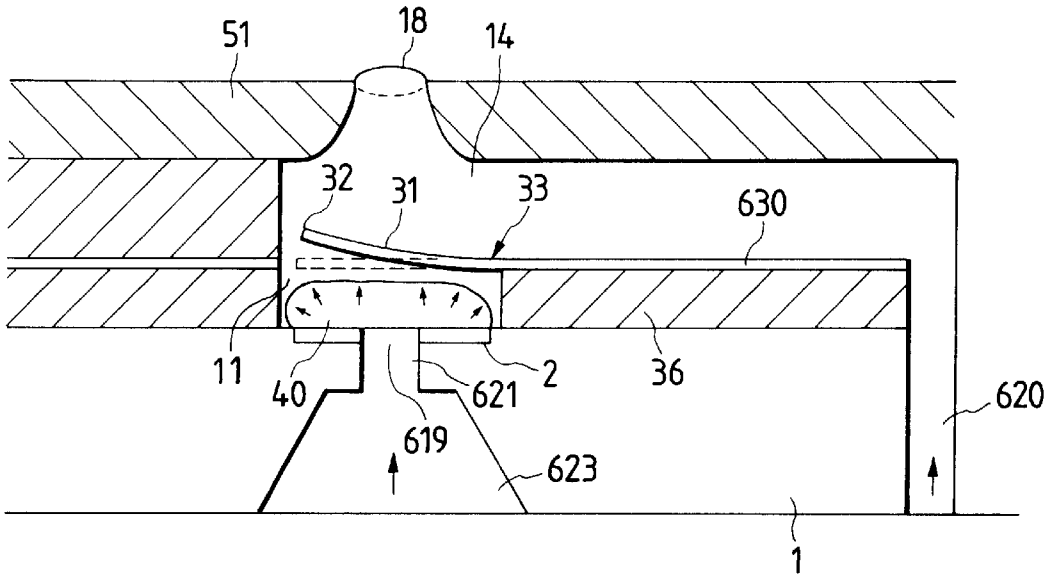
FIG. 24A is a cross-sectional view which schematically shows a liquid discharge head in accordance with a third embodiment of the present invention.
Figure 24B:
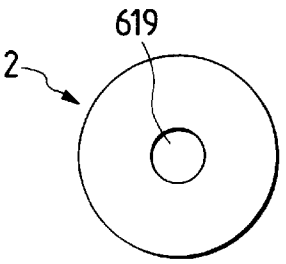
FIG. 24B is a plan view which shows the configuration of a heat generating element.

FIG. 24A is a cross-sectional view schematically showing the structure of the liquid discharge head in accordance with a third embodiment of the present invention. FIG. 24B is a plan view which shows the configuration of the heat generating element of this liquid discharge head.

This liquid discharge head is the so-called side shooter type liquid discharge head where discharge ports 18 are arranged in the position corresponding to each of the air bubble generating areas (heat generating elements 2). What differs in this liquid discharge head from the liquid discharge head shown in FIGS. 23A to 23C is that the orifice plate 51 is arranged instead of the grooved member, and also, each of the heat generating elements is circular having the through hole 619 in its central portion. The orifice plate 51 is made of resin molding or the like, for example. On one surface thereof, a groove is formed corresponding to the liquid flow path 14. At the same time, the discharge port 18 is formed as the through hole that conductively connects the end portion of this groove with the other surface. The discharge port 18 is arranged immediately above the heat generating element 2, that is, arranged just in the position corresponding to the through hole 619.

Now, the operation of this liquid discharge head will be described. As in the case of the third embodiment, when each of the heat generating elements 2 generates heat, liquid in the corresponding air bubble generating area 11 creates the air bubble 40. By means of the pressure exerted by the creation of the air bubble, the free end 32 of the movable member 31 is largely displaced to the liquid flow path 14 side. Then, the pressure waves exerted by the creation of air bubble is led toward the discharge port 18 side, thus discharging each droplet from the discharge port 18. It may be possible to supply the same liquid to the air bubble generating area 11 and the liquid flow path 14, or supply different ones to them, respectively. For the present embodiment, too, the through hole 619 is arranged for the corresponding heat generating element 2, and by way thereof, liquid is supplied to the air bubble generating area 11, thus suppressing back waves in order to stabilize the flow of liquid. At the same time, it becomes possible to reduce the influence of cavitation with respect to each of the heat generating elements 2. In this respect, the configuration of heat generating elements 2, and the positional relationship between each heat generating element 2 and through hole 619 is not necessarily limited to those described above as in the case of the first embodiment. Also, each of the discharge port 18 is not necessarily placed immediately above the corresponding heat generating element 2. For example, it may be off set to the left-hand side in FIGS. 24A and 24B so that it is positioned above the free end 32 of the movable member 31 in the stationary position. Further, the movable member 31 is not necessarily made to cover the enter surface of the heat generating elements, but to cover approximately half of them, and the remaining portion is structured so as to enable the air bubble generating area 11 and liquid flow paths 14 to be conductively connected freely.

(Fourth Embodiment)

Figure 25:
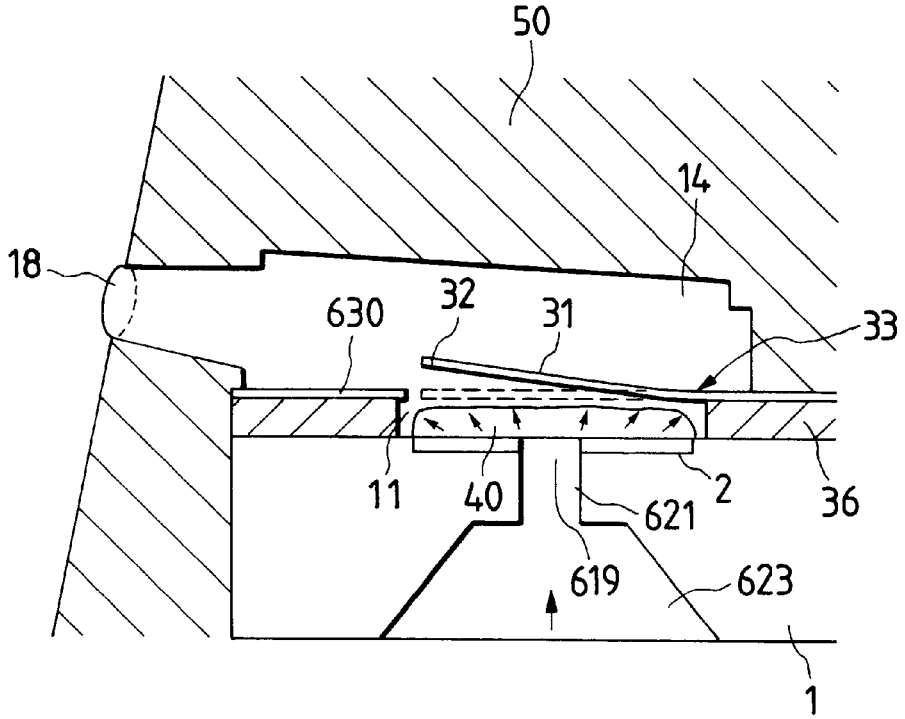
FIG. 25 is a cross-sectional view which shows a liquid discharge head in accordance with a fourth embodiment of the present invention.

FIG. 25 is a cross-sectional view which shows the structure of the liquid discharge head in accordance with a fourth embodiment of the present invention. This liquid discharge head is structured to supply liquid from the air bubble generating area 11 side to the liquid flow path 14 through the slit formed for the wall member 630 in the circumference of the movable member 35 instead of the liquid supply path 620 conductively connected with the liquid flow path 14 for the liquid discharge head of the second embodiment described above. With the arrangement of a structure of the kind, it is possible to attempt making the structure simpler. For the present embodiment, it is intended to materialize high discharging efficiency and good liquid supply characteristics as described in conjunction with the discharging principle earlier. Particularly, it is intended to suppress the backward progress of meniscus, thus utilizing the pressure to be exerted at the time of defoaming, and then, to perform almost all the liquid supplies compulsorily by means of refilling.

For this liquid discharge head, too, it is made possible to suppress back waves in order to stabilize the flow of liquid, and at the same time, to reduce the influence of cavitation with respect to each of the heat generating elements 2.

(Fifth Embodiment)

Figure 26:
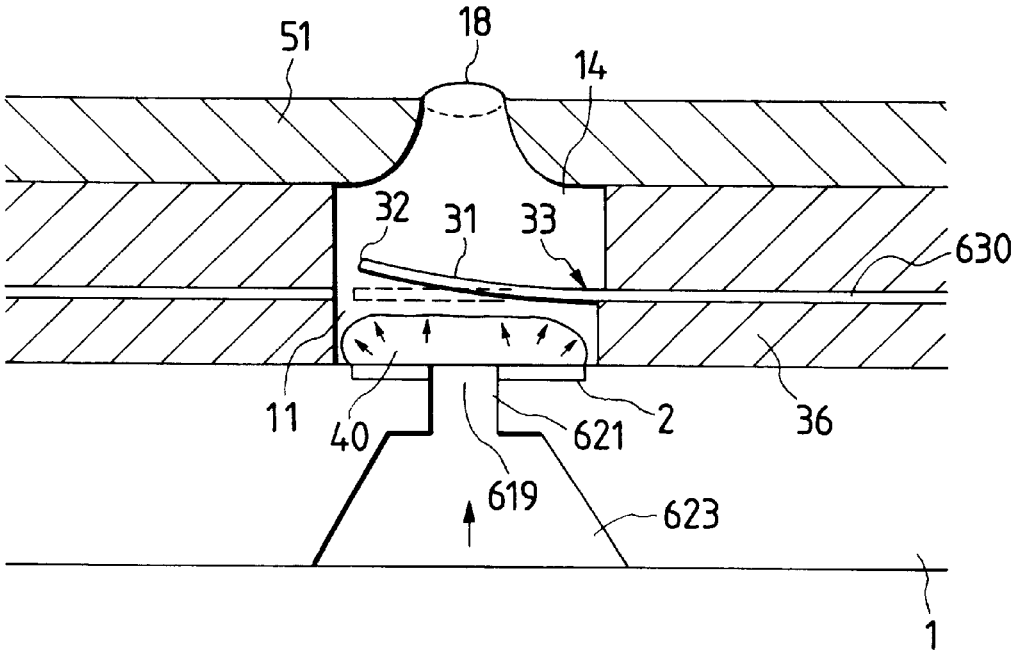
FIG. 26 is a cross-sectional view which shows a liquid discharge head in accordance with a fifth embodiment of the present invention.

FIG. 26 is a cross-sectional view which shows the structure of the liquid discharge head in accordance with a fifth embodiment of the present invention. For this liquid discharge head, it is also structured to supply liquid to the liquid flow path 14 from the air bubble generating area 11 side through the slit or the like described above, instead of the liquid supply path 20, which is conductively connected with the liquid flow path 14 of the liquid discharge head in accordance with the third embodiment. With the arrangement of a structure of the kind, it is possible to attempt making the structure simpler. For the present embodiment, it is intended to materialize high discharging efficiency and good liquid supply characteristics as described in conjunction with the discharging principle earlier. Particularly, it is intended to suppress the backward progress of meniscus, thus utilizing the pressure to be exerted at the time of defoaming, and then, to perform almost all the liquid supplies compulsorily by means of refilling.

For this liquid discharge head, too, it is made possible to suppress back waves in order to stabilize the flow of liquid, and at the same time, to reduce the influence of cavitation with respect to each of the heat generating elements 2.

(Other Embodiments)

Now, the embodiments of the principal part of the liquid discharge heads of the present invention have been described. Hereinafter, the description will be made of details of the structures preferably applicable to those embodiments.

(Movable Member and Wall Member)

The configuration of the movable member may be made arbitrarily if the configuration is such that it does not occupy the air bubble generation area 11 side, and that it is able to facilitate operation, while presenting excellent durability. For the description of the discharging principle, the separation wall is formed by nickel of approximately 5 $\mu$m thick. However, the present invention is not necessarily limited to such arrangement. It should be good enough if only the material used for the formation of the separation wall (wall member) and the movable member, is such that it has resistance to solvents of foaming and discharging liquids, while having elasticity as a movable member that enables good operation, and that it has properties that allow the formation of fine slits. For the embodiments described above, slits are formed for the wall member to enable them to function as movable members, but it may be possible to adopt the mode in which only the movable members are arranged without any separation wall (in this case, the pivot of each movable member is placed on the elemental substrate or on the spacer layer through an appropriate supporting member or without any intervention thereof) or to structure the separation wall and movable member with separate materials.

Figure 27A:
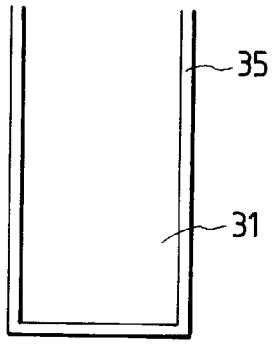
FIGS. 27A, 27B and 27C are views illustrating other configurations of movable members.
Figure 27B:
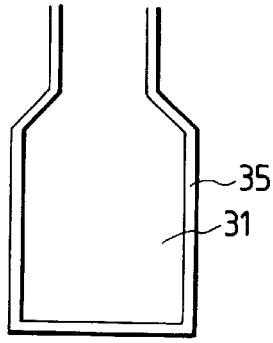
Figure 27C:
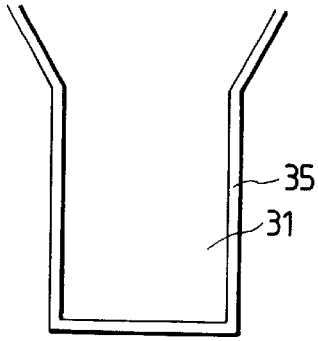

FIGS. 27A to 27C are views that shows other configurations of the movable member 31. On the separation wall, the slit 35 is arranged for each of them. By means of the slit 35, the movable member 35 is constituted. FIG. 27A shows an elongated configuration; FIG. 27B shows the configuration having narrower portion on the pivoting side to facilitate the movement of the member; FIG. 27C shows the configuration having the wider portion on the pivoting side to enhance the durability of the member. As the configuration that presents a easier movement and good durability, it is preferable to configure the member to present its pivoting side whose width is narrower in circular shape as shown in FIG. 14A. However, it should be good enough if only the movable member is configured not to occupy the second liquid flow path side, while facilitating its movement, and present excellent durability.

As a material for the movable member, it is preferable to use highly durable metal, such as silver, nickel, gold, iron, titanium, aluminum, platinum, tantalum, stainless steel, or phosphor bronze, or alloys thereof, or resin having acrylonitrile, butadiene, styrene or other nitrile group, resin having polyamide or other amide group, resin having polycarbonate or other carboxyl group, resin having polyacetal or other aldehyde group, resin having polysulfone or other sulfone group, or resin having liquid crystal polymer or the like and its chemical compound, such metal as having high resistance to ink as gold, tungsten, tantalum, nickel, stainless steel, or tantalum, or its alloys and those having them coated on its surface for obtaining resistance to ink, or resin having polyamide or other amide group, resin having polyacetal or other aldehyde group, resin having polyether ketone or other ketone group, resin having plyimide or other imide group, resin having phenol resin or hydroxyl group, resin having polyethylene or other ethyl group, resin having polypropylene or other alkyl group, resin having epoxy resin or other epoxy group, resin having melamine resin or other amino group, resin having xylene resin or other methylol group, and its compounds, and further, ceramics such as silicon dioxide and its compound.

As a material for the separation wall (wall member), it is preferable to use resin having good properties of resistance to heat and solvent, as well as good formability as typically represented by engineering plastics in recent years, such as polyethylene, polypropylene, polyamide, polyethylene telephthalate, melamine resin, phenol resin, epoxy resin, polybutadiene, polyurethane, polyether etherketone, polyether sulfone, polyarylate, polyimide, polysulfone, liquid crystal, or polymer (LCP) and its compound or silicon dioxide, silicon nitride, nickel, gold, stainless steel or other metals, its alloys or those coated with titanium or gold.

Also, the thickness of the separation wall (wall member) should be determined by the selected material and configuration from the viewpoint of whether or not desired strength and operativity are obtainable as the movable member. However, it is preferable to obtain a thickness of 0.5 $\mu$m to 10 $\mu$m.

The width of the slit 35 that forms the movable member 31 is 2 $\mu$m, for example. However, if it is desired to prevent any mixture of liquids when foaming liquid and discharging liquid are different ones, the width of the slit 35 is made a gap of a dimension that allows the formation of meniscus between both liquids, and the distribution of liquids themselves should be suppressed. For example, if liquid of approximately 2 cp (centipoise) is used as foaming liquid and liquid of approximately 100 cp or more is used as discharging liquid, it is possible to prevent its mixture even by the slit of 5 $\mu$m wide, but it is preferable to make it 3 $\mu$m or less.

As the movable member for the present invention, a thickness of $\mu$m order (t $\mu$m) is taken into account. It is not intended to use any movable member having a thickness of cm order. For the movable member having a thickness of $\mu$m order, it is desirable to take into account some variations resulting from manufacture if the $\mu$m order is set as an objective range for the width of its slit.

If the thickness of the member, which faces the free end and or side end of the movable member 31 having a slit to be formed therefor, is equal to that of the movable member (see FIG. 12, FIG. 13 and others), it is possible to suppress the mixture of foaming and discharging liquids stably by defining the relationship between the width and thickness of the slit within the range give below in consideration of variations resulting from manufacture. In other words, although condition is limited, if a highly viscous ink (5 cp, 10 cp, or the like) is used with respect to foaming liquid having a viscosity of 3 cp or less from the viewpoint of designing, it is possible to arrange a structure capable of suppressing the mixture of these liquids for a long time, provided that it is arranged to satisfy the relationship of $w/t \leqq 1$.

Also, the slit that gives a condition "essentially closed state" as referred to in the description of the present invention is made more reliable, if it is processed within an order of several $\mu$m.

As described above, if the functions are separated with respect to foaming liquid and discharging liquid, the movable member functions essentially as a partitioning member. However, when the movable member shifts along the creation of each air bubble, it is observable that slight amount of foaming liquid is mixed with discharging liquid. Discharging liquid for image formation has, in general, a colorant density of approximately 3% to 5% for ink jet recording. With this in view, any significant change is brought about if foaming liquid is mixed with discharging droplet within a range of 20% or less. Therefore, it is to be understood that the mixture of foaming liquid and discharging liquid, which makes such mixture 20% or less of the discharging droplet, is included in the range of the present invention.

In this respect, when actual discharges are performed under this structure, the mixture of foaming liquid is 15% at the upper limit even if viscosity changes. With foaming liquid of 5 cp or less, this mixing ratio is approximately 10% at the upper limit, although it depends on driving frequencies. If the viscosity of discharging liquid is defined as 20 cp or less in particular, it is possible to reduce this mixture (to 5% or less) when the viscosity is made smaller.

(Heat Generating Element)

The structure of each heat generating element arranged on the elemental substrate may be the one in which only each resisting layer (heat generating portion) is formed between wire electrodes on the elemental substrate or the one that includes a protection layer that protects the resisting layer. Further, on the elemental substrate, transistors, diodes, latches, shift registers, and other functional elements may be incorporated integrally in the semiconductor manufacturing process.

For each of the embodiments described above, a heat generating unit, which is structured by the arrangement of resisting layer that generates heat in response to electric signals, is used, but the present invention is not necessarily limited to this type of heat generating unit. It should be good enough if only the unit is able to cause foaming liquid to create each air bubble that is sufficient enough to discharge the discharging liquid that may be used. For example, it may be possible to use optothermal transducing elements having the heat generating portion that generates heat when receiving laser beam or other light beams or heat generating elements having the heat generating portion that generates heat when receiving high-frequency waves.

(Discharging Liquid and Foaming Liquid)

In accordance with the present invention described above, it is possible to discharge liquid with higher discharging power and discharging efficiency than the conventional liquid discharge head with the adoption of the structure provided with the movable member described earlier. It is also capable of discharging liquid higher speeds. When the same liquid is used as foaming liquid supplied to each air bubble generating area and as discharging liquid supplied to the liquid flow path, it is possible to use various kinds of liquids if only the applying liquid is such that its quality is not deteriorated by means of heating, it does not generate deposition easily on the heating elements when being heated, and also, it is capable of presenting reversible change of states by means of vaporization and condensation when being heated, and further, it does not cause each liquid flow path, movable member, and wall member to be deteriorated.

Of such liquids, it is possible to use ink having the composition used for the conventional bubble jet apparatus as liquid to be used for recording (recording liquid), for example.

On the other hand, when different liquids are used as discharging liquid and foaming liquid, respectively, it is possible to use liquid having the properties described above as foaming liquid. More specifically, the following can be named: methanol, ethanol, n-propanol, isopropanol, n-hexan, n-heptane, n-octane, toluene, xylene, ethylene dichloride, trichloro ethylene, Freon BF, ethyl ether, dioxane, cyclohexane, methyl acetate, ethyl acetate, acetone, methyl ether ketone, water, and its mixtures, among others. On the other hand, as discharging liquid, various kinds of liquid can be used without the presence and absence of foaming liquid and thermal properties. Also, even the liquid whose foaming capability is low to make discharging difficult by use of the conventional head, the liquid whose properties are easily changeable or deteriorated when receiving heat or the liquid whose viscosity is high can be used as discharging liquid. However, as the properties of discharging liquid, it is desirable that such liquid is the one that does not hinder discharging, foaming, and the operation of the movable member or the like by the discharging liquid itself or by reaction caused by its contact with foaming liquid. As discharging liquid for recording, it is possible to use highly viscous ink or the like. As other discharging liquids, it may be possible to name such liquid as the medicine and perfume whose properties are not strong against heat.

Now, for the liquid considered to present difficulty for the conventional discharging, the discharging speeds tend to be slower. Therefore, if the conventional liquid discharge head is used, the discharging orientation is varied to make the precision of dot impact on a recording sheet inferior. Also, the discharging amount is caused to vary due to unstable discharging. As a result, it is difficult to obtain images of good quality. However, with the embodiments structured as described above, it becomes possible to create each air bubble sufficiently and stably by use of foaming liquid. Therefore, the precision of droplet impact can be enhanced with the stabilized amount of ink discharge. Hence, the quality of recorded images is improved significantly.

Also, as a recording medium for which ink and other liquid are provided, it is possible to use as an objective material various kinds of paper and OHP sheet, plastic materials used for compact disc, ornamental board, metallic material such as aluminum and copper, cattle hide, pig hide, artificial leathers other leather materials, wood, plywood, bamboo, ceramics such tiles, sponge, or other three-dimensional structures.

In accordance with the present invention, it is possible to obtain a recorded object having good image quality by the provision of ink as discharging liquids each having colorant ink (2 cp), pigment ink (15 cp), polyethylene glycol 200 (55 cp), or polyethylene glycol 600 (150 cp), respectively, with the driving voltage of 25 V at 2.5 KHz, while using a mixed liquid of ethanol and water as described above.

(Liquid Discharge Head Cartridge)

Figure 28:
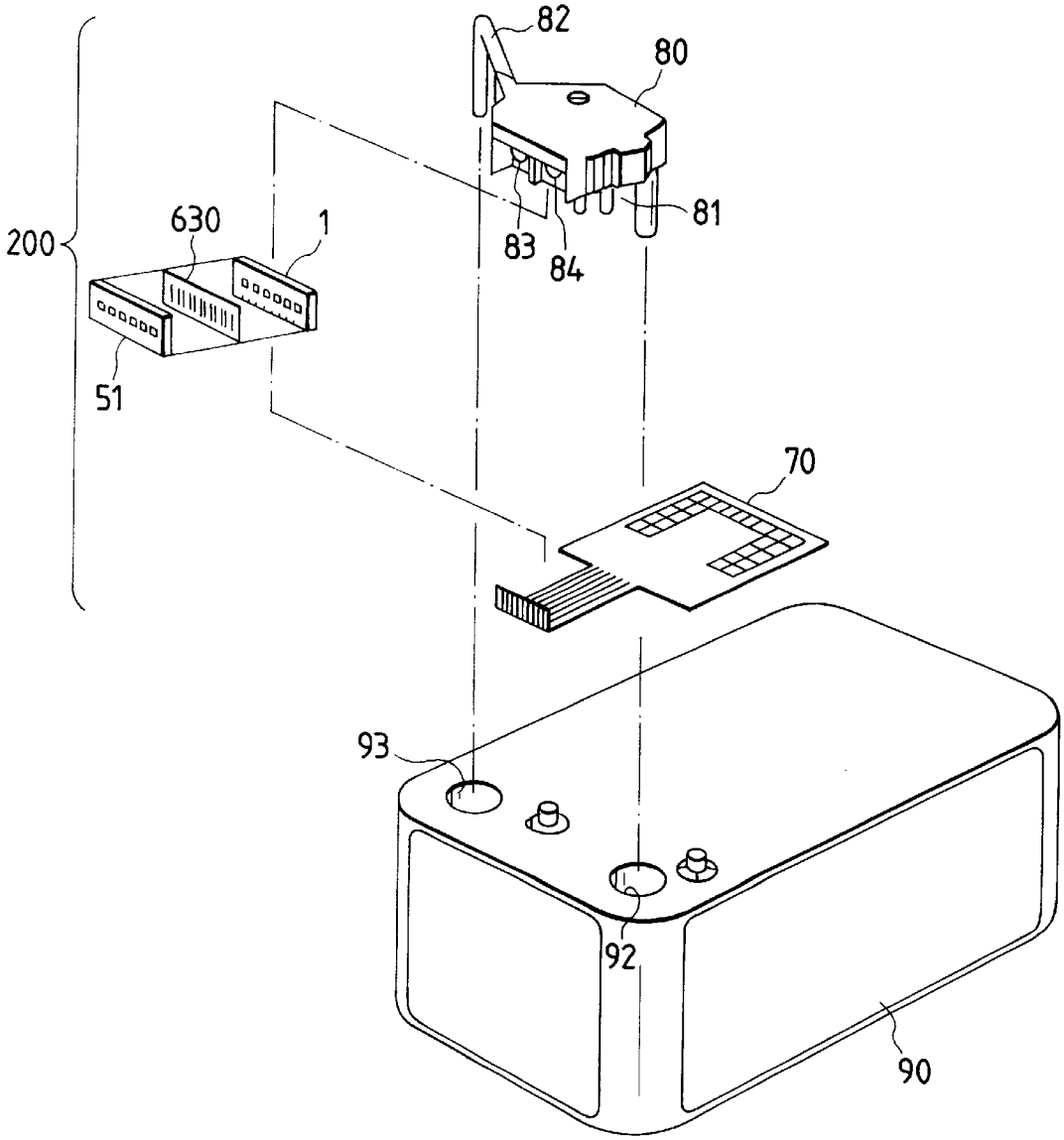
FIG. 28 is an exploded perspective view which shows a liquid discharge head cartridge.

Now, the brief description will be made of the liquid discharge head cartridge that mounts the liquid discharge head in accordance with each of the embodiments described above. Any one of the liquid discharge heads described above can be structured as a cartridge. Hereinafter, the structure of the liquid discharge head cartridge will be described briefly. Here, the description will be made assuming that the side-shooter type liquid discharge head shown in FIGS. 24A and 24B (the third embodiment) is used. FIG. 28 is an exploded perspective view which schematically shows the liquid discharge head cartridge including such liquid discharge head. The structure of this liquid discharge head cartridge is roughly divided into the liquid discharge head unit 200 and the liquid container 90. Here, fundamentally, it is possible to constitute a liquid discharge head cartridge even by using the edge-shooter type liquid discharge heads of the first and second embodiments.

The liquid discharge head unit 200 comprises the elemental substrate 1 that has been formed up to the spacer layer, the wall member 30, the orifice plate 51, the liquid supply member 80, and the printed-circuit board (TAB tape) 70 for supplying electric signals, among some others. As described earlier, a plurality of heat generating resistors (heat generating elements) are arranged in line on the elemental substrate 1. Also, a plurality of functional elements are arranged to selectively drive these heat generating resistors. Each of the air bubble generating area is formed between the elemental substrate 1 and the wall member 30 provided with movable elements. Foaming liquid is distributed thereto. By the junction of the wall member 30, orifice plate 51, and liquid supply member 80, the liquid flow path (not shown) is formed to distribute the discharging liquid to be discharged.

For the liquid container 90, ink or other discharging liquid and foaming liquid that creates each air bubble, which are supplied to the liquid discharge head, respectively, are separated and stored in the container. For the outer side of the liquid container 90, the positioning unit 94 is provided to arrange a connector that connects. Also, a fixing shaft 95 is arranged to fix this connector. The TAB tape 70 is incorporated by positioning the liquid container 90 with respect to the head unit, and fixed to the surface of the liquid container 90 by means of a double sided tape. Discharging liquid is supplied to the discharging liquid supply path 84 of the liquid supply member 80 from the discharging liquid supply path 92 of the liquid container 90 through the supply path 81 of the connecting member, and then, supplied to the discharging liquid flow path though the discharge supply path 20 of each member. Likewise, foaming liquid is supplied from the supply path 93 of the liquid container 90 to the foaming liquid supply path 83 of the liquid supply member 80, and then, supplied to each of the air bubble generating area through the foaming liquid supply path 21 of each member.

Now, the description has been made of the liquid discharge head cartridge having the supply mode that enables foaming liquid and discharging liquid to be supplied as different liquids, and the liquid container as well. However, when the discharging liquid and foaming liquid are the same, the supply path for foaming liquid and that for discharging liquid are not necessarily separated. Also, the liquid container may be used by refilling liquid after each liquid has been consumed. To this end, it is desirable to arrange a liquid injection port for the liquid container. Also, it may be possible to form the liquid discharge head and liquid container integrally or to form them separately.

(Liquid Discharge Apparatus)

Figure 29:
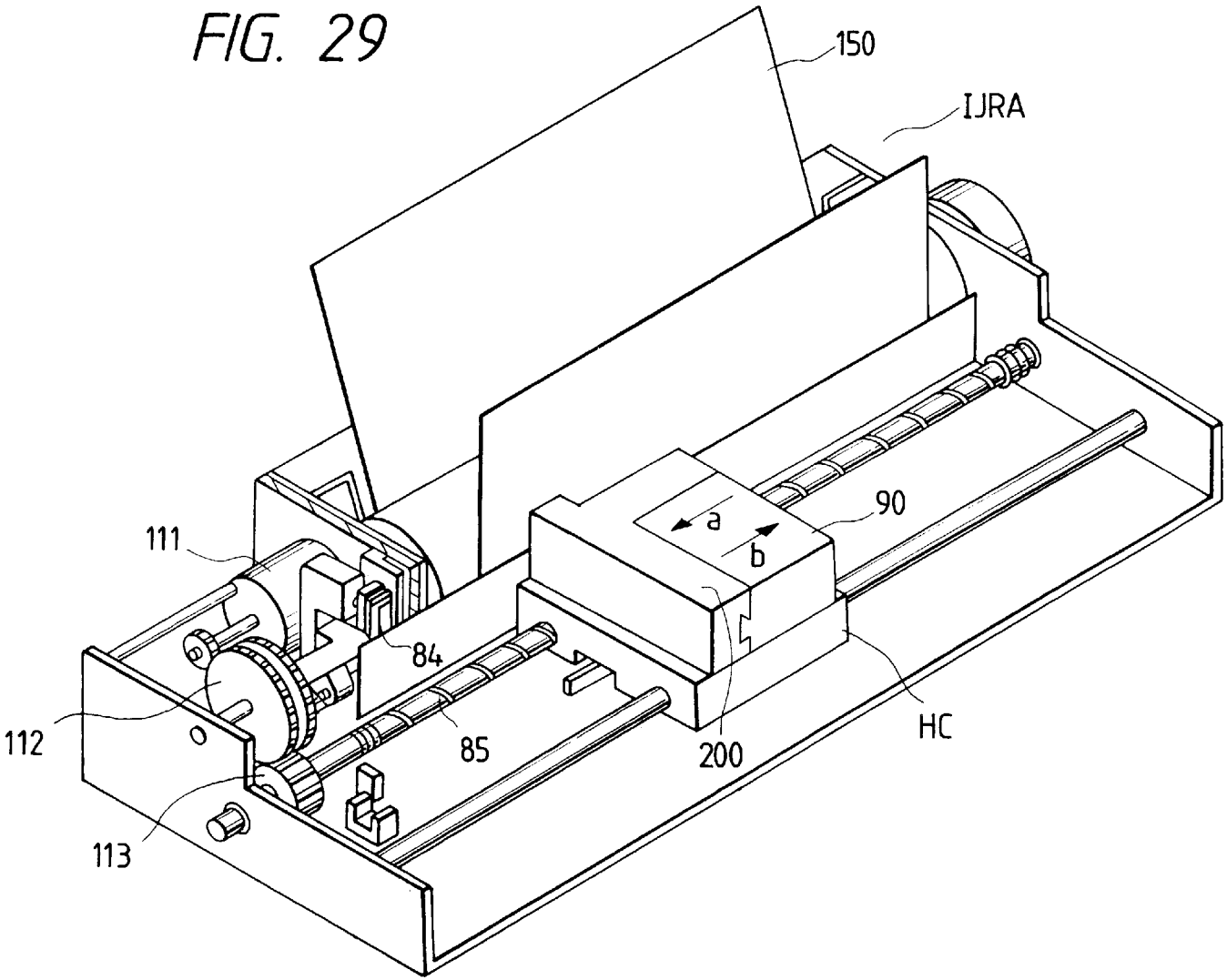
FIG. 29 is a perspective view schematically showing the structure of a liquid discharge apparatus.

FIG. 29 is a view which schematically shows the liquid discharge apparatus that mounts the liquid discharge head. Here, particularly, the description will be made of an ink jet recording apparatus IJRA using ink as discharging liquid.

The carriage HC of the liquid discharge apparatus (ink jet recording apparatus IJRA) mounts detachably the head cartridge, which comprises a liquid tank unit 90 for containing ink and liquid discharge head unit 200, and reciprocates in the width direction of a receding medium, such as recording sheet, which is carried by recording medium carrier means. When driving signals are supplied to the liquid discharge head unit on the carriage HC from driving signal supply means (not shown), recording liquid is discharged from the liquid discharge head onto the recording medium in response to these signals. Also, the recording apparatus is provided with a motor 111 as the driving source, gears 112 and 113, and carriage shaft 85 or the like to transfer the driving power from the driving source to the carriage. It is possible to obtain recorded objects having good images by using this recording apparatus and liquid discharging method adopted for the recording apparatus.

Figure 30:
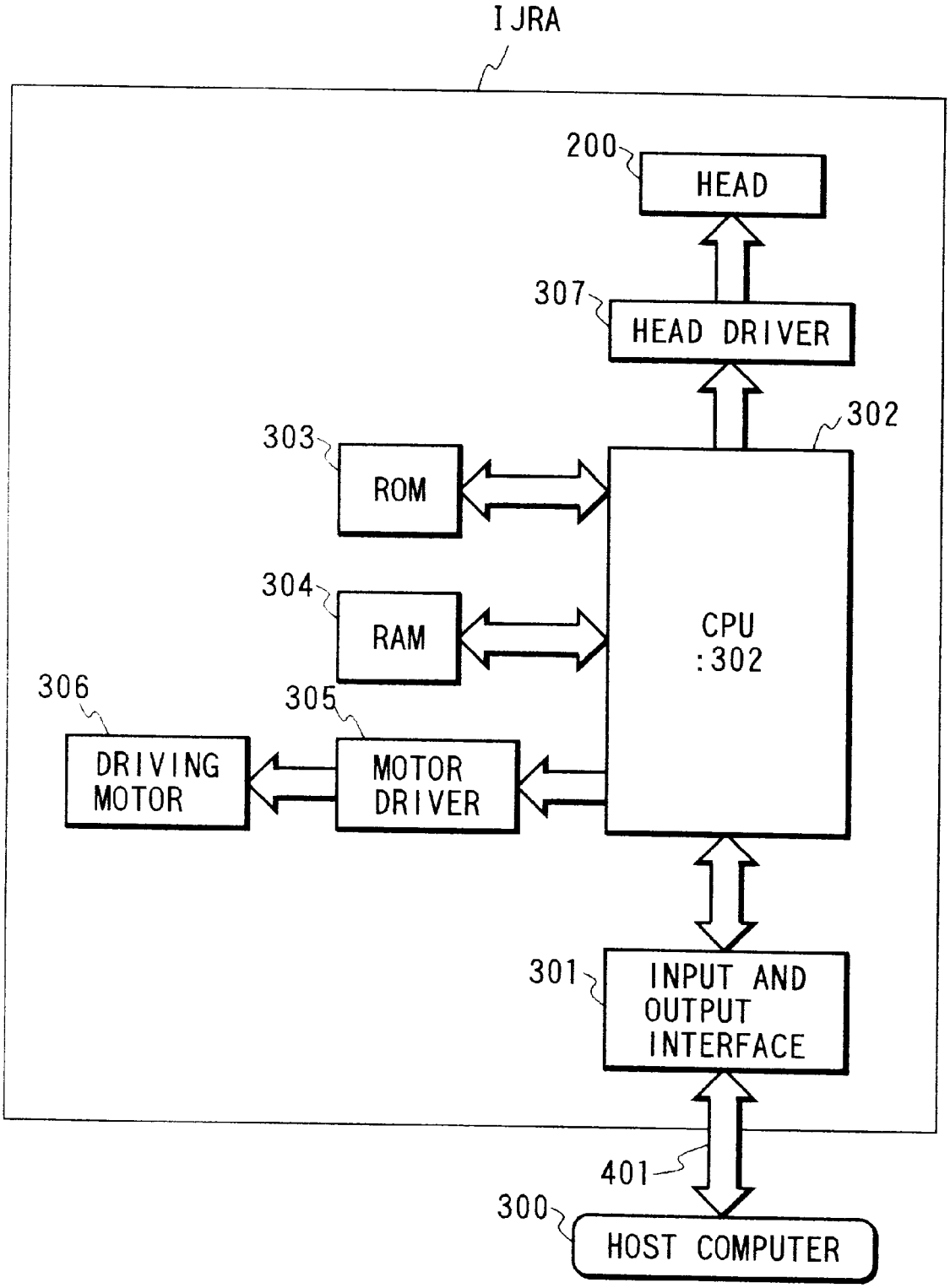
FIG. 30 is a block diagram showing the structure of circuit for the apparatus represented in FIG. 29.

FIG. 30 is a block diagram which shows the recording apparatus as a whole, which discharges ink for recording by the application of the liquid discharging method and liquid discharge head of the present invention.

This recording apparatus receives printing information from a host computer 300 as control signals. The printing information is provisionally stored in the input interface 301 in the recording apparatus. At the same time, the printing information is converted to the data that can be processed in the recording apparatus, thus being inputted into the CPU 302 that dually functions as means for supplying head driving signals. The CPU 302 processes the inputted data using peripheral units such as RAM 304 and others in accordance with the controlling program stored in the ROM 302, and converts them to printing data (image data). Also, the CPU 302 produces motor driving data in order to drive the driving motor that carries the recording sheet and the recording head in synchronism with each other for recording the image data in appropriate positions on the recording sheet. The image data and driving data are transferred to the head 200 and driving motor 306 through the head driver 307 and the motor driver 305, respectively, which are driven in accordance with the controlled timing to form images.

As the recording medium usable by the recording apparatus described above for the provision of ink or other, there can be named various paper and OHP sheets, plastic materials used for compact disc, ornamental board, or the like, cloths, metallic materials such as aluminum and copper, cattle hide, pig hide, artificial leathers or other leather materials, wood, plywood, bamboo, tiles and other ceramic materials, sponge or other three-dimensional structures. Also, as the recording apparatus described above, there can be named a printing apparatus for recording on various paper and OHP sheets, a recording apparatus for plastic use to record on compact disc and other plastic materials, a recording apparatus for recording on metallic plates, a recording apparatus for use to record on leathers, a recording apparatus for use to record on woods, a recording apparatus for use to record on ceramics, a recording apparatus for use to record on a three-dimensional net structure such as sponge. Also, a textile printing apparatus that records on cloths is included. As discharging liquid used for these liquid discharge apparatuses, it may be possible to use any one of the liquids depending on the kinds of recording media and recording condition.

(Recording System)

Figure 31:
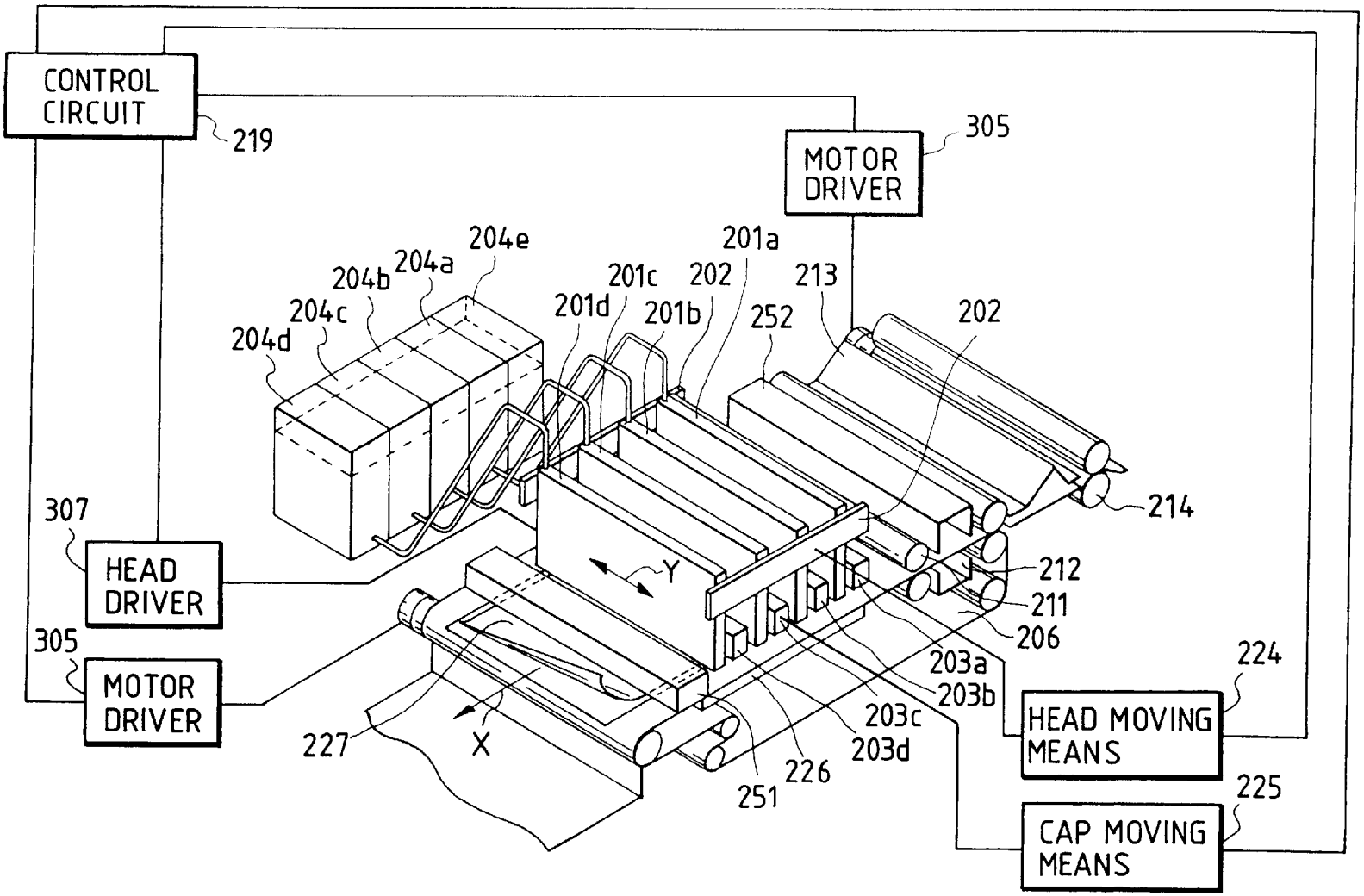
FIG. 31 is a view which shows the structure of an ink jet recording system.

Now, description will be made of one example of ink jet recording system that uses the liquid discharge head of the present invention as its recording head to perform recording on a recording medium. FIG. 31 is a view which schematically illustrates the structure of this ink jet recording system.

The liquid discharge head for this ink jet recording system is a full line type head where a plurality of discharge ports are arranged in the length that corresponds to the recordable width of a recording medium 150 at the interval (density) of 360 dpi (25.4 mm per 360 dots). Four liquid discharge heads 201*a*, 201*b*, 201*c*, and 201*d* are fixedly supported by the holder 202 in parallel to each other at given intervals in the direction X corresponding to four colors, yellow (Y), magenta (M), cyan (C), and black (Bk), respectively. From the head driver 307 constituting driving signal supplying means, signals are supplied to these liquid discharge head 201*a* to 201*d*. In accordance with such signals, four different color ink, Y, M, C, Bk, are supplied from the ink containers 204*a* to 204*d* to each of the liquid discharge heads 201*a* to 201*d*, respectively. Also, foaming liquid is stored in the foaming liquid container 204*e* and supplied to each of the liquid discharge heads 201*a* to 201*d*. Also, below each of the liquid discharge heads 201*a* to 201*d*, head caps 203*a* to 203*d* are arranged with sponge or other ink absorbing material contained in them to cover the discharge ports of the liquid discharge heads 201*a* to 201*d*, respectively, when recording is at rest. Thus the liquid discharge heads 201*a* to 201*d* are maintained.

Further, for this recording system, a carrier belt 206 is arranged to constitute carrier means for carrying each kind of recording medium as described earlier. This carrier belt is drawn around various rollers at given passage and driven by driving rollers connected with the motor driver 305.

Also, for this ink jet recording system, a pre-processing device 215, and post-processing device 252 are installed on the upstream and downstream of the recording medium carrier passage to perform various processes with respect to the recording medium before and after recording on the recording medium.

The pre-processing and post-processing are different in its contents of process depending on the kinds of recording media and kinds of ink. For example, for the metal, plastic, ceramic media for recording or the like, ultraviolet lays and ozone are irradiated to activate the surface of such media, thus improving the adhesion of ink. Also, for the recording medium, such as plastic, that easily generates static electricity, dust particles are easily attracted to the surface thereof by static electricity to hinder good recording in some cases. Therefore, as the pre-processing device, an ionizer is used to remove static electricity. In this way, dust particles should be removed from the recording medium. Also, cloths are used as the recording medium, a process to provide a substance selected from among alkali substance, water-soluble substance, synthetic polymer, water-soluble metallic salt, urea, and thiourea for the recording cloth in order to prevent stains on it, while improving coloring rate as the pre-processing. The pre-processing is not necessarily limited to those described above. It may be the process to make the temperature of a recording medium appropriately to a temperature suited for recording on such medium. On the other hand, fixation process is performed as the post-processing to promote the fixation of ink by executing heating process or irradiation of ultraviolet rays, among some others, as the post-processing for the recording medium for which ink has been provided. Cleaning process is performed as the post-processing to rinse the processing agent provided for the recording medium in the pre-processing but still remaining inactive.

Here, the description has been made in assumption that a full line head is used as the liquid discharge head, but the present invention is not necessarily limited to it. It may be possible to apply the present invention to such a mode that the smaller liquid discharge head described earlier is carried in the width direction of a recording medium for recording.

(Head Kit)

Figure 32:
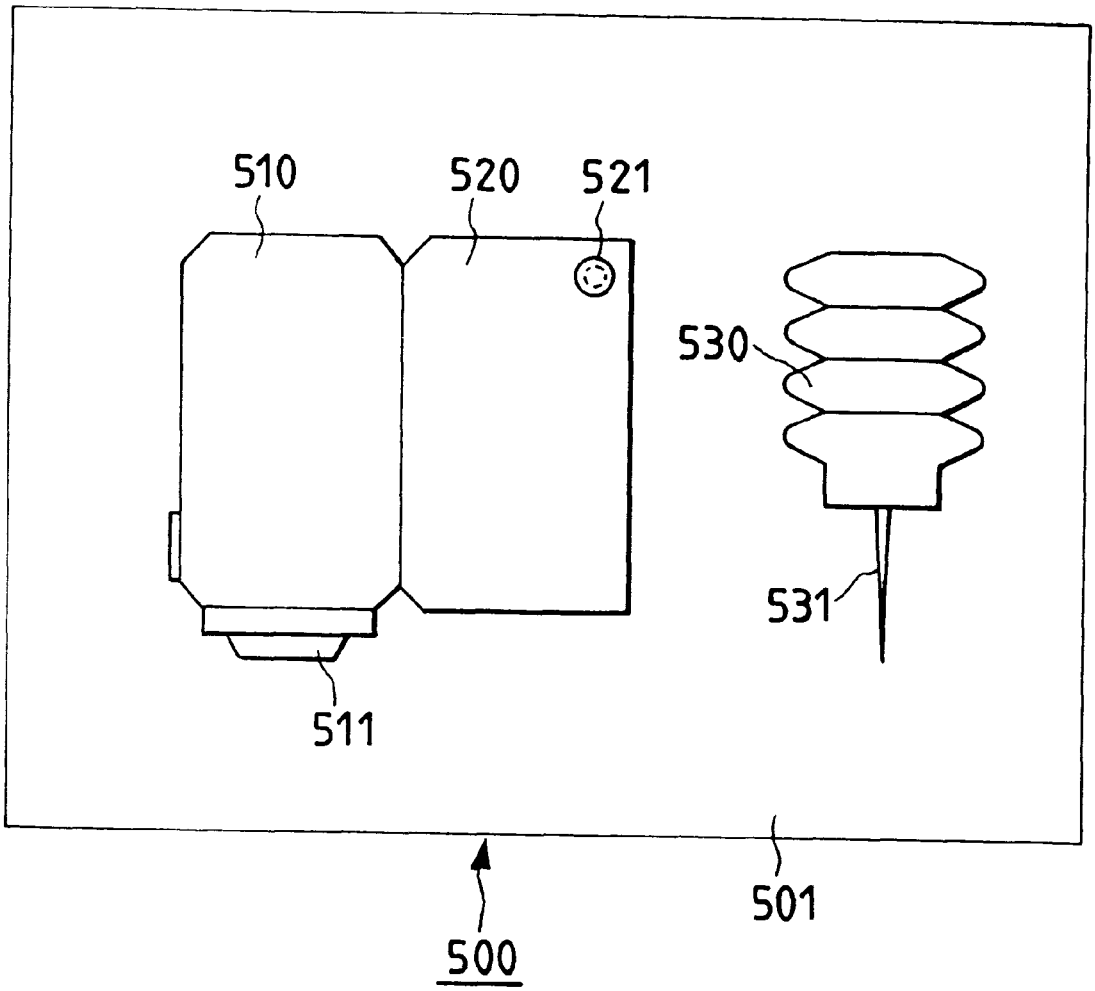
FIG. 32 is a view schematically showing a head kit.

Hereinafter, the description will be made of the head kit provided with the liquid discharge head of the present invention. FIG. 32 is a view schematically showing such head kit.

This head kit houses a liquid discharge head 510 provided with an ink jet unit 511 for discharging ink; an ink container 520, which is separable or inseparable from the liquid discharge head 510; and ink filling means 520 retaining ink to be filled into the ink container 520 in the kit container 501. When ink has been consumed, the injection unit (injection needle and others) 531 of the ink filling means 530 is partly inserted into the air communication port 521 of the ink container 520, the connector with the head, or the hole open on the wall of ink container 520, and then, through such inserted portion, ink the ink filing means 530 is filled ink container.

In this way, the liquid discharge head of the present invention, ink container, and ink filing means are housed in one kit container. Then, when ink has been consumed, ink is easily filled in the ink container immediately as described above, hence making it possible to begin recording promptly.

In this respect, the description has been made here in assumption that the ink filling means is included in the head kit, but as a head kit, it may be possible to adopt a mode in which only a separable type ink container with ink filled in it and the liquid discharge head are housed in the kit container 510 without any ink filling means. Also, FIG. 32 shows only ink filling means usable for filling ink to the ink container, but it may be possible to adopt a mode in which foaming liquid filling means arranged for filling foaming liquid to a foaming liquid container is housed in the kit container besides the ink container.

As described above, in accordance with the present invention, each of the liquid supply paths to the first and second liquid flow paths is arranged on the different side, respectively. Therefore, as compared with the structure where the second liquid supply system is arranged behind the first liquid supply path, to supply both liquids from above the head, there is an effect that the apparatus can be made smaller.

Also, for the apparatus where liquid is supplied to the second liquid flow path from the supporting element side, there is no need for the provision of any through hole arranged on the ceiling plate or separation wall for supplying liquid to the second liquid flow path. Therefore, it is possible to attempt making the head structure simpler, thus enhancing the yield in the manufacturing process. For the apparatus having a plurality of substrates arranged therefor, and liquid is supplied to the second liquid flow path by the utilization of gaps formed between each of the substrates, it is possible to attempt making the head structure simpler still, hence obtaining stabilized foaming pressure.

Further, in accordance with the present invention, liquid is supplied to each of the air bubble generating areas from the surface side facing each movable member through the air bubble generating area. Therefore, while attempting to enhance the discharging power, it is possible to suppress the propagation of the developing element of each air bubble and pressure wave component in the direction opposite to the liquid supplying direction to confine the flow of discharging liquid to one direction. As a result, there is an effect that the flow of discharging liquid is stabilized. Also, the through hole is provided for the corresponding portion where cavitation occurs with respect to the heat generating element, thus making it possible to suppress the influence of cavitation to the heat generating element. As a result, there is an effect that it is possible to attain making the life of each heat generating element longer.

What is claimed is:

1. A liquid discharging method comprising the steps of:

providing a liquid jet head having a heat generating element for creating bubbles to discharge liquid, the heat generating element being disposed on a providing surface of a substrate, a discharge port arranged corresponding to said heat generating element, a first liquid flow path conductively connected with said discharge port, a second liquid flow path arranged corresponding to said heat generating element, and a separation wall to separate said first and second liquid flow paths, said separation wall having the free end caused to be displaced to said first liquid flow path side by pressure exerted by bubbles created by said heat generating element for leading said pressure toward said discharge port side for discharging liquid from said discharge port;

causing liquid supply to said second liquid flow path and liquid supply to said first liquid flow path to be performed in a direction opposed to each other sandwiching said separation wall and at a side close to respective liquid flow paths to which the liquid supply is performed; and causing liquid supply to the second liquid flow path to be performed, with respect to the substrate and an opposite surface opposed to the providing surface, in a direction from the opposite surface to the providing surface.

2. A liquid discharging method according to claim 1, wherein a through hole is provided for the substrate having said heat generating element arranged therefor, and liquid supply to said liquid flow paths is performed through said through hole from the reverse side of the supporting member fixing said substrate.

3. A liquid discharging method comprising the steps of:

providing a head having a discharge port for discharging liquid, bubble generating areas for creating bubbles in liquid, the bubble generating areas being disposed on a providing surface of a substrate, and a movable member capable of being displaced between a first position and a second position further away from said bubble generating area than said first position, and supplying liquid at least to said bubble generating areas to displace said movable member from said first position to said second position by pressure exerted by the creation of each bubble in said bubble generating area to cause said bubble to be expanded toward said discharge port side for discharging liquid from said discharge port;

causing liquid supply to a liquid flow path communicated with said bubble generating area and liquid supply to a liquid flow path communicated with said discharge port being performed in a direction opposed to each other sandwiching said movable member and at a side close to respective liquid flow path to which the liquid supply is performed; and causing liquid supply to the bubble generating areas to be performed, with respect to the substrate and an opposite surface opposed to the providing surface, in a direction from the opposite surface to the providing surface.

4. A liquid discharging method according to claim 3, wherein said liquid is supplied from through holes provided for said bubble generating areas.

5. A liquid discharging method for discharging liquid from a discharge port by the creation of bubbles, comprising the steps of:

providing a head provided with liquid flow paths conductively connected with said discharge port, bubble generating areas having a heat generating element for creating bubble, the heat generating element being disposed on a providing surface of a substrate, and a movable member arranged between said liquid flow paths and said bubble generating areas, each having free end on said discharge port side, is used; and causing liquid supply to a liquid flow path communicated with said bubble generating area and liquid supply to a liquid flow path communicated with said discharge port being performed in a direction opposed to each other sandwiching said movable member and at a side close to respective liquid flow path to which the liquid supply is performed, and bubbles are created in said bubble generating areas by heating said heat generating element, and the free end of said movable member is displaced to said liquid flow path side by the pressure exerted by said creation of bubbles to lead said pressure to the discharge port side of said liquid flow path by said displacement of said movable member; and causing liquid supply to the heat generating element to be performed, with respect to the substrate and an opposite surface opposed to the providing surface, in a direction from the opposite surface to the providing surface.

6. A liquid discharging method for discharging liquid from a discharge port by the creation of bubbles, comprising the steps of:

providing a head provided with liquid flow paths conductively connected with said discharge port, bubble generating areas having a heat generating element for creating bubble, the heat generating element being disposed on a providing surface of a substrate, and a movable member arranged between said liquid flow paths and said bubble generating areas, each having free end on said discharge port side, is used;

causing liquid supply to a liquid flow path communicated with said bubble generating area and liquid supply to a liquid flow path communicated with said discharge port being performed in a direction opposed to each other sandwiching said movable member and at a side close to respective liquid flow path to which the liquid supply is performed;

creating bubbles in said bubble generating areas by heating said heat generating element, and the free end of said movable member is displaced to said liquid flow side by pressure exerted by the creation of bubbles to lead said pressure to the discharge port side of said liquid flow path by said displacement of said movable member; and causing liquid supply to the heat generating element to be performed, with respect to the substrate and an opposite surface opposed to the providing surface, in a direction from the opposite surface to the providing surface.

7. A liquid discharging method according to claim 5 or 6, wherein said first liquid and said liquid are the same liquid.

8. A liquid discharging method according to claim 5 or 6, wherein said first liquid and said second liquid are different liquids.

9. A liquid discharging method according to any one of claims 1, 2, 5 and 6, wherein said bubbles created by film boiling phenomenon generated in said liquid by heat of said heat generating element.

10. A liquid discharging method according to claim 5 or 6, wherein through holes are provided for said heat generating element, and said second liquid is supplied to said bubble generating areas through said through holes.

11. A liquid supplying method comprising the steps of:

providing a liquid jet head provided with a heat generating element for creating bubbles to discharge liquid, the heat generating element being disposed on a providing surface of a substrate, a discharge port arranged corresponding to said heat generating element, first liquid flow paths conductively connected with said discharge port, second liquid flow paths arranged corresponding to said heat generating element, and a separation wall to separate said first and second liquid flow paths, said separation wall having the free end caused to be displaced by pressure exerted by bubbles created by said heat generating element to said first liquid flow path side for leading said pressure toward said discharge port side for discharging liquid from said discharge port;

causing liquid supply to said second liquid flow paths and liquid supply to said first liquid flow paths being performed in a direction opposed to each other sandwiching said separation wall and at a side close to respective liquid flow paths to which the liquid supply is performed; and causing liquid supply to the second liquid flow path to be performed, with respect to the substrate and an opposite surface opposed to the providing surface, in a direction from the opposite surface to the providing surface.

12. A liquid supplying method according to claim 11, wherein a through hole is provided for the substrate having said heat generating element arranged therefor, and liquid supply to said liquid flow paths is performed through said through hole from the reverse side of the supporting member fixing said substrate.

13. A liquid supplying method according to claim 11, wherein said separation wall is configured to be substantially U-shaped for use, said separation wall being fixed to cover the substrate having said heat generating element arranged therefor, and liquid supply to said second flow paths is performed from the reverse side of the supporting member fixing said substrate through the gap formed between the side end of said substrate and the side wall of said separation wall.

14. A liquid supplying method according to claim 11, wherein a plurality of substrates having said heat generating element arranged therefor are fixed in line on the supporting element to make the intervals between heat generating element constant, and liquid supply to said second liquid flow paths is performed from said supporting element side through the gaps formed between the side walls of said substrates.

15. A liquid supplying method according to claim 14, wherein said separation wall is configured to be substantially U-shaped for use, said separation wall being fixed to cover each substrate, and liquid supply to said second flow paths is performed from the supporting member side through the gap formed between the side end of said substrate and the side wall of said separation wall.

16. A liquid discharge head comprising:

a heat generating element for creating bubbles to discharge liquid, the heat generating element being disposed on a providing surface of a substrate, a discharge port arranged corresponding to said heat generating element, first liquid flow paths conductively connected with said discharge port, second liquid flow paths arranged corresponding to said heat generating element, and a separation wall to separate said first and second liquid flow paths, said separation wall having the free end caused to be displaced by pressure exerted by bubbles created by said heat generating element to said first liquid flow path side for leading said pressure toward said discharge port side for discharging liquid from said discharge port, a first liquid supply path communicated with said first liquid flow path, and a second liquid supply path communicated with said second liquid flow path are provided in a manner that the liquid is supplied in a direction opposed to each other sandwiching separation wall and at a side close to respective liquid flow paths to which the liquid supply is performed, and the liquid supply to the second liquid flow path is performed, with respect to the substrate and an opposite surface opposed to the providing surface, in a direction from the opposite surface to the providing surface.

17. A liquid discharge head according to claim 16, wherein the substrate having said heat generating element arranged therefor is fixed to the supporting element, said substrate being provided with a through hole, and said second liquid supply path forms passage conductively connected with said second flow path from said supporting element side through said through hole.

18. A liquid discharge head according to claim 17, wherein a plurality of said second liquid flow paths are provided, and said through hole is arranged for each of said second liquid flow paths.

19. A liquid discharge head according to claim 16, wherein the substrate having said heat generating element arranged therefor, and said separation wall is configured to be substantially U-shaped for use, said separation wall being fixed to cover the substrate, and said second supply path forms passage conductively connected with said second liquid flow path from the said supporting element side through the gap formed between the side end of said substrate and the side wall of said separation wall.

20. A liquid discharge head according to claim 16, wherein a plurality of substrates having said heat generating elements arranged therefor are fixed in line on the supporting element to make the intervals between heat generating elements constant, and said second supply path forms passage conductively connected with said second flow path from said supporting element side through the gaps formed between the side walls of said substrates.

21. A liquid discharge head according to claim 20, wherein said separation wall is configured to be substantially U-shaped for use, said separation wall being fixed to cover each substrate, and said second supply path includes passage conductively connected with said second liquid flow paths from said supporting element side through the gap formed between the side end of said substrate and the side wall of said separation wall.

22. A liquid discharge head comprising:

a discharge port for discharging liquid, a heat generating element for creating bubbles by heating liquid, the heat generating element being disposed on a providing surface of a substrate, and a movable member arranged facing said heat generating element, having free end and a fulcrum thereof, said movable member being displaced by pressure exerted by the creation of said bubbles to discharge liquid from said discharge port by said displacement of said movable member; and a through hole being provided at a central portion of said heat generating element to supply liquid to said heat generating element through said through hole, wherein the liquid supply to the heat generating element is performed, with respect to the substrate and an opposite surface opposed to the providing surface, in a direction from the opposite surface to the providing surface.

23. A liquid discharge head according to claim 22, wherein said discharge port is in the position facing said heat generating element, and said movable member is provided to lie between said heat generating element and said discharge port.

24. A liquid discharge head comprising:

a discharge port for discharging liquid, liquid flow paths conductively connected with said discharge port, bubble generating areas a having heat generating element arrange therefor, the heat generating element being disposed on a providing surface of a substrate, and a movable member arranged between said liquid flow paths and said bubble generating areas, each having free end on said liquid flow side, said free end being displaced by pressure exerted by the creation of bubbles in said bubble generating areas to lead said pressure to the discharge port side of said liquid flow path, said liquid discharge head being provided with a through hole arranged at a central portion of said heat generating element, a first supply path for supplying liquid to said liquid flow path, and a second supply path for supplying liquid to said bubble generating area through said through hole, wherein the liquid supply to the second liquid flow path is performed, with respect to the substrate and an opposite surface opposed to the providing surface, in a direction from the opposite surface to the providing surface.

25. A liquid discharge head comprising:

a discharge port for discharging liquid, liquid flow paths conductively connected with said discharge port, bubble generating areas having a heat generating element in a position facing said discharge port to create bubbles in liquid, the heat generating element being disposed on a providing surface of a substrate, and a movable member having a free end, lying between said discharge port and said heat generating element and being arranged accordingly between said liquid flow paths and said bubble generating areas to displace said free end to said liquid flow path side by pressure exerted by the creation of bubble in said bubble generating area for leading said pressure to said discharge port side, said liquid discharge head being provided with a through hole arranged at a central portion of said heat generating element, a first supply path for supplying liquid to said liquid flow path, and a second supply path for supplying liquid to said bubble generating area, wherein the liquid supply to the second liquid flow path is performed, with respect to the substrate and an opposite surface opposed to the providing surface, in a direction from the opposite surface to the providing surface.

26. A liquid discharge head according to claim 24 or 25, wherein liquid applied to said first liquid flow path and liquid applied to said second liquid flow path are the same liquid.

27. A liquid discharge head according to claim 24 or 25, wherein liquid applied to said first liquid flow path and liquid applied to said second liquid flow path are different liquids.

28. A liquid discharge head according to any one of claims 22 to 25, wherein said bubbles are created by film boiling phenomenon generated in said liquid by heat generated by said heat generating element.

29. A liquid discharge head according to any one of claims 22 to 25, wherein said heat generating element is an electrothermal transducing element having a heat generating resisting element for generating heat by receiving electric signals.

30. A liquid discharge head cartridge comprising:

a liquid discharge head according to claim 16;

a first liquid container for containing a first liquid;

a second liquid container for containing a second liquid;

first liquid supply means for supplying the first liquid from the first liquid container to said liquid discharge head; and second liquid supply means for supplying the second liquid from the second liquid container to said liquid discharge head.

31. A liquid discharge head cartridge according to claim 30, wherein said liquid discharge head, and said first and second liquid containers are separable.

32. A liquid discharge head cartridge comprising:

a liquid discharge head according to any one of claims 22, 24 and 25;

a liquid container containing the liquid that is supplied to said liquid discharge head; and supply means for supplying the liquid from the liquid container to the liquid discharge head.

33. A liquid discharge apparatus for recording on a recording medium using a liquid discharge head according to claim 16, comprising a carriage reciprocable in the sub-scanning direction upon which the liquid discharge head is mounted.

34. A liquid discharge apparatus comprising:

a liquid discharge head according to any one of claims 22, 24 and 25; and supplying means for supplying a plurality of driving signals to said liquid discharge head, wherein said liquid discharge head elects the liquid in response to the driving signals.

35. A liquid discharge apparatus comprising:

a liquid discharge head according to any one of claims 22, 24 and 25; and recording medium carrier means for carrying a recording medium which receives the liquid that is discharged from said liquid discharge head.

* * * * *

UNITED STATES PATENT AND TRADEMARK OFFICE

CERTIFICATE OF CORRECTION

PATENT NO. : 6,109,735
DATED : August 29, 2000
INVENTOR(S) : Toshio Kashino et al.

It is certified that error appears in the above-identified patent and that said Letters Patent is hereby corrected as shown below:

Column 2,
Line 51, "that" should read -- that is --.

Column 3,
Line 34, "transduing" should read -- transducing --.

Column 5,
Line 5, "is to" should read -- to --.

Column 7,
Line 35, "paths" should read -- path is --; and
Line 52, "elements," should read -- element, --.

Column 8,
Line 8, "is supplied" should read -- supply; and
Line 49, "head" should read -- heads --.

Column 12,
Line 30, "$V_A$" should read -- $V_A$, --; and
Line 33, "from the position almost half" should read -- from positions corresponding to almost half --.

Column 21,
Line 42, "deicing" should read -- dicing --.

Column 23,
Line 1, "supplied" should read -- is supplied --;
Line 6, "branched" should read -- branches --;
Line 20, "showing" should read -- shows --.

Column 24,
Line 5, "deicing" should read -- a dicing --.

Column 25,
Line 30, "arranged" should read -- arrangement --; and
Line 56, "that" should read -- that is --.

UNITED STATES PATENT AND TRADEMARK OFFICE

CERTIFICATE OF CORRECTION

PATENT NO. : 6,109,735
DATED : August 29, 2000
INVENTOR(S) : Toshio Kashino et al.

It is certified that error appears in the above-identified patent and that said Letters Patent is hereby corrected as shown below:

Column 26,
Line 18, "are in" should read -- to be in --.

Column 28,
Line 35, "area" should read -- areas --.

Column 29,
Line 4, "area" should read -- areas --;
Line 28, "foiling" should read -- boiling --; and
Line 41, "air" should read -- an air --.

Column 30,
Line 57, "discharge" should read -- discharged --.

Column 31,
Line 37, "air" should read -- the air --;
Line 53, "port" should read -- ports --;
Line 55, "off set" should read -- offset --; and
Line 59, "enter" should read -- entire --.

Column 33,
Line 7, "shows" should read -- show --; and
Line 38, "plyimide" should read -- polyimide --.

Column 34,
Line 20, "give" should read -- given --.

Column 35,
Line 18, "liquid" should read -- liquid at --; and
Line 39, "n-hexan," should read -- n-hexane, --.

Column 36,
Line 10, "leathers" should read -- leathers, --.

Column 37,
Line 6, "area" should read -- areas --; and
Line 29, "receding" should read -- recording --.

UNITED STATES PATENT AND TRADEMARK OFFICE

CERTIFICATE OF CORRECTION

PATENT NO. : 6,109,735
DATED : August 29, 2000
INVENTOR(S) : Toshio Kashino et al.

It is certified that error appears in the above-identified patent and that said Letters Patent is hereby corrected as shown below:

Column 38,
Line 33, "ink," should read -- inks, --; and
Line 63, "lays" should read -- rays --.

Column 39,
Line 4, "Also," should read -- Also, when --;
Line 5, "to provide" should read -- provides --;
Line 8, "as" should read -- is used as --;
Line 41, "ink the ink filing means 530 is filled" should read -- ink in the ink filling means 530 fills the --; and
Line 44, "filing" should read -- filling --.

Column 40,
Line 7, "and" should read -- in which --.

Column 41,
Line 28, "bubble," should read -- bubbles, --;
Line 31, "free" should read -- a free --;
Line 55, "bubble," should read -- bubbles, --; and
Line 59, "free" should read -- a free --.

Column 42,
Line 13, "and said" should read -- and said second -- and
Line 19, "bubbles" should read -- bubbles are --.

Column 43,
Line 5, "element" should read -- elements --;
Line 35, "separation" should read -- said separation --;
Line 54, "the" should read -- said -- and "having" should read -- has --;
Line 58, "passage" should read -- a passage --; and
Line 66, "pas-" should read -- a pas- --.

UNITED STATES PATENT AND TRADEMARK OFFICE

CERTIFICATE OF CORRECTION

PATENT NO. : 6,109,735
DATED : August 29, 2000
INVENTOR(S) : Toshio Kashino et al.

It is certified that error appears in the above-identified patent and that said Letters Patent is hereby corrected as shown below:

Column 44,
Line 6, "passage" should read -- a passage --;
Line 7, "paths" should read -- path --;
Line 16, "free" should read -- a free --;
Line 37, "a having" should read -- having a --;
Line 38, "arrange" should read -- arranged -- and
Line 42, "free" should read -- a free --.

Column 45,
Line 4, "bubble" should read -- bubbles --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*